US007546046B2

(12) United States Patent
Ishibashi

(10) Patent No.: US 7,546,046 B2
(45) Date of Patent: Jun. 9, 2009

(54) METHOD AND APPARATUS FOR CONTROLLING AN IMAGE DENSITY

(75) Inventor: Hitoshi Ishibashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/102,056

(22) Filed: Apr. 14, 2008

(65) Prior Publication Data

US 2008/0199194 A1 Aug. 21, 2008

Related U.S. Application Data

(62) Division of application No. 11/475,959, filed on Jun. 28, 2006, now Pat. No. 7,398,026, which is a division of application No. 10/798,382, filed on Mar. 12, 2004, now Pat. No. 7,139,511.

(30) Foreign Application Priority Data

Mar. 14, 2003 (JP) ..... 2003-070064
May 28, 2003 (JP) ..... 2003-151195
May 28, 2003 (JP) ..... 2003-151219

(51) Int. Cl.
*G03G 15/00* (2006.01)

(52) U.S. Cl. ..... 399/49; 399/53

(58) Field of Classification Search ..... 399/49, 399/53, 55, 72, 74, 41, 27
See application file for complete search history.

(56) References Cited

U.S. PATENT DOCUMENTS 5,053,822 A 10/1991 Butler
5,162,874 A 11/1992 Butler
5,438,401 A 8/1995 Murayama et al.
5,623,330 A 4/1997 Ishibashi
5,659,843 A 8/1997 Takano et al.
5,991,558 A 11/1999 Emi et al.
6,360,065 B1 3/2002 Ishibashi et al.
6,456,803 B2 9/2002 Suzuki et al.
6,470,161 B2 10/2002 Fujishiro et al.
6,505,022 B2 1/2003 Kosuge et al.
6,519,428 B1 2/2003 Ohtoshi et al.
6,546,219 B2 4/2003 Sato et al.

(Continued)

FOREIGN PATENT DOCUMENTS

JP 55-127571 10/1980

(Continued)

*Primary Examiner*—David M Gray
*Assistant Examiner*—Laura K Roth
(74) *Attorney, Agent, or Firm*—Oblon, Spivak, McClelland, Maier & Neustadt, P.C.

(57) ABSTRACT

An amount of toner transfer on a reference pattern is calculated by using an optical detecting unit that detects both regular reflection light and diffuse reflection light from a detection target simultaneously, based on a relative ratio between a value obtained by subtracting a result of multiplying a "diffuse reflection output" by a "minimum value of a ratio between a regular reflection output and the diffuse reflection output" from the "regular reflection output" of the density detection reference pattern, and a value obtained by subtracting a result of multiplying the "diffuse reflection output" by a "minimum value of a ratio between the regular reflection output and the diffuse reflection output" from the "regular reflection output" in the background of a transfer belt or an intermediate transfer body.

4 Claims, 31 Drawing Sheets

U.S. PATENT DOCUMENTS

| | | | |
|---|---|---|---|
| 6,633,734 | B2 | 10/2003 | Maebashi et al. |
| 6,731,888 | B2 | 5/2004 | Suzuki et al. |
| 6,853,817 | B2 | 2/2005 | Suzuki et al. |
| 7,305,195 | B2 | 12/2007 | Ishibashi |
| 2002/0098005 | A1 | 7/2002 | Takeuchi et al. |
| 2003/0049039 | A1 | 3/2003 | Suzuki |
| 2004/0008245 | A1 | 1/2004 | Hirai et al. |
| 2008/0050134 | A1 | 2/2008 | Ishibashi |

FOREIGN PATENT DOCUMENTS

| | | |
|---|---|---|
| JP | 5-249787 | 9/1993 |
| JP | 5-333652 | 12/1993 |
| JP | 8-12310 | 5/1996 |
| JP | 8-219990 | 8/1996 |
| JP | 8-271230 | 10/1996 |
| JP | 2577354 | 1/1997 |
| JP | 9-73215 | 3/1997 |
| JP | 2729976 | 3/1998 |
| JP | 10/221902 | 8/1998 |
| JP | 11-174753 | 7/1999 |
| JP | 11-249373 | 9/1999 |
| JP | 2000-39746 | 2/2000 |
| JP | 2000-66463 | 3/2000 |
| JP | 2000/227692 | 8/2000 |
| JP | 2000-231254 | 8/2000 |
| JP | 2000-250286 | 9/2000 |
| JP | 2000-267369 | 9/2000 |
| JP | 2000-275167 | 10/2000 |
| JP | 2001-34027 | 2/2001 |
| JP | 3155555 | 4/2001 |
| JP | 2001-194843 | 7/2001 |
| JP | 2001-215762 | 8/2001 |
| JP | 2001-215850 | 8/2001 |
| JP | 2001-312115 | 11/2001 |
| JP | 2001-324840 | 11/2001 |
| JP | 2002-40746 | 2/2002 |
| JP | 2002-72612 | 3/2002 |
| JP | 2003-76129 | 3/2003 |

METHOD AND APPARATUS FOR CONTROLLING AN IMAGE DENSITY

CROSS-REFERENCE TO RELATED APPLICATIONS

This application is a divisional application of U.S. patent application Ser. No. 11/475,959, filed Jun. 28, 2006, now U.S. Pat. No. 7,398,026 which is a divisional of U.S. patent application Ser. No. 10/798,382 filed Mar. 12, 2004, now U.S. Pat. No. 7,139,511 and claims the benefit of priority under 35 U.S.C. §119 from Japanese Patent Application priority documents, 2003-070064 filed in Japan on Mar. 14, 2003, 2003-151195 and 2003-151219 filed in Japan on May 28, 2003.

BACKGROUND OF THE INVENTION

1) Field of the Invention

The present invention relates to a regular reflection output conversion method, a diffuse reflection output conversion method, and a toner amount-of-transfer conversion method, in transfer detection of toner such as toner, and an image forming apparatus such as a copying machine, a printer, a facsimile, and a plotter, capable of executing these methods, a toner transfer detection apparatus capable of executing these methods, and a gradation pattern used for these methods.

2) Description of the Related Art

Conventionally, in an image forming apparatus such as a copying machine and a laser beam printer using the electrophotographic method, a toner patch for density detection (hereinafter, "density pattern" or "density detection pattern") is formed on an image carrier such as a photosensitive material, in order to obtain a stable image density at all times, the patch density is detected by an optical detecting unit, and based on the detection result, the development potential is changed (specifically, an LD power, a charging bias, and a development bias are changed).

In a case of a two-component development method, image density is controlled so that the maximum target transfer (a transfer for obtaining a target ID) becomes an intended value, by changing a target value for toner density control in a development unit.

For such a detecting unit for density detection patch, a reflecting type optical sensor including a light emitting diode and a photodetector is generally used. In the image forming apparatus, since a formed reference pattern is detected, the sensor is referred to as a P (pattern) sensor. Further, a light emitting diode (LED) is generally used for the light emitting diode for the P sensor, and a photodiode (PD) or a phototransistor (PTr) is generally used for the photodetector.

As the sensor configuration, there are three types, that is, (1) a type of detecting only regular reflection light, as illustrated in FIG. 14 (See for example, Japanese Patent Application Laid-Open No. 2001-324840), (2) a type of detecting only diffuse reflection light, as illustrated in FIG. 15 (See, for example, Japanese Patent Application Laid-Open No. H5-249787 and Japanese Patent Publication No. 3155555), and (3) a type of detecting both as illustrated in FIG. 16 (See, for example, Japanese Patent Application Laid-Open No. 2001-194843). Reference signs 250A, 250B, and 250C denote element holders, 251 denotes an LED, 252 denotes a regular reflection photodetector, 253 denotes a detection target surface, 254 denotes a toner patch on the detection target surface, and 255 denotes a diffuse reflection photodetector.

Recently, as illustrated in FIG. 17, a type in which a beam splitter is provided on the optical path on the light emission side and light reception side is also used frequently (4) (See, for example, Japanese Patent Publication No. 2729976 and Japanese Patent Application Laid-Open Nos. H10-221902 and 2002-72612). Reference sign 256 denotes an LED, 257 and 258 denote a beam splitter, 259 denotes a photodiode as a light receiving unit with respect to P-ray light (regular reflection light), and 260 denotes a photodiode as a light receiving unit with respect to S-ray light (diffuse reflection light).

A color image forming apparatus including one drum (photosensitive drum), revolver development, and an intermediate transfer body has been heretofore predominant. However, due to the recent trend of high speed and high function of the color image output unit, a so-called tandem-type color image forming apparatus becomes predominant recently, which has a configuration such that a plurality of imaging units (for example, units for four colors) including an image carrier, a development apparatus, and the like is arrayed opposite to a transfer belt, and toner images on the image carriers are sequentially transferred onto transfer paper (or a transfer belt).

In the image forming apparatus having a plurality of imaging units, arrangement of an optical detecting unit for density detection for each image carrier in each imaging unit leads to a cost increase. Further, a photosensitive material having a diameter as small as 40 millimeters or less has been recently used, in order to decrease a size of a whole system. In a system using such a small-diameter photosensitive material, however, there is no space to arrange the optical detecting unit for density detection around the photosensitive material. Therefore, such a method is adopted that a toner patch for density detection formed on the image carrier in the respective imaging units is transferred onto the transfer belt, and these density patches are detected by a sensor arranged opposite to the transfer belt.

However, when a density patch for each color is formed on the transfer belt, problems described below occur with the lapse of time. That is, as for the transfer belt and the intermediate transfer belt, a belt cannot be easily replaced by users, and since the cost of the whole belt unit is high, a longer service life is often set as compared with that of the photosensitive unit and the development unit. However, since the transfer belt is brought into contact with the transfer paper at all times, both in the tandem-type direct transfer method in which the transfer belt directly transfers a toner image on an image carrier onto paper carried on the belt, and in the intermediate transfer method in which the respective color toner images formed on the intermediate transfer belt are collectively transferred onto paper, the surface of the transfer belt becomes rough due to paper dust with the lapse of time.

When the surface of the transfer belt or the intermediate transfer belt becomes rough with the lapse of time, if detection is attempted by a density detection sensor of a regular reflection output type as illustrated in FIG. 14, as the surface roughness in the background of the transfer belt deteriorates, the sensor output difference between the background and a low transfer patch decreases. Therefore, in the case of a color toner, if the surface roughness Rz (10-points average roughness) of the transfer belt becomes equal to or lower than 1.0 micrometers, only a transfer of 0.2 $mg/cm^2$ at maximum can be detected with respect to a transfer target value in a solid part, 0.6 $mg/cm^2$ (for the Bk toner, detection is possible up to 0.4 $mg/cm^2$ at maximum).

FIGS. 3 and 4 are graphs illustrating the relation between the amount of toner transfer and the sensor output (regular reflection light) when the surface roughness of the transfer belt is different (3 types), respectively in the black toner and the color toners. From these graphs, it is seen that as the surface roughness in the background of the transfer belt deteriorates (the value of Rz increases), a change in the output when the amount of toner transfer changed is small (a sensor output difference due to the transfer decreases).

In the above explanation and FIG. 4, in the case of a color toner, the reason why the maximum value of transfer detectable by the regular reflection output is set to 0.2 mg/cm$^2$ when Rz is equal to or larger than 1.0 micrometer (marks ○ and ◇ in FIG. 4) is that the range in which transfer detection by the regular reflection output is possible is an area where the regular reflection output with respect to the transfer indicates a monotonous decrease, that is, a transfer area from a low density pattern portion to a pattern portion giving a minimum value in the output voltage in order in the continuous gradation pattern.

The reason why the regular reflection output changes from a monotonous decrease to a monotonous increase at a certain transfer (0.2 to 0.4 mg/cm$^2$) or more is that as illustrated in FIG. 31, in color toners, the diffuse reflection light from the toner increases with an increase in the transfer, and the diffuse reflection components enter into the regular reflection photodetector.

FIG. 31 is a diagram illustrating the situation in which a belt surface and a solid part of the color toner (cyan here) are detected by the P sensor, wherein in the case of reflection on the belt surface (left side in the figure), diffuse reflection light is small, and hence the influence on the regular reflection photodetector 252 is small. On the other hand, in the case of a cyan solid part (right side in the figure), the diffuse reflection light increases, and is detected by the regular reflection photodetector 252, together with the regular reflection light.

When a transfer belt applied with surface coating is used (that is, in the tandem-type direct transfer method in which toner images are directly transferred from the respective image carriers arranged in tandem onto recording medium supported and carried on the transfer belt, when high-resistance coating is applied on the belt surface in order to obtain a necessary function of electrostatically attracting the paper onto the transfer belt reliably, or in the intermediate transfer belt method, when high-resistance coating is applied on the belt surface in order to prevent dust on superposed images formed on the belt), the surface characteristics expressed by roughness and gloss level certainly deteriorate due to coating as compared with the surface of a base layer of a single-element substance of resin, in addition to deterioration due to wear. Therefore, there is a problem in that the margin with respect to the service life decreases.

On the other hand, if a diffuse reflection sensor as illustrated in FIG. 15 is used, sensor output characteristics of monotonously increasing with an increase in the amount of the color toner transfer, as illustrated in the graph of FIG. 5, can be obtained without being affected by the belt surface characteristics expressed by the roughness and gloss level on the belt surface. As a result, transfer detection is possible up to a high transfer area. On the contrary, there are problems in that, as illustrated in the graph of FIG. 6, this type of sensor is difficult to handle because sensitivity adjustment cannot be performed due to a difference in sensitivity of the sensor in the belt background, since the sensor output in the background of the transfer belt is substantially zero, and on a black transfer belt in which carbon is dispersed such as the transfer belt, detection itself is not possible, since the sensor sensitivity against an increase in transfer is zero with respect to the black (Bk) toner having substantially the same absorption property as the transfer belt.

When sensitivity adjustment of the optical sensor of the diffuse reflection light detection type is performed, adjustment is required so that the output at a transfer (equivalent), where the sensor output is sufficiently high, becomes a predetermined value (as a specific example, for example, the sensor sensitivity is adjusted so that an output voltage value with respect to a certain reference white board inspection plate becomes a predetermined value at the time of factory shipment). However, even if such adjustment is performed initially, the age-based sensitivity changes due to the temperature characteristics of the sensor or deterioration of the light emitting diode, thereby causing a problem in that age-based guarantee is difficult.

Therefore, a method in which a sensor of a type using both regular reflection output and diffuse reflection output is used, so as to detect the black toner by the regular reflection light and color toners by the diffuse reflection light is desired. However, as described above, with regard to the color toners, the diffuse reflection output type sensor is difficult to handle because the sensitivity cannot be adjusted.

In the color image forming apparatus, since a change in the image density leads to a change in hue, it is important to accurately detect the transfer on the density detection pattern to perform density control, in order to stabilize the image density.

The image density to be stabilized here indicates the "image density of the output image". Therefore, while the conventional monochrome image forming apparatus performs density detection on the photosensitive material, in the color image forming apparatus, it is desired to perform density detection on the transfer belt immediately before being transferred onto the paper. Further, since the purpose of the image density control is to perform control so that the maximum target transfer becomes an aimed value, it is desired that accurate detection up to a high transfer area is possible.

However, in the conventional detection method, it is difficult to detect the transfer stably and accurately at all times over the whole transfer area.

SUMMARY OF THE INVENTION

It is an object of the present invention to solve at least the problems in the conventional technology.

The image forming apparatus according to one aspect of the present invention includes a plurality of image carriers; a color image forming unit that sequentially transfers toner images formed on each of the image carriers onto a recording medium that is carried on a transfer belt to form a color image; an optical detecting unit that transfers a reference pattern for density detection formed on each of the image carriers for each color onto the transfer belt, and detects the reference pattern transferred; and an image density control unit that controls image density based on a result of the detection by the optical detecting unit. The optical detecting unit detects both regular reflection light and diffuse reflection light from a detection target simultaneously. The image density control unit controls the image density based on a value obtained by subtracting a result of multiplying a diffuse reflection output by a minimum value of a ratio between a regular reflection output and the diffuse reflection output from the regular reflection output of the reference pattern for each color detected by the optical detecting unit.

The image forming apparatus according to another aspect of the present invention includes a plurality of image carriers; a color image forming unit that sequentially transfers toner images formed on each of the image carriers onto an intermediate transfer body to form a color image on the intermediate transfer body, and collectively transfers the color image onto a recording medium; an optical detecting unit that transfers a reference pattern for density detection formed on each of the image carriers for each color onto the intermediate transfer body, and detects the reference pattern transferred; and an image density control unit that controls image density based on a result of the detection by the optical detecting unit. The optical detecting unit detects both regular reflection light and diffuse reflection light from a detection target simultaneously. The image density control unit controls the image density based on a value obtained by subtracting a result of multiplying a diffuse reflection output by a minimum value of a ratio between a regular reflection output and the diffuse reflection output from the regular reflection output of the reference pattern for each color detected by the optical detecting unit.

The image forming apparatus according to still another aspect of the present invention includes an image carrier; a color image forming unit that repeatedly transfers a toner image formed on the image carrier onto an intermediate transfer body to form a color image, and collectively transfers the color images onto a recording medium; an optical detecting unit that transfers a reference pattern for density detection formed on each of the image carriers for each color onto the intermediate transfer body, and detects the reference pattern transferred; and an image density control unit that controls image density based on a result of the detection by the optical detecting unit. The optical detecting unit detects both regular reflection light and diffuse reflection light from a detection target simultaneously. The image density control unit controls the image density based on a value obtained by subtracting a result of multiplying a diffuse reflection output by a minimum value of a ratio between a regular reflection output and the diffuse reflection output from the regular reflection output of the reference pattern for each color detected by the optical detecting unit.

The method of calculating an amount of toner transfer on a reference pattern by detecting the reference pattern transferred onto a transfer belt or an intermediate transfer body from an image carrier, according to still another aspect of the present invention includes detecting both regular reflection light and diffuse reflection light from a detection target simultaneously; and calculating the amount of toner transfer on the reference pattern based on a relative ratio between a value obtained by subtracting a result of multiplying a diffuse reflection output by a minimum value of a ratio between a regular reflection output and the diffuse reflection output from the regular reflection output of the reference pattern, and a value obtained by subtracting a result of multiplying the diffuse reflection output by a minimum value of a ratio between the regular reflection output and the diffuse reflection output from the regular reflection output in a background of the transfer belt or the intermediate transfer body.

The method of converting a regular reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; extracting a regular reflection light component by separating a regular reflection output from the gradation pattern detected into the regular reflection light component and a diffuse reflection light component; converting the regular reflection light component into a normalized value; and acquiring a first-order linear relation between the normalized value and the amount of toner transfer within a range in which detection of the amount of toner transfer by the regular reflection light is possible.

The method of converting a regular reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; multiplying a diffuse reflection output by a minimum value of a ratio between a regular reflection output and the diffuse reflection output from the gradation pattern detected; subtracting a result of the multiplying from the regular reflection output; converting a ratio between a result of the subtracting and the regular reflection output from the surface of the detection target into a normalized value; and acquiring a first-order linear relation between the normalized value and the amount of toner transfer within a range in which detection of the amount of toner transfer by the regular reflection light is possible.

The method of converting a regular reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; obtaining a regular reflection output increment and a diffuse reflection output increment from a difference of each output values between at an ON time of a light source for the detecting and at an OFF time of the light source; multiplying the diffuse reflection output increment by a minimum value of a ratio between the regular reflection output increment and the diffuse reflection output increment; subtracting a result of the multiplying from the regular reflection output increment; converting a ratio between a result of the subtracting and the regular reflection output increment from the surface of the detection target into a normalized value; and acquiring a first-order linear relation between the normalized value and the amount of toner transfer within a range in which detection of the amount of toner transfer by the regular reflection light is possible.

The method of converting a diffuse reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; extracting a regular reflection light component by separating a regular reflection output from the gradation pattern detected into the regular reflection light component and a diffuse reflection light component; converting the regular reflection light component into a normalized value; multiplying the normalized value by a background diffuse reflection output directly reflected from a background of the surface of the detection target; obtaining a diffuse-reflection-output conversion value by subtracting a result of the multiplying from the diffuse reflection output; and acquiring a first-order linear relation between the diffuse-reflection-output conversion value and the amount of toner transfer within a range in which detection of the amount of toner transfer by the regular reflection light is possible.

The method of converting a diffuse reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; multiplying a diffuse reflection output by a minimum value of a ratio between a regular reflection output and the diffuse reflection output from the gradation pattern detected; subtracting a result of the multiplying from the regular reflection output; converting a ratio between a result of the subtracting and the regular reflection output from the surface of the detection target into a normalized value; multiplying the normalized value by a background diffuse reflection output directly reflected from a background of the surface of the detection target; obtaining a diffuse reflection output conversion value by subtracting a result of multiplying from the diffuse reflection output; and acquiring a first-order linear relation between the diffuse-reflection-output conversion value and the amount of toner transfer within a range in which detection of the amount of toner transfer by the regular reflection light is possible.

The method of converting a diffuse reflection output into an amount of toner transfer, according to still another aspect of the present invention includes detecting optically a plurality of gradation patterns of toner formed continuously on a surface of a detection target with different amount of toner transferred by detecting both regular reflection light and diffuse reflection light simultaneously from the detection target; obtaining a regular reflection output increment and a diffuse reflection output increment from a difference of each output values between at an ON time of a light source for the detecting and at an OFF time of the light source; multiplying the diffuse reflection output increment by a minimum value of a ratio between the regular reflection output increment and the diffuse reflection output increment; subtracting a result of the multiplying from the regular reflection output increment; converting a ratio between a result of the subtracting and the regular reflection output increment from the surface of the detection target into a normalized value; multiplying the normalized value by the a diffuse reflection output increment obtained from a difference between the diffuse reflection output at an ON time of a light source for the detecting and the diffuse reflection output at an OFF time of the light source; obtaining a diffuse reflection output conversion value by subtracting a result of multiplying from the diffuse reflection output increment; and acquiring a first-order linear relation between the diffuse-reflection-output conversion value and the amount of toner transfer within a range in which detection of the amount of toner transfer by the regular reflection light is possible.

The method of converting a diffuse reflection output into an amount of toner transfer, according to still another aspect of the present invention converting the diffuse reflection output conversion value into the amount of toner transfer by multiplying a correction factor by which the diffuse reflection output conversion value corresponding to an arbitrary regular reflection output conversion value becomes a predetermined value, based on a first-order linear relation between a regular reflection output conversion value obtained by the method according to the above aspect and a diffuse reflection output conversion value obtained by the method according to the above aspect.

The method of obtaining an amount of powder transfer, according to still another aspect of the present invention includes forming a plurality of gradation patterns continuously on a surface of a detection target; detecting optically the gradation patterns by detecting both regular reflection light and diffuse reflection light simultaneously from the detection target; extracting a regular reflection light component by separating a regular reflection output from the gradation pattern detected into the regular reflection light component and a diffuse reflection light component; converting the regular reflection light component into a normalized value; obtaining the amount of powder transfer from a relational expression or a table data between a predetermined amount of powder transfer and the normalized value.

The method of obtaining an amount of powder transfer, according to still another aspect of the present invention forming a plurality of gradation patterns continuously on a surface of a detection target; detecting optically the gradation patterns by detecting both regular reflection light and diffuse reflection light simultaneously from the detection target; multiplying a diffuse reflection output by a minimum value of a ratio between a regular reflection output and the diffuse reflection output from the gradation pattern detected; subtracting a result of the multiplying from the regular reflection output; converting a ratio between a result of the subtracting and the regular reflection output from the surface of the detection target into a normalized value; and obtaining the amount of powder transfer from a relational expression or a table data between a predetermined amount of powder transfer and the normalized value.

The method of obtaining an amount of powder transfer, according to still another aspect of the present invention includes forming a plurality of gradation patterns continuously on a surface of a detection target; detecting optically the gradation patterns by detecting both regular reflection light and diffuse reflection light simultaneously from the detection target; obtaining a regular reflection output increment and a diffuse reflection output increment from a difference of each output values between at an ON time of a light source for the detecting and at an OFF time of the light source; multiplying the diffuse reflection output increment by a minimum value of a ratio between the regular reflection output increment and the diffuse reflection output increment; subtracting a result of the multiplying from the regular reflection output increment; converting a ratio between a result of the subtracting and the regular reflection output increment from the surface of the detection target into a normalized value; and obtaining the amount of powder transfer from a relational expression or a table data between a predetermined amount of powder transfer and the normalized value.

The method of obtaining an amount of powder transfer, according to still another aspect of the present invention includes obtaining a diffuse reflection output conversion value into the amount of powder transfer by multiplying a correction factor by which the diffuse reflection output conversion value corresponding to an arbitrary regular reflection output conversion value becomes a predetermined value, based on a first-order linear relation between a regular reflection output conversion value obtained by the method according to the above aspect and a diffuse reflection output conversion value obtained by the method according to the above aspect; and obtaining the amount of powder transfer from a relational expression or a table data between a predetermined amount of powder transfer and the diffuse reflection output conversion value.

The image forming apparatus according to still another aspect of the present invention forms a color image by sequentially superposing toner images formed on a plurality of image carriers onto a recording medium carried on a transfer body. The method according to the above aspect is executed by using the transfer body as the detection target and toner as the powder.

The image forming apparatus according to still another aspect of the present invention forms a color image by sequentially superposing toner images formed on a plurality of image carriers onto a recording medium carried on the image carriers. The method according to the above aspect is executed by using the image carriers as the detection target and toner as the powder.

The image forming apparatus according to still another aspect of the present invention forms a color image by sequentially superposing toner images formed on a plurality of image carriers onto an intermediate transfer body, and collectively transfers the color image onto a recording medium. The method according to the above aspect is executed by using the intermediate transfer body as the detection target and toner as the powder.

The image forming apparatus according to still another aspect of the present invention forms a color image by sequentially superposing toner images formed on a plurality of image carriers onto an intermediate transfer body, and collectively transfers the color image onto a recording medium. The method according to the above aspect is executed by using the image carriers as the detection target and toner as the powder.

The image forming apparatus according to still another aspect of the present invention forms a color image by sequentially superposing toner images formed on an image carrier onto an intermediate transfer body, and collectively transfers the color image onto a recording medium. The method according to the above aspect is executed by using the intermediate transfer body as the detection target and toner as the powder.

The image forming apparatus according to still another aspect of the present invention forms a color image by sequentially superposing toner images formed on an image carrier onto an intermediate transfer body, and collectively transfers the color image onto a recording medium. The method according to the above aspect is executed by using the image carrier as the detection target and toner as the powder.

The apparatus for detecting an amount of toner transfer according to still another aspect of the present invention executes the method according to the above aspect.

The gradation pattern according to still another aspect of the present invention is used for the method according to above aspect. The gradation pattern has at least one pattern of the amount of toner transfer near an amount of toner transfer where a minimum value of the ratio between the regular reflection output and the diffuse reflection output is obtained.

The gradation pattern according to still another aspect of the present invention is used for the method according to the above aspect. The gradation pattern has at least one pattern of the amount of toner transfer near an amount of toner transfer where a minimum value of the ratio between the regular reflection output increment and the diffuse reflection output increment obtained by a difference of each output values between at an ON time of a light source for the detecting and at an OFF time of the light source.

The gradation pattern according to still another aspect of the present invention is used for the method according to the above aspect. The gradation pattern has at least one pattern of the amount of toner transfer in a range of the amount of toner transfer where the regular reflection output conversion value is in a first-order linear relation with respect to the amount of toner transfer.

The method of controlling a powder density, according to still another aspect of the present invention includes forming a plurality of predetermined gradation patterns of powder having different amount of powder transfer continuously on a surface of a detection target; detecting optically the gradation patterns; acquiring either of detecting data and arithmetic processing data based on the detecting data; storing data that is obtained only by detecting of the predetermined gradation patterns, and is necessary for maintaining accuracy in density control with a fewer patterns than the predetermined gradation patterns to the level equal to the accuracy in density control with the predetermined gradation patterns from among the data acquired in a memory; and using the data stored when controlling the powder density with fewer patterns.

The method of controlling an image density, according to still another aspect of the present invention includes forming a plurality of predetermined gradation patterns of powder having different amount of powder transfer continuously on a surface of a detection target; detecting optically the gradation patterns; acquiring either of detecting data and arithmetic processing data based on the detecting data; storing data that is obtained only by detecting of the predetermined gradation patterns, and is necessary for maintaining accuracy in density control with a fewer patterns than the predetermined gradation patterns to the level equal to the accuracy in density control with the predetermined gradation patterns from among the data acquired in a memory; and using the data stored when controlling the image density with fewer patterns.

The method of controlling an image density, according to still another aspect of the present invention includes forming a plurality of predetermined gradation patterns of toner having different amount of toner transfer continuously on a surface of a detection target; detecting optically the gradation patterns by detecting both regular reflection light and diffuse reflection light simultaneously from the detection target; performing arithmetic processing based on detecting data of a regular reflection output and a diffuse reflection output obtained; storing data that is obtained only by detecting of the predetermined gradation patterns, and is necessary for maintaining accuracy in density control with a fewer patterns than the predetermined gradation patterns to the level equal to the accuracy in density control with the predetermined gradation patterns from among the data obtained from the performing in a memory; and using the data stored when controlling the image density with fewer patterns.

The method of controlling an image density, according to still another aspect of the present invention includes forming a plurality of predetermined gradation patterns of toner having different amount of toner transfer continuously on a surface of a detection target; detecting optically the gradation patterns by detecting both regular reflection light and diffuse reflection light simultaneously from the detection target; performing arithmetic processing based on detecting data of a regular reflection output and a diffuse reflection output obtained; storing a coefficient obtained by a process for determining a value unequivocally with respect to the amount of toner transfer from among the data arithmetically processed at the arithmetic processing step, which can be obtained only by detection of the predetermined gradation patterns, and is necessary for maintaining the accuracy in density control with a fewer patterns than the predetermined gradation patterns, to the level equal to the accuracy in density control with the predetermined gradation patterns in a memory; and using the data stored when controlling the image density with fewer patterns.

The method of controlling an image density, according to still another aspect of the present invention includes forming a plurality of predetermined gradation patterns of toner having different amount of toner transfer continuously on a surface of a detection target; detecting optically the gradation patterns by detecting both regular reflection light and diffuse reflection light simultaneously from the detection target; performing arithmetic processing based on detecting data of a regular reflection output and a diffuse reflection output obtained; storing a coefficient obtained by a process for determining a value of the amount of toner transfer from among the data arithmetically processed at the arithmetic processing step, which can be obtained only by detection of the predetermined gradation patterns, and is necessary for maintaining the accuracy in density control with a fewer patterns than the predetermined gradation patterns, to the level equal to the accuracy in density control with the predetermined gradation patterns in a memory; and using the data stored when controlling the image density with fewer patterns.

The image forming apparatus according to still another aspect of the present invention forms a color image by sequentially superposing toner images formed on a plurality of image carriers onto a recording medium carried on a transfer body. The method according to the above aspect is executed by using the transfer body as the detection.

The image forming apparatus according to still another aspect of the present invention forms a color image by sequentially superposing toner images formed on a plurality of image carriers onto a recording medium carried on a transfer body. The method according to the above aspect is executed by using the image carriers as the detection target.

The image forming apparatus according to still another aspect of the present invention forms a color image by sequentially superposing toner images formed on a plurality of image carriers onto an intermediate transfer body, and collectively transfers the color image onto a recording medium. The method according to the above aspect is executed by using the intermediate transfer body as the detection target.

The image forming apparatus according to still another aspect of the present invention forms a color image by sequentially superposing toner images formed on a plurality of image carriers onto an intermediate transfer body, and collectively transfers the color image onto a recording medium. The method according to the above aspect is executed by using the image carriers as the detection target.

The image forming apparatus according to still another aspect of the present invention forms a color image by sequentially superposing toner images formed on an image carrier onto an intermediate transfer body, and collectively transfers the color image onto a recording medium. The method according to the above aspect is executed by using the intermediate transfer body as the detection target.

The image forming apparatus according to still another aspect of the present invention forms a color image by sequentially superposing toner images formed on an image carrier onto an intermediate transfer body, and collectively transfers the color image onto a recording medium. The method according to the above aspect is executed by using the image carrier as the detection target.

The other objects, features, and advantages of the present invention are specifically set forth in or will become apparent from the following detailed description of the invention when read in conjunction with the accompanying drawings.

DETAILED DESCRIPTION

Exemplary embodiments of an image forming apparatus, a method of calculating amount of toner transfer, methods of converting regular reflection output and diffuse reflection output, a method of converting amount of toner transfer, an apparatus for detecting amount of toner transfer, a gradation pattern, and methods of controlling toner density and image density, according to the present invention are explained below with reference to the accompanying drawings.

Figure 1:
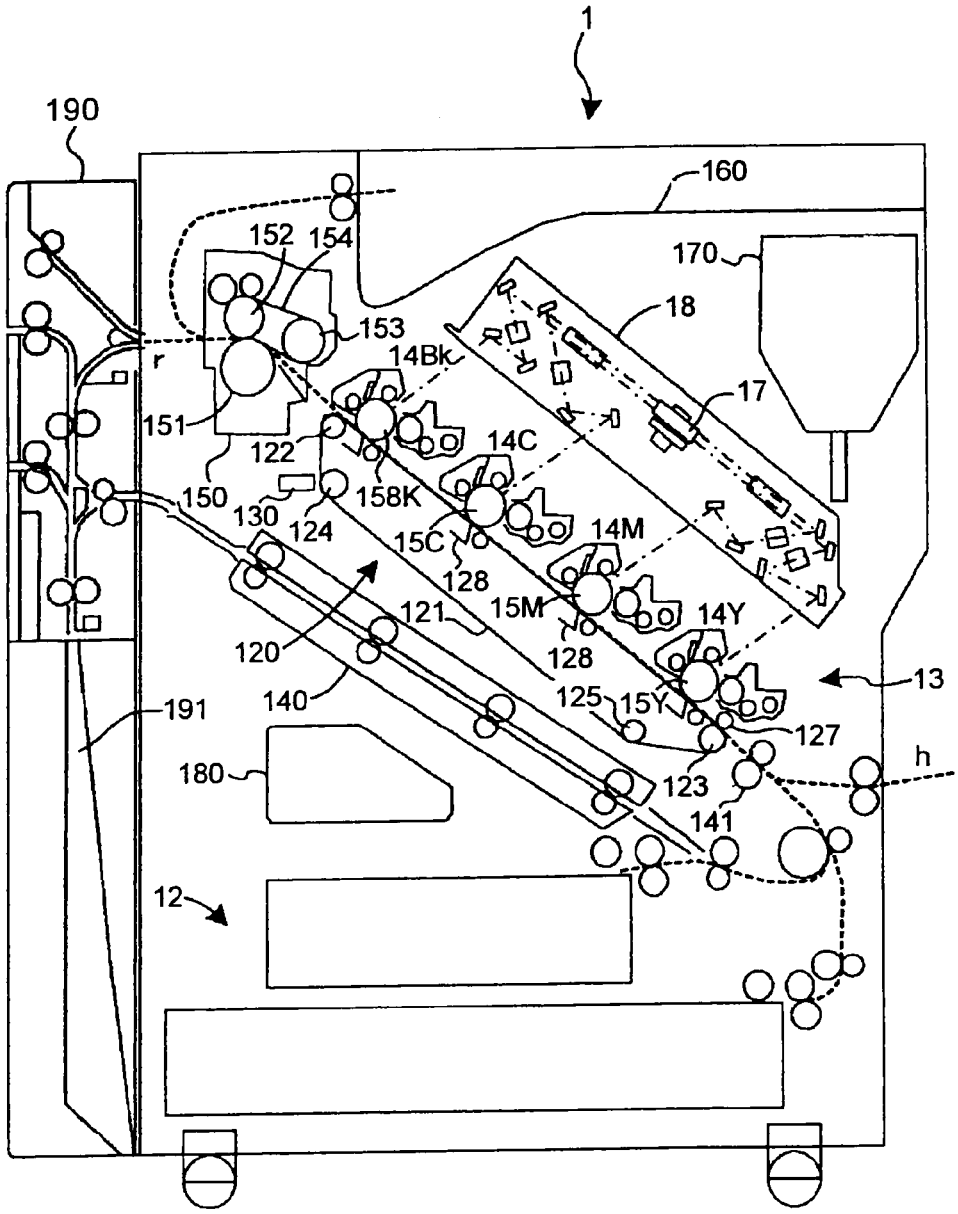
FIG. 1 is a cross sectional view illustrating a schematic configuration of a color laser printer as an example of an image forming apparatus according to the present invention.

FIG. 1 is a cross sectional view illustrating a schematic configuration of a color laser printer as an example of an image forming apparatus according to a first embodiment of the present invention. A color laser printer 1 has a configuration such that a paper feeder 12 is provided at a lower part of the apparatus, and an imaging section 13 is arranged above this. On the upper face of the apparatus, an output tray 160 is formed. As a feeding path of recording medium is indicated by a broken line, the paper is fed from the paper feeder 12, an image formed in the imaging section 13 is transferred onto the paper and fixed by a fixing apparatus 150, and the paper is ejected onto the output tray 160. Paper can be manually fed from the side of the apparatus (as indicated by a sign h).

A reversing unit 190 is mounted on the side of the apparatus, which can transport paper after fixation as indicated by a broken line r, and re-feed the paper through a re-transport section 140, after reversing the two sides of paper via the reversing unit 190. It is also configured so that paper can be ejected to an output tray (not shown) in the lateral direction of the apparatus.

In the imaging section 13, a transfer belt apparatus 120 is arranged, inclined such that the paper feeding side is down and the paper ejection side is up. Four imaging units 14Y, 14M, 14C, and 14Bk respectively for yellow (Y), magenta (M), cyan (C), and black (Bk) are arrayed in the ascending order, along the upper traveling edge of the transfer belt apparatus 120.

Since the configurations of the respective imaging units 14Y, 14M, 14C, and 14Bk are the same, the imaging unit 14M for magenta will be explained as an example.

Figure 2:
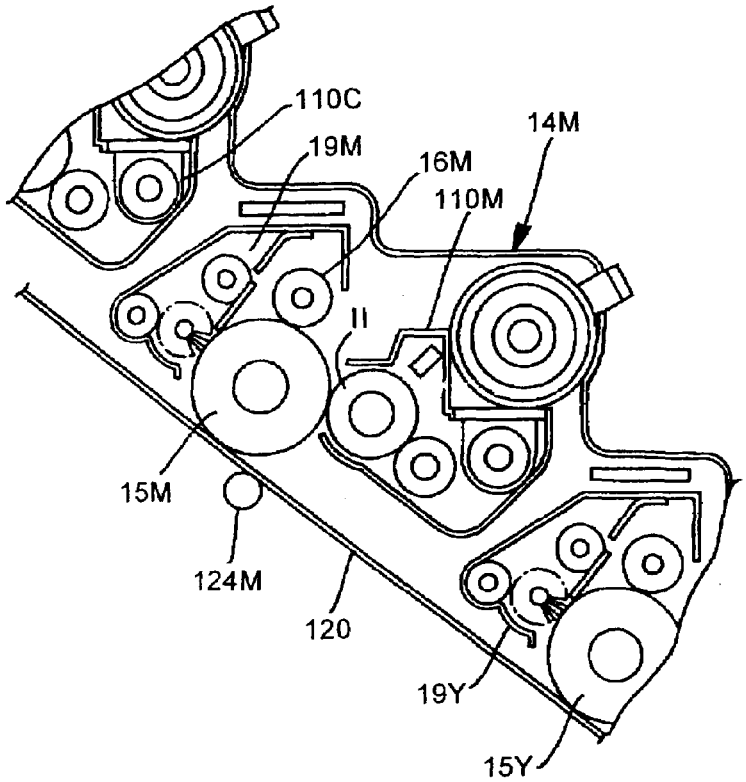
FIG. 2 is a partially enlarged view illustrating the details of an imaging unit in the color laser printer.

As illustrated in FIGS. 1 and 2, the respective imaging units 14Y, 14M, 14C, and 14Bk respectively have a photosensitive drum 15 as an image carrier, and the respective photosensitive drums 15 are rotated in the clockwise direction in the figure by a drive unit (not shown). A charging roller 16, a development unit 10, a cleaning unit 19, and the like are provided around each photosensitive drum 15. The development unit 110 applies toner carried on the developing sleeve 111 onto the photosensitive drum 15. Laser beams from an optical write unit 18 are irradiated to the photosensitive drum 15 from between the charging roller 16 and the developing sleeve 111. In FIG. 2, the respective members of the respective color imaging units are denoted by reference number with alphabet (M, C, Y) indicating the color.

A transfer belt 121 in an endless loop form is spanned over and laid across a drive roller 122, a driven roller 123, and tension rollers 124 and 125 in a tensioned condition. A transfer brush 128 is respectively arranged so as to come in contact with the belt 121, at positions facing the respective photosensitive drums 15 in the respective color imaging units 14Y, 14M, 14C, and 14Bk, inside the upper traveling edge of the transfer belt 121. A transfer bias of a reversed polarity (in this embodiment, positive) to the charging polarity of the toner (in this embodiment, negative) is applied to the transfer brush 128. A paper attracting roller 127 is provided on the upper part of the driven roller 123, putting the belt 121 therebetween. The recording medium is fed onto the belt 121 from between the driven roller 123 and the attraction roller 127, and carried with the paper electrostatically attracted on the transfer belt 121 by a bias voltage applied to the attraction roller 127. In this embodiment, the process linear velocity is 125 mm/sec, and the recording medium is carried at this speed.

The fixing apparatus 150 is of a belt fixing type in this embodiment, and a belt 154 is entrained over a fixing roller 152 and a heating roller 153. A pressure roller 151 is pressed against the fixing roller 152, to form a fixing nip. The heating roller 153 and the pressure roller 151 include a heater (not shown) built therein.

The printing operation in the color laser printer 1 in this embodiment will be explained below.

In the respective color imaging units 14Y, 14M, 14C, and 14Bk, the respective photosensitive drums 15 are rotated by a main motor (not shown), and discharged by an alternate current (hereinafter, "AC") bias (containing no direct current (hereinafter, "DC") component) applied to the charging roller 16, so that the surface potential thereof becomes a reference potential of about −50 volts in this embodiment. The respective photosensitive drums 15 are uniformly charged to the potential substantially equal to the DC component by applying the DC voltage superposed with the AC voltage to the charging roller 16, such that the surface potential thereof is charged to about −500 to −700 volts in this embodiment. The target charging potential is determined by a process controller (not shown).

In an exposure apparatus 18, laser beams are irradiated to a polygon mirror 17 by driving a laser diode (LD) (not shown) based on the image data transmitted from a host machine such as a personal computer, and led to the photosensitive drums 15 via a cylinder lens or the like. The surface potential of the photosensitive material, on which the laser beams are irradiated, becomes about −50 volts, thereby forming an electrostatic latent image to be developed by the respective color toners, respectively on the photosensitive drums 15.

Toners are applied to the latent image from the development unit 110, thereby forming respective color toner images. In this embodiment, the toner is adhered only on a part on the photosensitive drum 15 where the potential is reduced by optical write (the development potential QM: −20 to −30 μC/g), by applying the development bias (−300 to −500 volts) in which the AC voltage is superposed on the DC voltage to the developing sleeve 110, thereby forming a visual image.

On the other hand, paper specified as a transfer material is fed from the paper feeder 12, and the fed paper is once abutted against a resist roller pair 141 provided on the upstream side in the transport direction of the transfer belt apparatus 120. The paper is fed onto the belt 121, synchronized with the visual image, and reaches transfer positions facing the respective color photosensitive drums 15, with traveling of the transfer belt. At these transfer positions, visual images of the respective color toners are transferred and superposed on the paper by the operation of the transfer brushes 128 arranged on the backside of the transfer belt 121. In the color printer in this embodiment, a full color image can be formed with the same short period of time as in the case of a monochrome image.

In the case of a monochrome print, a visual image of the black toner is formed on the surface of the photosensitive drum 15 only in the black imaging unit 14Bk, and the Bk toner image is transferred to the paper fed onto the transfer belt 121, synchronized with the visual image.

The paper after transfer of the toner image is curvature-separated from the transfer belt 121 at the position of the drive roller 122 and fed to the fixing apparatus 150. In the fixing apparatus 150, the paper carrying an unfixed toner image passes through the fixing nip where the pressure roller 151 is pressed against the fixing belt 154, so that the toner image is fixed thereon by heat and pressure. The paper after fixation is ejected onto the output tray 160 provided on the upper side of the apparatus, or delivered to the reversing unit 190, as indicated by a sign r.

The paper may be ejected onto an output tray (not shown) in the lateral direction of the apparatus from the reversing unit 190, or in the case of the dual side printing, the two sides of the paper is reversed by the reversing unit 190, and the paper is re-fed to the imaging section 13 through the re-transport section 140, to form an image on the backside of the paper. The paper after dual side printing is ejected onto the output tray 160 on the upper face of the apparatus, or onto the output tray (not shown) in the lateral direction of the apparatus.

In the color laser printer in this embodiment, at the time of toner on, or every time a predetermined number of printing is performed, the process control operation for optimizing the density of the respective color images is executed. In this process control operation, a plurality of (more than three for each color in this embodiment) density detection patches (hereinafter, "reference patterns") of a continuous tone are sequentially formed and transferred at a timing such that the respective reference patterns are not superposed on each other on the transfer belt 121, by sequentially changing over the charging bias and the development bias (by changing the development potential), and these reference patterns are detected by the density detection sensor (hereinafter, "P sensor") 130.

In this embodiment, the P sensor 130 is arranged at a position facing the tension roller 124 in the transfer belt apparatus 120 (FIG. 1). In the portion carrying the recording medium, the respective imaging units 14 face the transfer belt 121, and there is no reserve space. However, by arranging the P sensor 130 at a position where the P sensor 130 does not face the carried recording medium, an increase in the space or in complexity of the equipment arrangement due to arrangement of the sensor can be prevented.

The P sensor 130 can be used also as a misalignment detecting unit of the transfer belt 121. In other words, by providing a predetermined mark on the transfer belt 121, and detecting this mark by the P sensor 130, a misalignment of the transfer belt 121 in the horizontal scanning direction can be detected.

Figure 12:
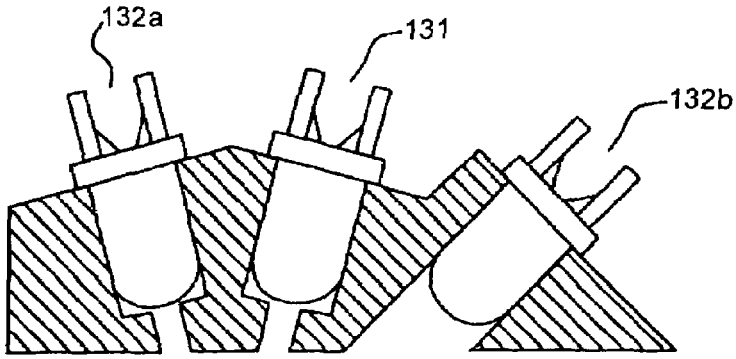
FIG. 12 illustrates an optical sensor that detects regular reflection light and diffuse reflection light.

As the P sensor 130, one having a configuration including a light emitting diode 131 and two photodetectors 132*a* and 132*b* illustrated in FIG. 12 is adopted. In this embodiment, a GaAs Light Emitting Diode (LED) having a peak emission wavelength of 950 nanometers is used for the light emitting diode 131, and an Si phototransistor having a peak spectral sensitivity wavelength of 800 nanometers is used for the photodetectors 132*a* and 132*b*. Regular reflection light projection/reception angles by the light emitting diode 131 and the photodetector 132*a* are set to 15 degrees, and an angle between the diffuse reflection photodetector 132*b* and the detection target surface is set to 45 degrees. In this embodiment, the Si phototransistor is used for the photodetector 132, but other photodetectors such as a photodiode (PD) may be used. However, the two photodetectors must have the same light-output characteristics, in view of performing the output conversion processing in the present invention.

As described above with reference to FIGS. 3 and 4, the reason why the output of the regular reflection photodetector 132*a* changes from a monotonous decrease to a monotonous increase at a certain transfer (0.2 to 0.4 mg/cm$^2$ in FIG. 4) or more is that the diffuse reflection components from the toner are also received by the regular reflection photodetector 132*a*. Here, if it is assumed that the light from the light emitting diode 131 is uniformly diffused on the target surface, light of n times (<1) as much as the light entering into the diffuse reflection photodetector 132*b* should enter into the regular reflection photodetector 132*a*. The n-times value used herein is determined by light receiving diameters of the respective photodetectors, and the optical layout such as arrangement.

If a photodetector having substantially the same output characteristics with respect to the quantity of light (=illuminance) is used for the regular reflection photodetector 132*a* and the diffuse reflection photodetector 132*b*, a relation of α times should be established between the diffuse reflection output components in the regular reflection output and the diffuse reflection output. It is considered that if such a factor: α can be determined, the regular reflection output (output from the photodetector 132*a*) can be divided into "regular reflection output components" and "diffuse reflection output components".

Figure 3:
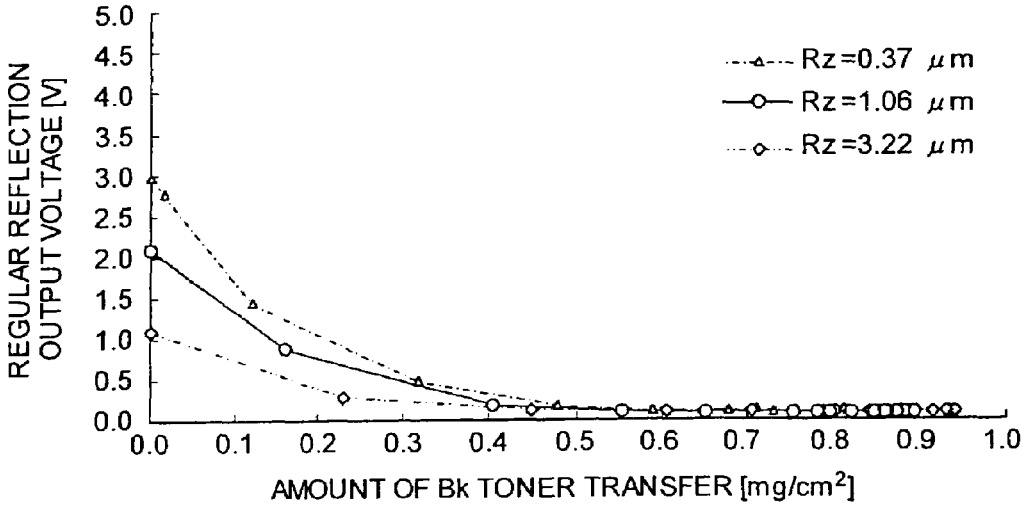
FIG. 3 is a graph illustrating relations between an amount of toner transfer in a black toner and a sensor output (regular reflection light)
Figure 4:
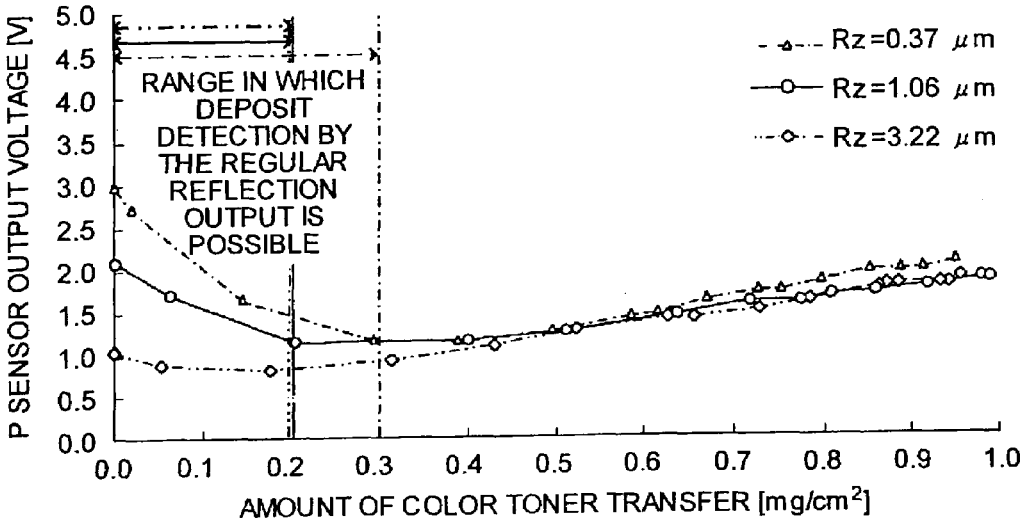
FIG. 4 is a graph illustrating relations between an amount of toner transfer in a color toner and a sensor output (regular reflection light)
Figure 5:
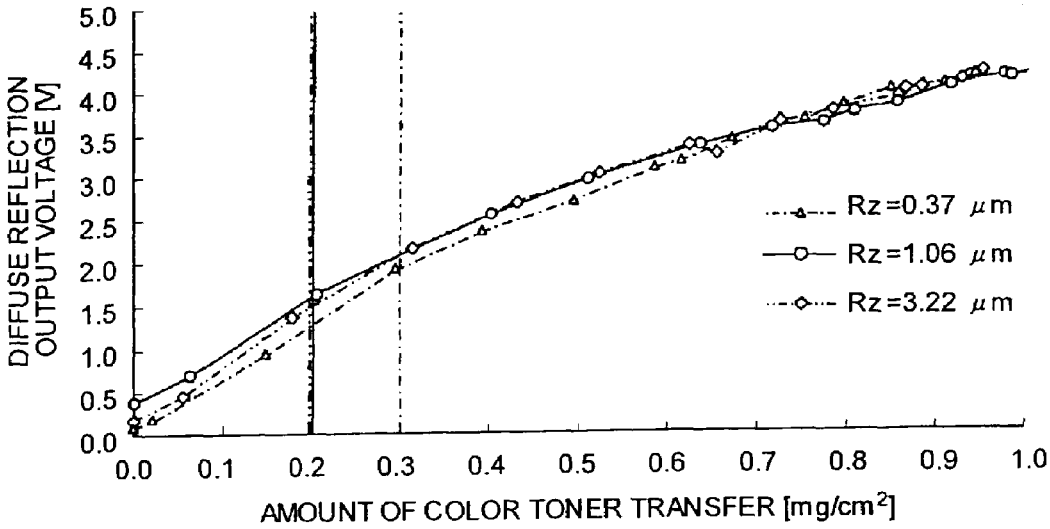
FIG. 5 is a graph illustrating relations between an amount of toner transfer in a color toner and a sensor output (regular reflection light)
Figure 6:
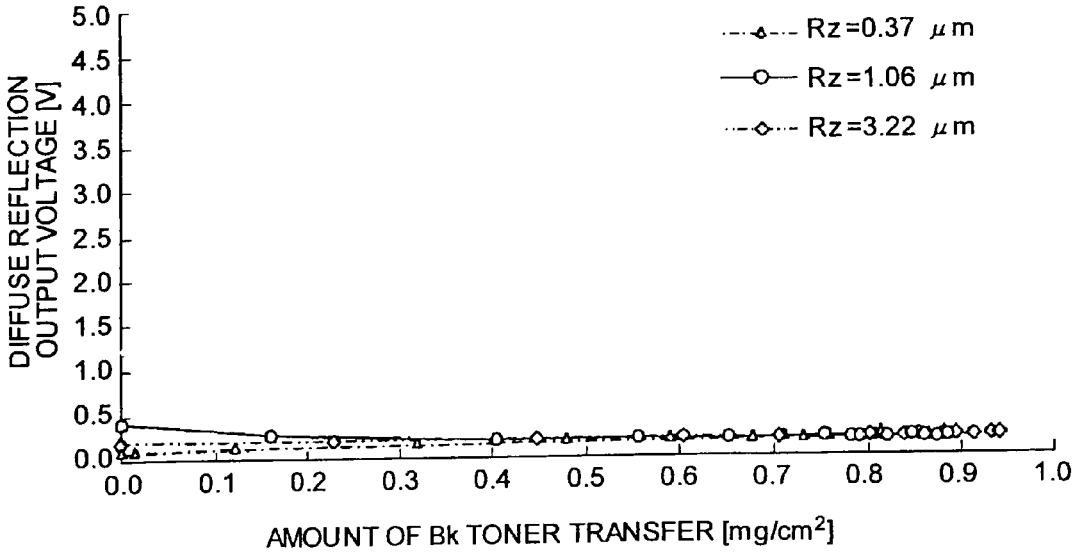
FIG. 6 is a graph illustrating relations between an amount of toner transfer in the black toner and a sensor output (diffuse reflection light)

When considering how to determine the factor: α, in the case of the Bk toner, since the factor α becomes smaller as the diffuse reflection output components approach zero, it can be considered that the regular reflection output characteristic of the Bk toner illustrated in FIG. 3 is substantially equal to the regular reflection output characteristic in which the diffuse reflection output components in the color toner are removed.

As illustrated in FIG. 3, the regular reflection output characteristic of the Bk toner is such that the output value becomes substantially zero or a slightly positive value (never be a negative value), with an increase in the transfer. Therefore, a minimum value of a ratio between the regular reflection output and the diffuse reflection output is determined for each reference pattern of each color toner, and by subtracting a value obtained by multiplying the diffuse reflection output by the minimum value from the regular reflection output, the output characteristic of only the aimed regular reflection output components can be extracted.

The meaning of signs (marks) in the following explanation is as follows.

Vsg Output voltage in the transfer belt background

Vsp Output voltage in each pattern

Voffset Offset voltage (output voltage at the time of the LED 131 being OFF)

_reg. Regular reflection output (abbreviation of Regular Reflection)

_dif. Diffuse reflection output (abbreviation of Diffuse Reflection, see terms relating to color, in JISZ8105)

Figure 7:
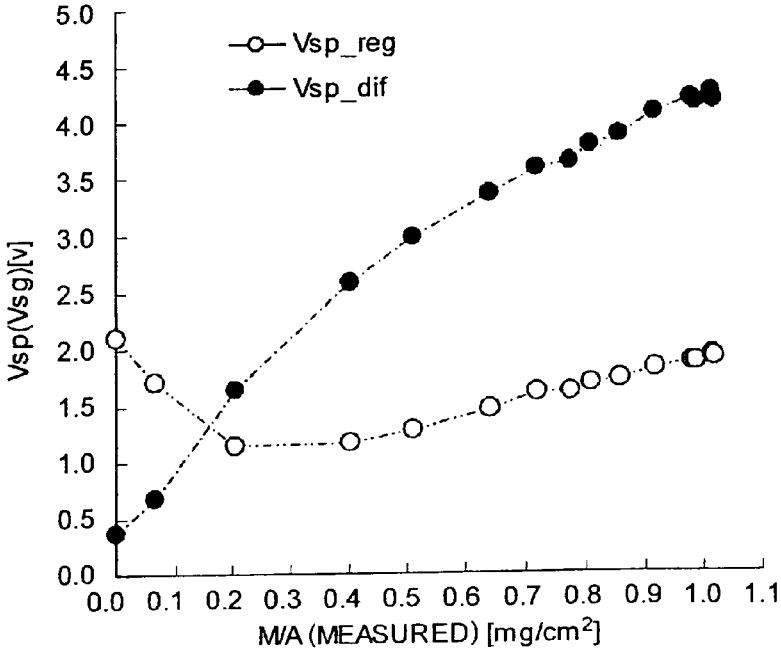
FIG. 7 is a graph illustrating data sampling in reference pattern detection.
Figure 8:
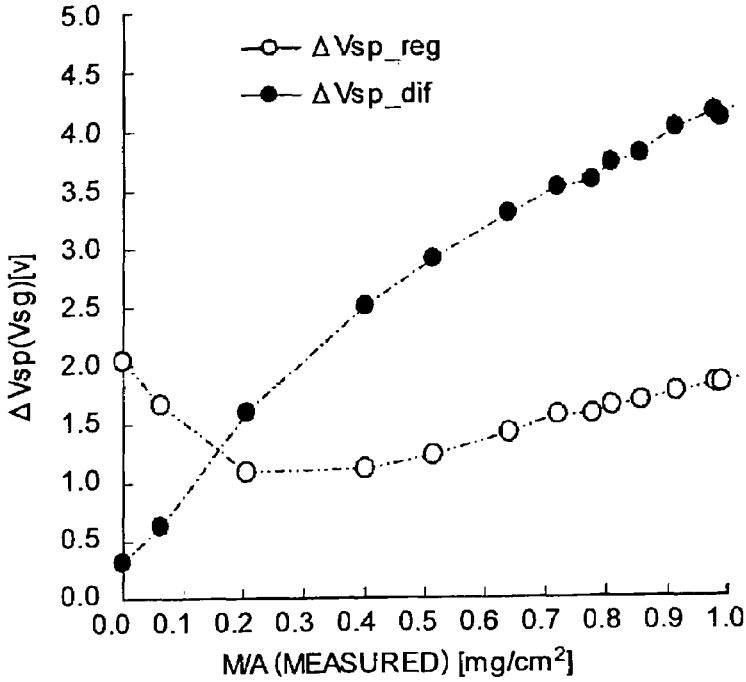
FIG. 8 is a graph illustrating data obtained by performing differential processing with respect to an offset voltage.

[n] Number of elements: array variable of n (Step 1): Calculation of Data Sampling: ΔVsp, ΔVsg (see FIGS. 7 and 8)

A difference between the regular reflection output and the offset voltage (an output at the time of the LED, a light emitting diode, being OFF), and a difference between the diffuse reflection output and the offset voltage are calculated first for all points [n] according to the following processing expression 1. This is for finally expressing the "increment of the sensor output only by the increment due to the transfer change in the color toner".

Since the processing for the transfer belt background is similar to that for the respective pattern portions, except of being only one-point detection, only the processing expression for the pattern portions will be described until STEP 3.

Regular reflection output increment:

$$\Delta V\text{sp_reg.}[n]=V\text{sp_reg.}[n]-V\text{offst_reg. Diffuse reflection output increment: }\Delta V\text{sp_ref.}[n]=V\text{sp_dif.}[n]-V\text{offst_dif.} \quad (1)$$

However, when an OP amplifier in which the respective offset output value at the time of the LED 131 being OFF becomes sufficiently small so that it can be ignored (in the embodiment, Vsp_reg_offset: 0.0621 volt, and Vsp_dif_offset: 0.0635 volt), such difference processing is not necessary, and the regular reflection output or diffuse reflection output may be directly used.

Figure 9:
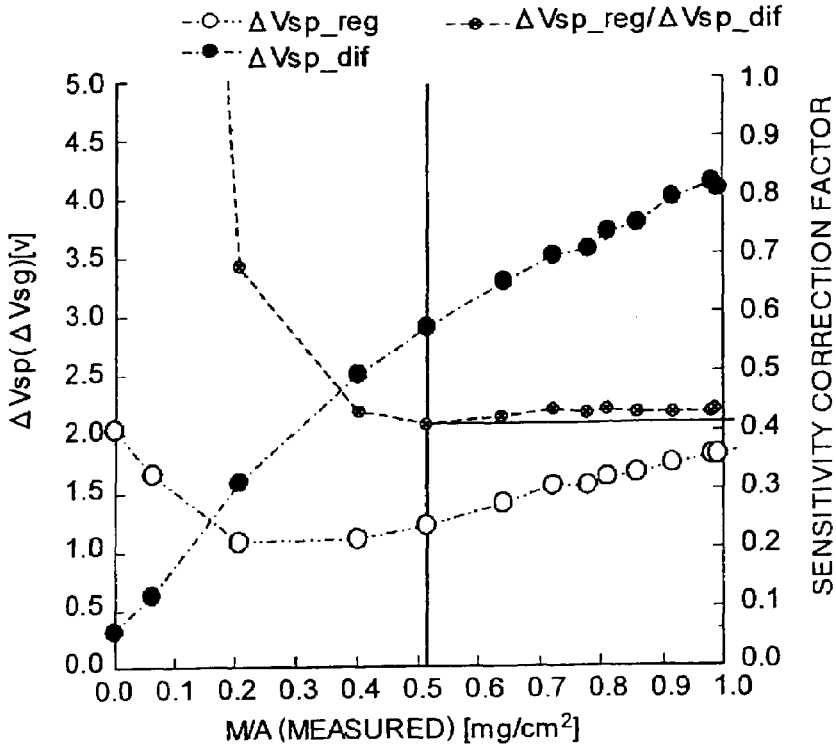
FIG. 9 is a graph illustrating calculation of sensitivity correction factors.

(STEP 2): Calculation of Sensitivity Correction Factor: α (FIG. 9)

When ΔVsp_reg.[n]/ΔVsp_dif.[n] is calculated for each point by the ΔVsp_reg.[n] and ΔVsp_dif.[n] obtained at STEP 1, to divide the components of the regular reflection output at STEP 3, calculation of the factor α to be multiplied to the diffuse reflection output (ΔVsp_dif.[n]) is performed according to the following expression $$\alpha = \min\left(\frac{\Delta\text{Vsp_reg.}[n]}{\Delta\text{Vsp_dif.}[n]}\right) \quad (2)$$

Here, the reason why a is obtained from the minimum value of the ratio is that it is known that the minimum value of the regular reflection output components in the regular reflection output is substantially zero, and becomes a positive value.

Figure 10:
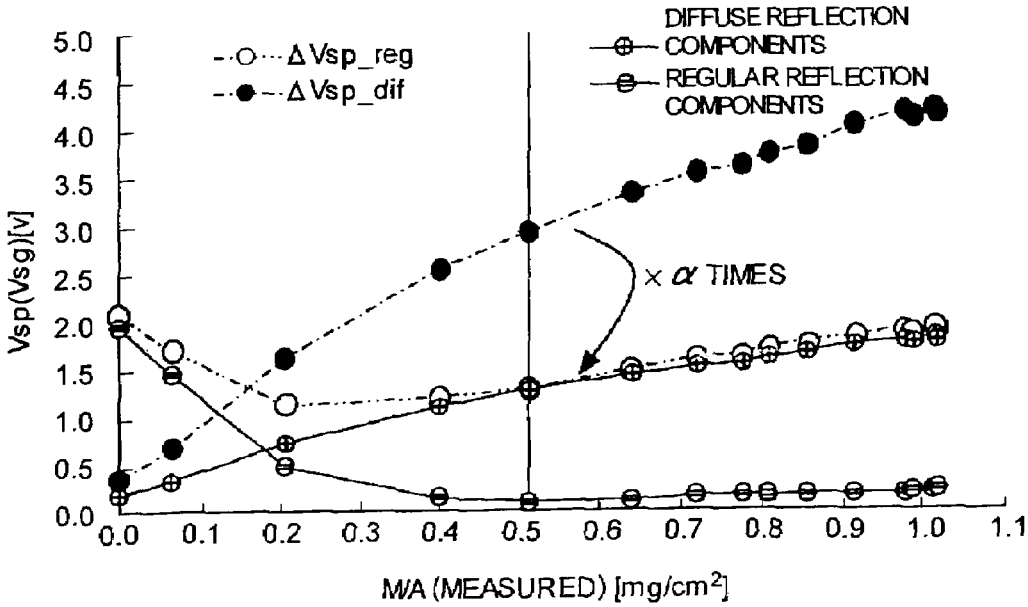
FIG. 10 is a graph illustrating separation of components in the regular reflection light.

(STEP 3): Separation of Components of Regular Reflection Light (FIG. 10)

Separation of components in the regular reflection output is performed according to the following expression.

Diffuse reflection components in regular reflection output:

$$\Delta V\text{sp_reg._dif.}[n]=V\text{sp_dif.}[n]\times\alpha$$

Regular reflection components in regular reflection output:

$$\Delta V\text{sp_reg._reg.}[n]=V\text{sp_reg.}[n]-\Delta V\text{sp_reg._dif.}[n] \quad (3)$$

When the components are separated in this manner, the regular reflection output components in the regular reflection output become zero in the pattern portion where the sensitivity correction factor α is obtained.

(STEP 4): Normalization of Regular Reflection Output Components in the Regular Reflection Output (See FIG. 11)

The relative output ratio (=normalized value) between the regular reflection output components in the regular reflection output in the background and the pattern portions is calculated according to the following processing expression 4. In the transfer belt background, the diffuse reflection output components in the regular reflection output are: ΔVsg_reg._dif.=ΔVsg_dif.×α, and the regular reflection output components in the regular reflection output are: ΔVsg_reg._reg.=ΔVsg_reg.−ΔVsg_reg._dif., according to the same processing as in STEPS 1 to 3 explained with respect to the pattern portions.

$$\text{Normalized value: } \beta[n]=\Delta V\text{sp_reg._reg.}[n]/\Delta V\text{sg_reg._reg.}[n]\text{(=Exposure rate of transfer belt background)} \quad (4)$$

The relative output ratio becomes zero in the pattern portion: n β where the sensitivity correction factor: β is determined. Therefore, conversion to the transfer finishes at the point where this n a is provided.

Figure 11:
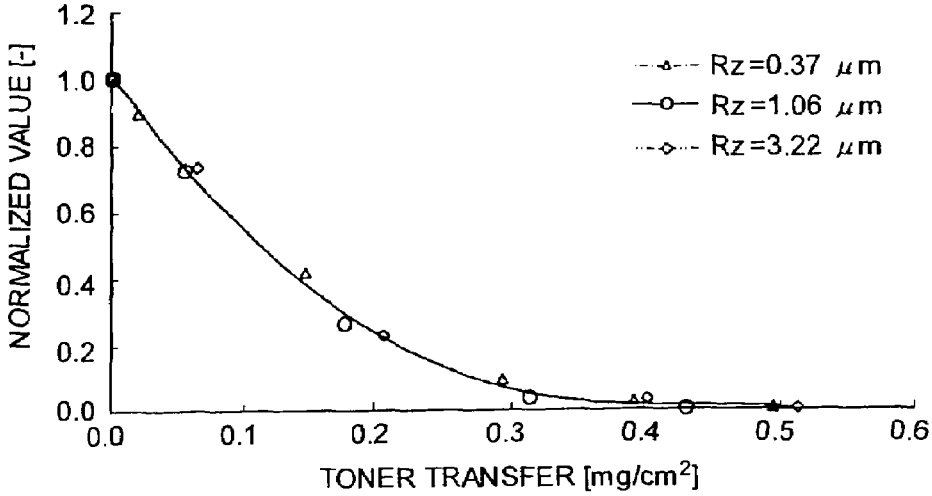
FIG. 11 is a graph illustrating a relative output ratio (a normalized value) between regular reflection output components in the regular reflection outputs in the background and a pattern portion of a transfer belt.

FIG. 11 illustrates the results of conversion to the normalized value of the belts of three levels having different surface roughness: Rz, illustrated in FIGS. 3 to 6. The original measurement data before such conversion processing is performed is expressed by the plot illustrated in FIG. 4 (in FIG. 4, detection is possible only up to 0.2 mg/cm$^2$, at which the output with respect to the amount of toner transfer indicates a monotonous decrease). However, in the embodiment, as illustrated in FIG. 11, conversion to a value, at which the sensitivity is shown up to 0.4 mg/cm$^2$ at maximum, is possible for all of the three types of the belt having different surface roughness, by the conversion processing.

The conversion processing of the amount of color toner transfer to a normalized value has been explained above as an example, but since the similar processing can be performed with respect to the Bk (black) toner, the black toner and the color toners can be converted to a certain characteristic curve by the same processing.

Thus, detection of the amount of toner transfer becomes possible without being affected by the surface condition of the transfer belt. Even when the surface of the transfer belt deteriorates, accurate detection of the amount of toner transfer can be performed. As a result, appropriate process control operation can be executed by accurately detecting the density of the reference patterns, and the image quality can be improved by optimizing the color image density.

If a relational expression of the transfer to the normalized value (or a reference table indicating the relations between the transfer and the normalized value) as illustrated in FIG. 11 is determined beforehand, by inverting this in the actual control, the amount of toner transfer can be calculated from the normalized value (the relative output ratio between the background and the pattern portions).

The color laser printer according to the first embodiment has been explained with reference to the drawings, but the present invention is not limited thereto. For example, in the above explanation, at the time of normalizing the amount of toner transfer, the number of elements [n] for sampling the data can be appropriately set. Further, the respective voltage values are examples only, and these can be appropriately set.

Further, the present invention is applicable to a method in which the toner image is transferred from a plurality of image carriers onto the recording medium via the intermediate transfer belt, or a method in which the toner image is transferred from one image carrier onto the recording medium via the intermediate transfer belt, and the amount of toner transfer on the reference patterns formed on the intermediate transfer belt needs only to be calculated in the manner explained above, to control the image density. The number of the imaging units in the tandem type is not limited to four (four colors) in the illustrated example, and three or other number is also possible. The configuration of the development unit and the exposure apparatus (write unit) is optional.

As explained above, according to the image forming apparatus according to the first embodiment, since image density is controlled based on a value obtained by subtracting a value obtained by multiplying the "diffuse reflection output" by a "minimum value of a ratio between the regular reflection output and the diffuse reflection output" from the "regular reflection output" of the reference pattern of each color detected by the optical detecting unit that can detect both the regular reflection light and diffuse reflection light from the detection target simultaneously, the density of the respective color reference patterns can be accurately detected, without being affected by the surface condition of the transfer belt of the intermediate transfer body. As a result, the image quality can be improved, by optimizing the respective color image density.

Further, the image density is controlled based on the relative ratio between the value obtained by subtracting a value obtained by multiplying the "diffuse reflection output" by a "minimum value of a ratio between the regular reflection output and the diffuse reflection output" from the "regular reflection output" of the reference pattern of each color detected by the optical detecting unit, and a value obtained by subtracting a value obtained by multiplying the "diffuse reflection output" by a "minimum value of a ratio between the regular reflection output and the diffuse reflection output" from the "regular reflection output" in the background of the transfer belt or the intermediate transfer body, detected by the optical detecting unit. As a result, accurate detection of the reference pattern density can be performed, regardless of the surface condition of the transfer belt or the intermediate transfer body.

By using a difference between the regular reflection output at the time of the light emission side being ON of the optical detecting unit and the regular reflection output at the time of the light emission side being OFF, as the regular reflection output, accurate detection can be performed even when there is an offset output at the time of the light emission side being OFF.

By using a difference between the diffuse reflection output at the time of the light emission side being ON of the optical detecting unit and the diffuse reflection output at the time of the light emission side being OFF, as the diffuse reflection output, accurate detection can be performed even when there is an offset output at the time of the light emission side being OFF.

Further, the processing accompanying the calculation of the amount of toner transfer can be simplified, by calculating the amount of toner transfer on the respective color reference patterns by using a relational expression between the amount of toner transfer on the respective color reference patterns and the relative ratio or a reference table obtained beforehand, to control the image density.

Further, the optical detecting unit has a first photodetector that receives the regular reflection light from the detection target, and a second photodetector that receives the diffuse reflection light, and the light-output characteristics of the two photodetectors are the same. Therefore, from the relations between the diffuse reflection output components in the regular reflection output and the diffuse reflection output, the components in the regular reflection output can be separated, thereby enabling accurate detection of the reference pattern density.

More accurate reference pattern density can be detected, by forming three or more reference patterns for each color to perform detection.

By arranging the optical detecting unit at a position where the optical detecting unit does not face the carried recording medium, an increase in the space or in complexity of the equipment arrangement can be prevented.

A misalignment of the transfer belt or the intermediate transfer body can be detected by using the optical detecting unit that detects the density of the reference pattern, and toner transfer on the reference pattern can be calculated accurately, regardless of the surface condition of the transfer belt or the intermediate transfer body.

By using a difference between the regular reflection output at the time of the light emission side being ON of the optical detecting unit and the regular reflection output at the time of the light emission side being OFF, as the regular reflection output, accurate detection can be performed even when there is an offset output at the time of the light emission side being OFF.

Even when there is an offset output at the time of the light emitting diode being OFF, accurate detection is possible, by using a difference between the diffuse reflection output at the time of the light emission side being ON of the optical detecting unit and the diffuse reflection output at the time of the light emission side being OFF, as the diffuse reflection output.

Further, the processing accompanying the calculation of the amount of toner transfer can be simplified, by calculating the amount of toner transfer on the respective color reference patterns by using a relational expression between the amount of toner transfer on the respective color reference patterns and the relative ratio or a reference table obtained beforehand.

A second embodiment of the present invention will be explained based on FIGS. 13 to 44. At first, before explaining the configuration and the function in this embodiment, the detailed situation for realizing the present invention will be explained.

When considering which type of sensors should be used for detecting the density pattern on the transfer belt as the detection target surface, (1) there is a defect in the type of detecting only the regular reflection light in that detection up to the high transfer area is not possible; (2) in the type of only the diffuse reflection light, if the transfer belt is black (the transfer belt is often black since carbon is used for the transfer belt as a resistance modifier), there is a fatal defect in that the black toner cannot be detected, and there is another defect in that the sensor sensitivity cannot be calibrated since the diffuse reflection output in the transfer belt background is substantially zero.

It is considered that in order to deal with such problems, a method in which a difference in outputs between two light-receiving sensors is calculated by using the type of detecting both regular reflection light and the diffuse reflection light explained above as (3) and (4), (See, for example, Japanese Patent Publication No. 3155555 and Japanese Patent Application Laid-Open No. H2001-194843) and a method in which the transfer is detected by calculating a ratio between two light-receiving sensors (See, for example, Japanese Patent Application Laid-Open No. H10-221902) have been proposed.

However, in the conventional detection method using the types (3) and (4) of detecting both regular reflection light and the diffuse reflection light, it is difficult to perform transfer detection stably and accurately at all times, due to the following reasons.

1. A lot difference in the light emitting diode output and the photodetector output is not considered (difference in sensors).

2. Temperature characteristics and deterioration in the light emitting diode output and the photodetector output are not considered (changes in sensors).

3. Influence due to the deterioration of the transfer belt, being the detection target surface, is not considered (changes in belt).

In order to study how much element difference is there between the sensors, difference range is evaluated by measurement of output by the following method, with respect to several lots (one lot=197 pieces) of LEDs and phototransistors (PTr).

Figure 14:
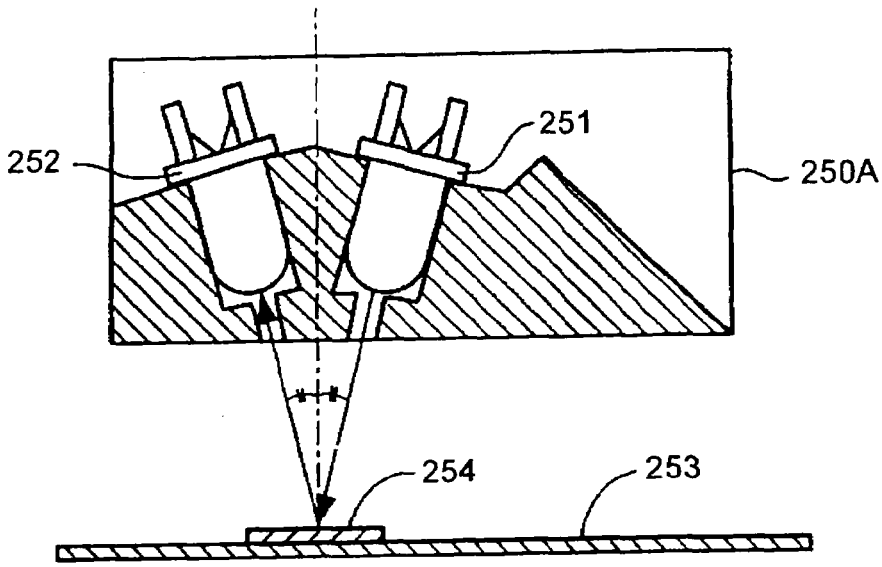
FIG. 14 is a block diagram of an optical detecting unit that detects only the regular reflection light.
Figure 15:
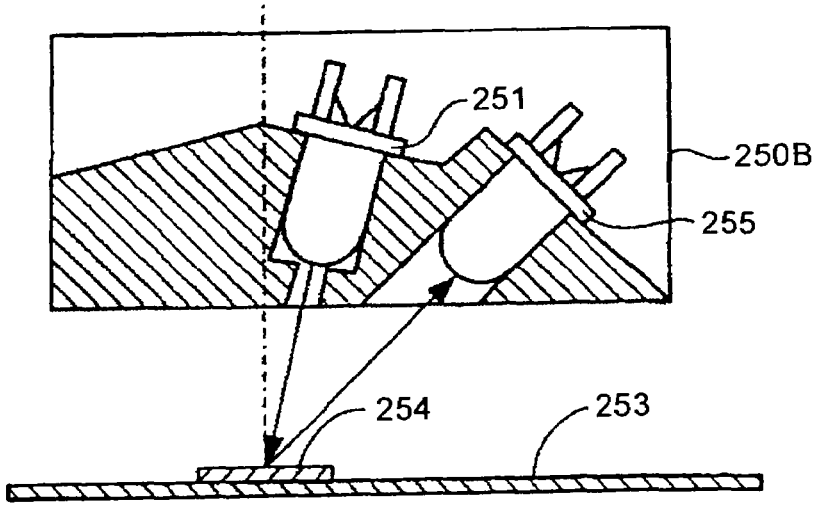
FIG. 15 is a block diagram of an optical detecting unit that detects only the diffuse reflection light.

The light emitting diodes are sequentially changed, under the conditions that Vcc=5 volts, LED current: If=14.2 milliamperes, and the photodetector is fixed, by using the sensor head as illustrated in FIG. 14, to measure the photocurrent: IL of the photodetector at the time of irradiating light to a certain reference board, thereby judging the size of the light emitting output.

The photodetectors are sequentially changed, under the conditions that Vcc=5 volts, LED current: If=14.2 milliamperes, and the light emitting diode is fixed, by using the sensor head as illustrated in FIG. 14, to measure the photocurrent: IL of the photodetector at the time of irradiating light to a certain reference board, thereby judging the size of the photo detecting sensitivity. The measurement results are illustrated in Table 1.

TABLE 1

Element difference measurement results

| | Difference lower limit | Difference upper limit | Ratio between upper and lower limits |
|---|---|---|---|
| Light emitting diode | 110 μA | 200 μA | 1.8 times |
| Photodetector | 71 μA | 268 μA | 3.8 times |

From Table 1, it is seen that there is an output difference of a little less than twice on the light emitting diode side, and a little less than four times on the photodetector side.

It is considered that the size of the element difference is different by the types of elements (top view type, side view type) and manufacturers, but there should be a difference at a level where at least adjustment is required, when any element is used.

This point is not mentioned in the respective conventional techniques. This may be because it is recognized as "needless to say", but in order to detect accurate transfer by the methods described in the conventional technique, strict output adjustment is necessary at a stage of final inspection of the sensors (elements).

The expected results when any adjustment is not performed will be explained below, based on the experimental data.

Figure 16:
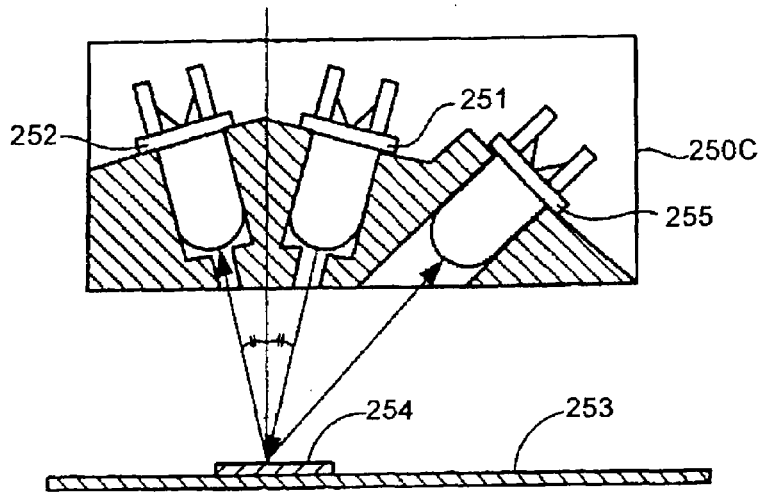
FIG. 16 is a diagram of an optical detecting unit that simultaneously detects the regular reflection light and the diffuse reflection light.
Figure 17:
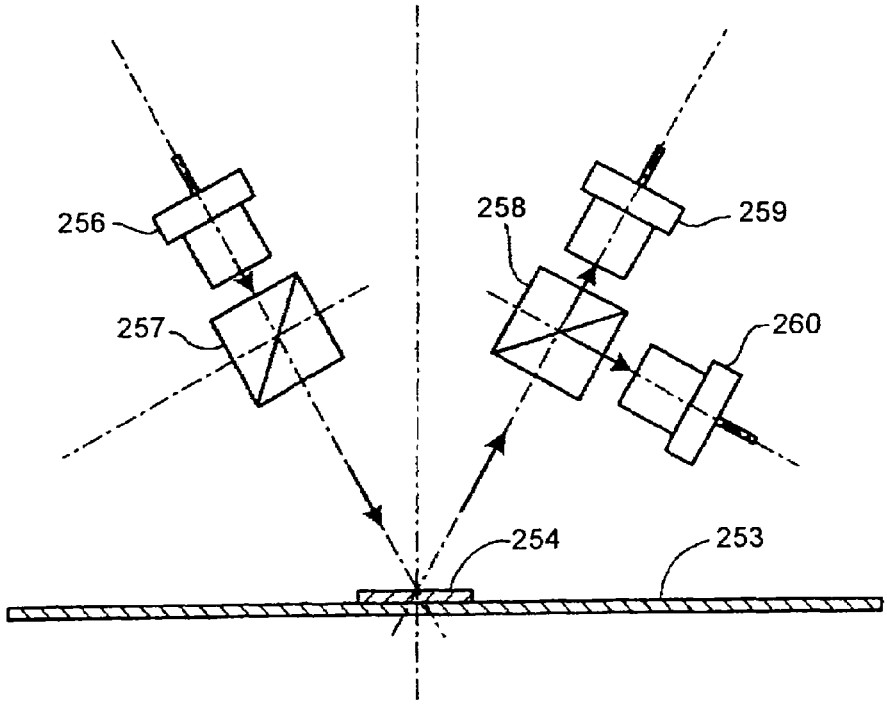
FIG. 17 is a block diagram of an optical detecting unit using a beam splitter, which simultaneously detects the regular reflection light and the diffuse reflection light.
Figure 18:
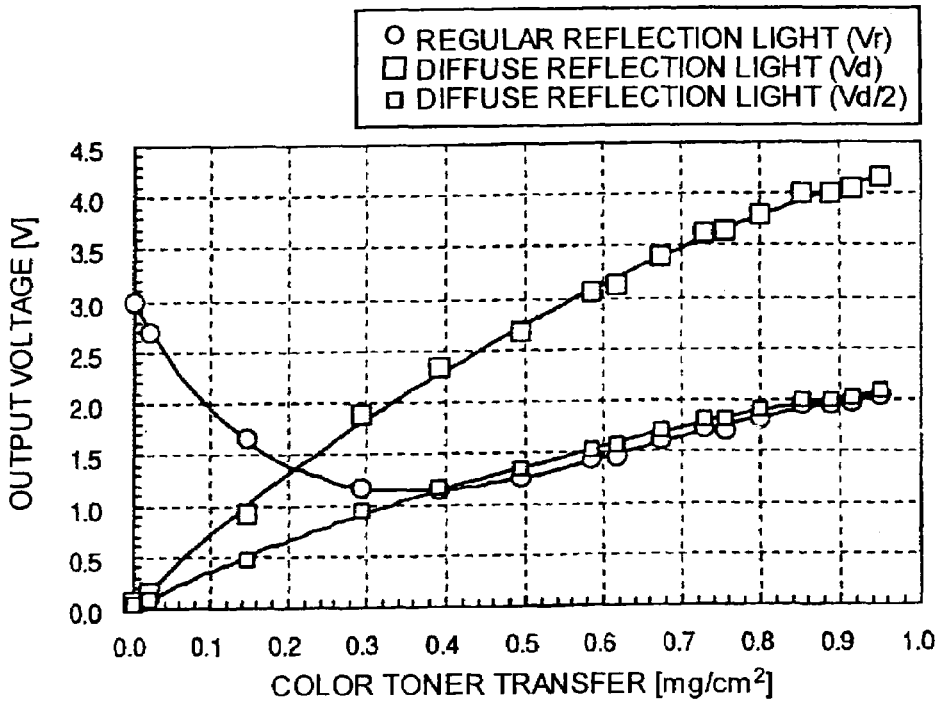
FIG. 18 is a graph illustrating the detection result of the regular reflection output and the diffuse reflection output with respect to an amount of color toner transfer.

FIG. 18 illustrates the results of measurement of the color toner transfer on the transfer belt measured by the sensor illustrated in FIG. 16, wherein the transfer is plotted on the X axis, and output voltage of the regular reflection light and diffuse reflection light are plotted on the Y axis.

Here, even when there is an element difference in the regular reflection photodetector and the diffuse reflection photodetector, respectively, since there is such a characteristic that the output becomes the largest in the belt background at least in the regular reflection output, if the LED current is adjusted so that the output in the belt background becomes a certain value (in this case, 3.0 volts), the output difference due to the element difference in the light emitting diodes and the regular reflection output photodetectors can be absorbed. As a result, substantially unequivocal output characteristic can be obtained as the sensor output with respect to the transfer.

Figure 19:
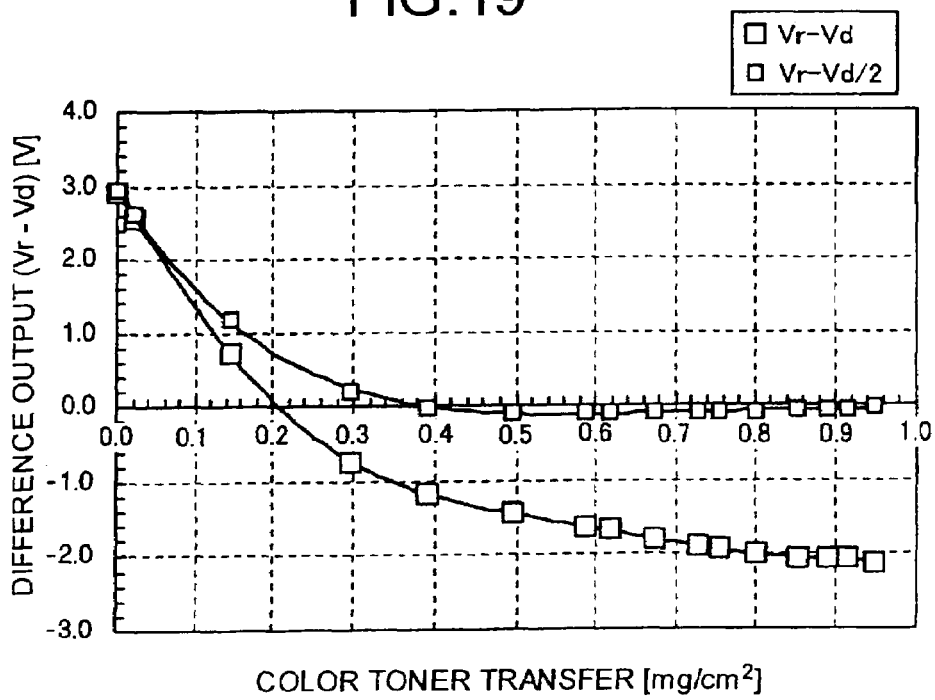
FIG. 19 is a graph illustrating a difference between the amount of color toner transfer and the regular reflection light.

Large square marks in FIG. 18 indicate points plotting the diffuse reflection output after the LED adjustment. If it is assumed that there are differences twice the size in photodetectors, and if the photodetector for diffuse reflection output is changed to the one having photodetecting sensitivity of ½, the diffuse reflection output at that time becomes the output (Vd/2) expressed by small square marks. Therefore, if a difference between the regular reflection light (Vr) and the output (Vd/2) is calculated, as illustrated in FIG. 19, the output relation with respect to the transfer cannot be determined unequivocally. This also applies to the instance when the ratio between these is used.

As illustrated in FIG. 19, when values of two conditions agree with each other at a point where the transfer is zero, but do not agree with each other in high transfer areas, the output relation with respect to the transfer cannot be determined unequivocally, even if known calculation such as the normalization processing of the regular reflection output is performed.

Hence, when amount-of-transfer conversion is performed based on the difference or ratio data between the "regular reflection output" and the "diffuse reflection output", the relation between the "regular reflection output" and the "diffuse reflection output" should satisfy a certain relation at all times. For this purpose, difference correction is necessary, for example, at the time of final inspection of the sensors, such as strictly adjusting the relations between the regular reflection output and the diffuse reflection output with respect to a certain reference board.

Even if adjustment as described above is performed in the method described in the conventional technique, accurate transfer detection is not possible by only calculating the difference or the ratio, due to the variable factors (changes in sensors, changes in the belt) mentioned in (2) and (3).

Since the transfer belt comes in contact with the transfer paper as the recording medium at all times, at the time of image output, the belt surface becomes rough due to wear with the lapse of time. Further, when transfer paper containing much whitening agent is continuously fed, the belt surface whitens with the lapse of time.

Before showing the experiment results, state-changing factors for the regular reflection output and the diffuse reflection output will be explained.

Figure 20:
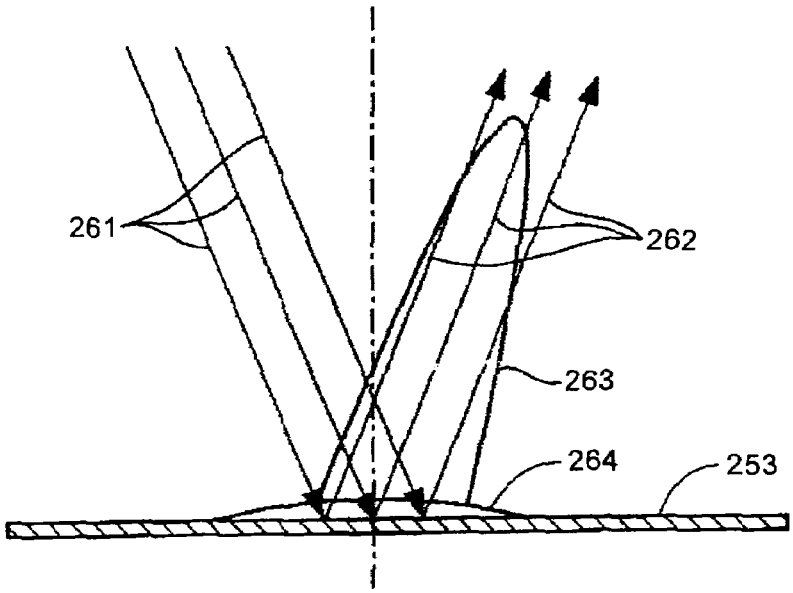
FIG. 20 illustrates reflection state of irradiation light when specular gloss level of a detection target surface is high.

The regular reflection output stands for light mirror-reflected on the detection target surface (the incident angle and the angle of reflection are the same), and when the detection target surface is very smooth (=specular gloss level is high), as illustrated in FIG. 20, the irradiated light 261 is slightly diffused on the detection target surface 253, and almost all are mirror-reflected as the regular reflection light 262. Reference number 263 denotes the sensitivity for the regular reflection light, and 264 denotes the sensitivity for the diffuse reflection light, respectively, in a distributed area.

Figure 21:
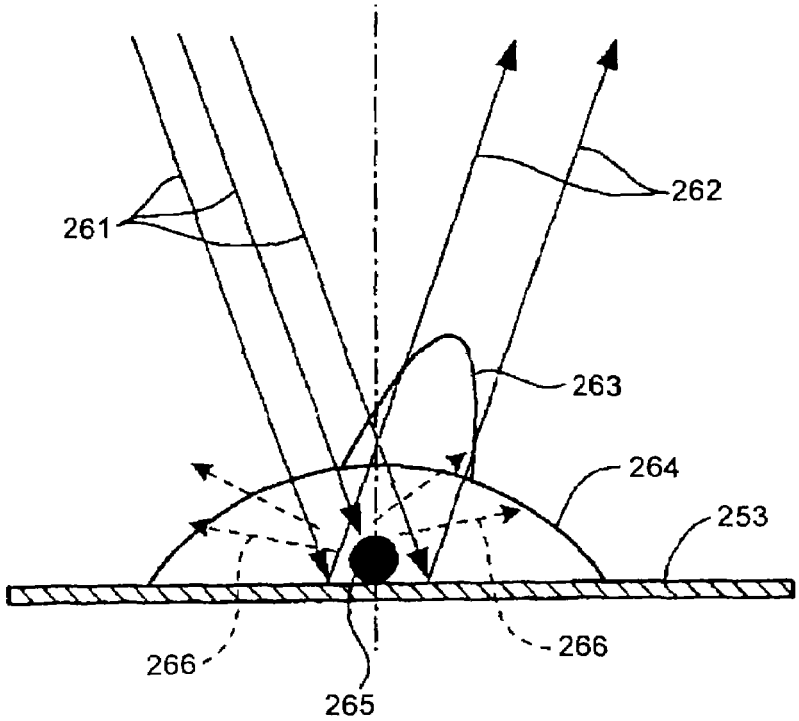
FIG. 21 illustrates reflection state of irradiation light when the specular gloss level of the detection target surface is decreased due to adhesion of the toner.

As illustrated in FIG. 21, when toner 265 as toner adheres on the detection target surface 253, since the incident light is diffused by the toner 265, the regular reflection light decreases, and the diffuse reflection light 266 increases. However, the diffuse reflection light 266 increases only when the toner 265 is a color toner, and when the toner 265 is the black toner, the irradiated light 261 is substantially absorbed, and hence the diffuse reflection light 266 hardly increases.

In other words, in the regular reflection light, the output changes due to the "change of state of the surface characteristics (gloss level, surface roughness, and the like)" of the object to the detected, and in the diffuse reflection light, the output changes due to the "change of state of color characteristics (lightness and the like)" of the object to the detected. Thus, the output changes due to factors independently different.

The experiment results will now be explained. In the color image forming apparatus of the train-of-four tandem direct transfer type illustrated in FIG. 13, it is assumed an instance in which the surface of the transfer belt becomes rough and whitens with the lapse of time, and 16 gradation patterns are formed on the three types of transfer belts having different "specular gloss level (Gs)" and "lightness (L*)", to predict the results when these patterns change with the lapse of time, by comparison of the sensor detection outputs of these patterns. Various conditions for the experiment are shown below.

<Transfer Belt (Detection Target Surface)>
Black belt . . . Specular gloss level: Gs(60)=57,
Lightness: L*=10
Brown belt . . . Specular gloss level: Gs(60)=27,
Lightness: L*=25
Grey belt . . . Specular gloss level: Gs(60)=5,
Lightness: L*=18

<Detection Sensor (Optical Detecting Unit)>

Detailed Specification of the Sensor Illustrated in FIG. 16

Light Emission Side
Element: GaAs infrared emission diode (peak emission wavelength: λp=950 nanometers), top view type
Spot diameter: 1.0 millimeter Photodetector Side
Element: Si phototransistor (peak spectral sensitivity: λp=800 nanometers), top view type
Spot diameter:
Regular reflection receiving side: 1.0 millimeter
Diffuse reflection receiving side: 3.0 millimeters
Detection distance: 5 millimeters (distance from the upper part of the sensor to the detection target surface)
LED current: fixed to 25 milliamperes <Linear Velocity>
125 millimeters per second <Sampling Frequency>
500 Sampling per second (=for each 2 milliseconds)
Note 1: The measurement value of the specular gloss level is a value obtained by using a gloss meter PG-1 manufactured by Nippon Denshoku, and performing measurement at a measurement angle of 60 degrees.

Note 2: Lightness is measured by using a spectrophotometric colorimeter: X-Rite 938 manufactured by X-Rite and performing measurement at an angle of visibility of 2 degrees, using D50 as a light source.

Figure 22:
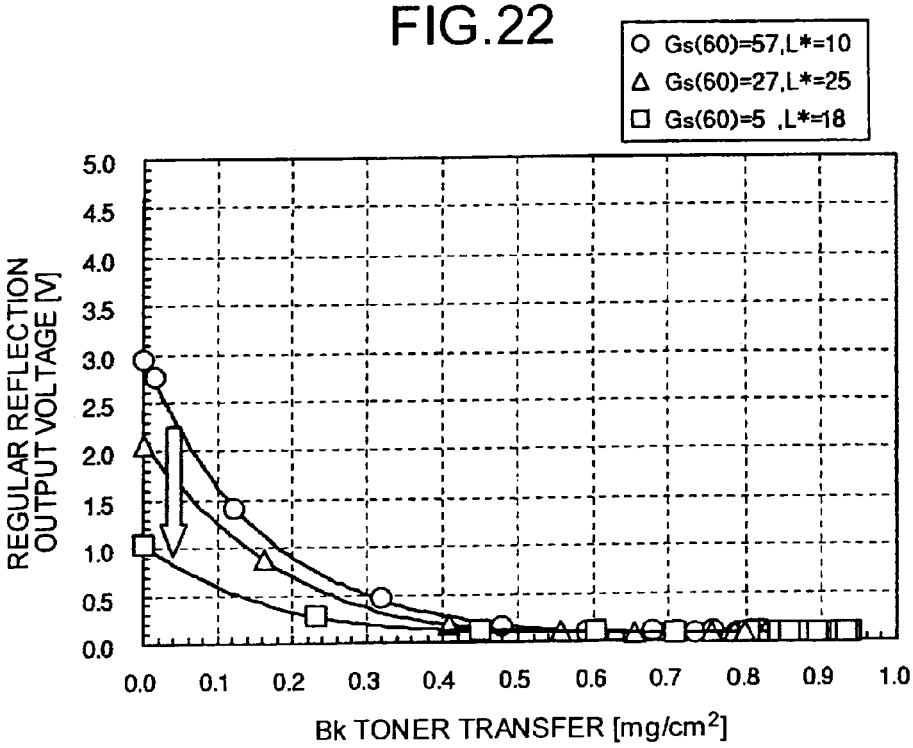
FIG. 22 is a graph illustrating regular reflection output characteristics with respect to an amount of black toner transfer.
Figure 23:
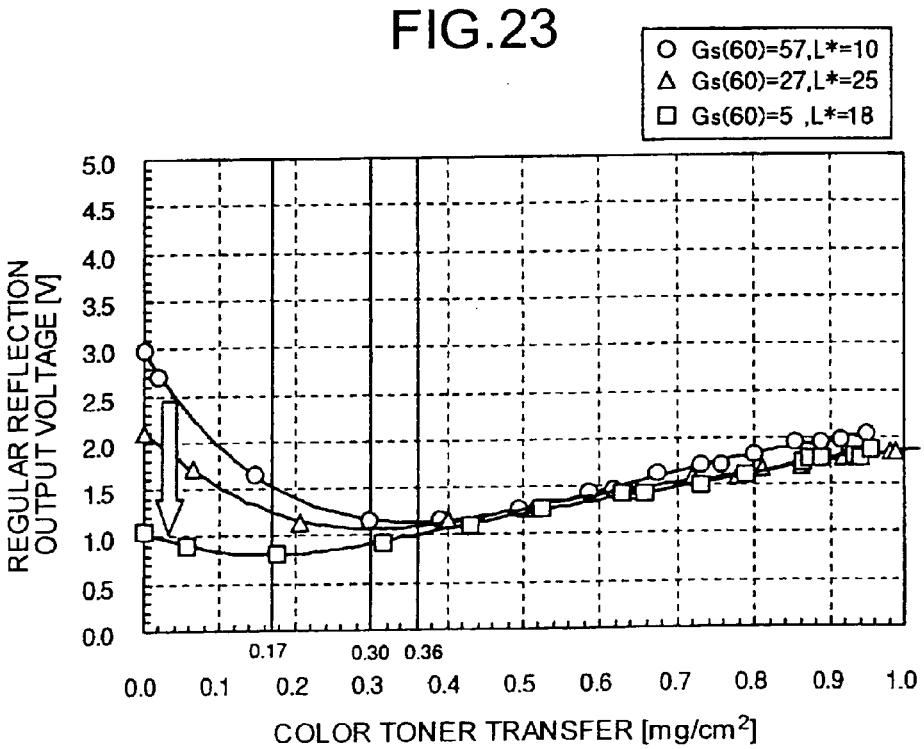
FIG. 23 is a graph illustrating regular reflection output characteristics with respect to an amount of color toner transfer.

The regular reflection output characteristic with respect to the black toner transfer is illustrated in FIG. 22, and the regular reflection output characteristic with respect to the color toner transfer is illustrated in FIG. 23.

This experiment has been conducted under a condition that the input condition on the sensor side is fixed (LED current: If is fixed to 25 milliamperes). Therefore, in a high transfer area (M/A is not smaller than 0.4 mg/cm$^2$) where there is no influence of the belt background, the regular reflection output (voltage) of the three types of belts substantially agree with each other, but in a low transfer area (M/A=0.4 mg/cm$^2$ or less) where there is the influence of the belt background, the regular reflection output (voltage) of the three types of belts do not agree with each other.

As is seen from the result, when the specular gloss level of the transfer belt drops with the lapse of time, that is, when the surface roughness deteriorates, the regular reflection output (voltage) drops as indicated by the arrow, in the low transfer area where the belt background having zero transfer is exposed.

From the results obtained from the experiments, the major problem when the transfer detection is performed by using the sensor of type (1) having only the regular reflection output is that in the color transfer detection, the transfer detectable range decreases with the lapse of time, with a decrease in the gloss level of the transfer belt.

It is because transfer cannot be detected when the sensor output characteristic with respect to the transfer is larger than a point of inflection (minimum value) illustrated in FIG. 23, since the transfer detection of the color transfer is performed according to the transfer detection algorithm described below in the conventional technique.

When the minimum output values of the respective belts are determined by calculation of the point of inflection in an approximating curve, it is seen in FIG. 23, that the detectable maximum transfer becomes narrow such as 0.36 (57), 0.30 (27), and 0.17 (5), with deterioration of the belt. The figure in the brackets indicates a gloss level. The transfer detectable range is between the output value and the transfer having the minimum value.

As for the detection of the black toner transfer, only the output SN ratio decreases, and the detectable maximum transfer hardly changes and can be detected, though the detection accuracy slightly drops.

Figure 24:
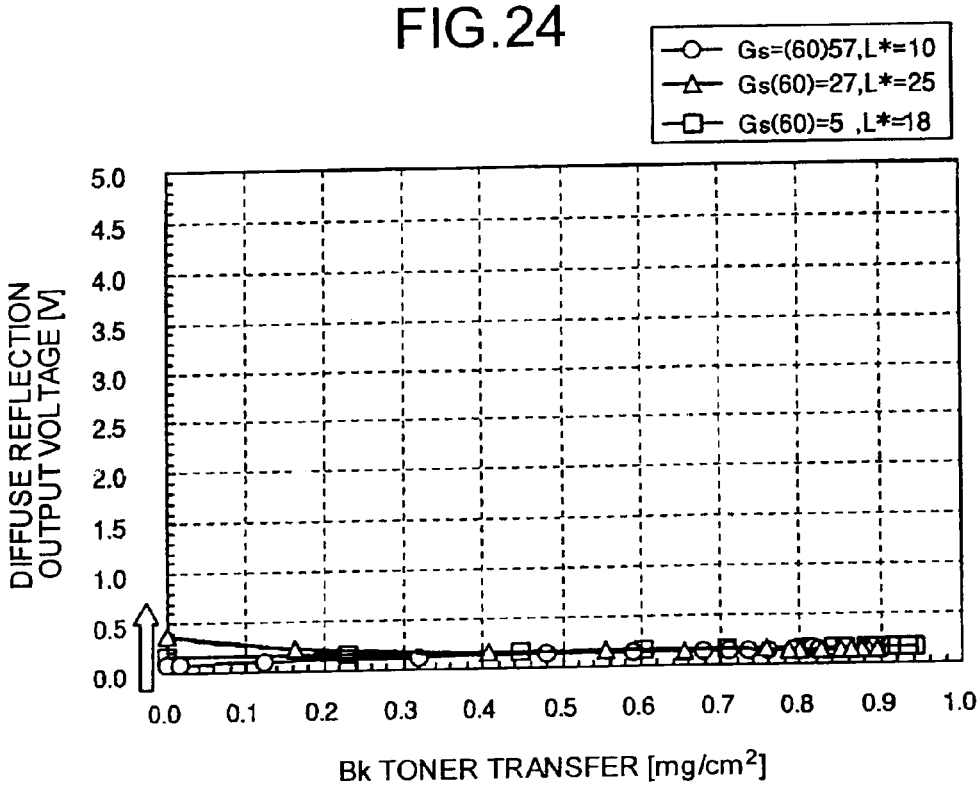
FIG. 24 is a graph illustrating diffuse reflection output characteristics with respect to the amount of black toner transfer.
Figure 25:
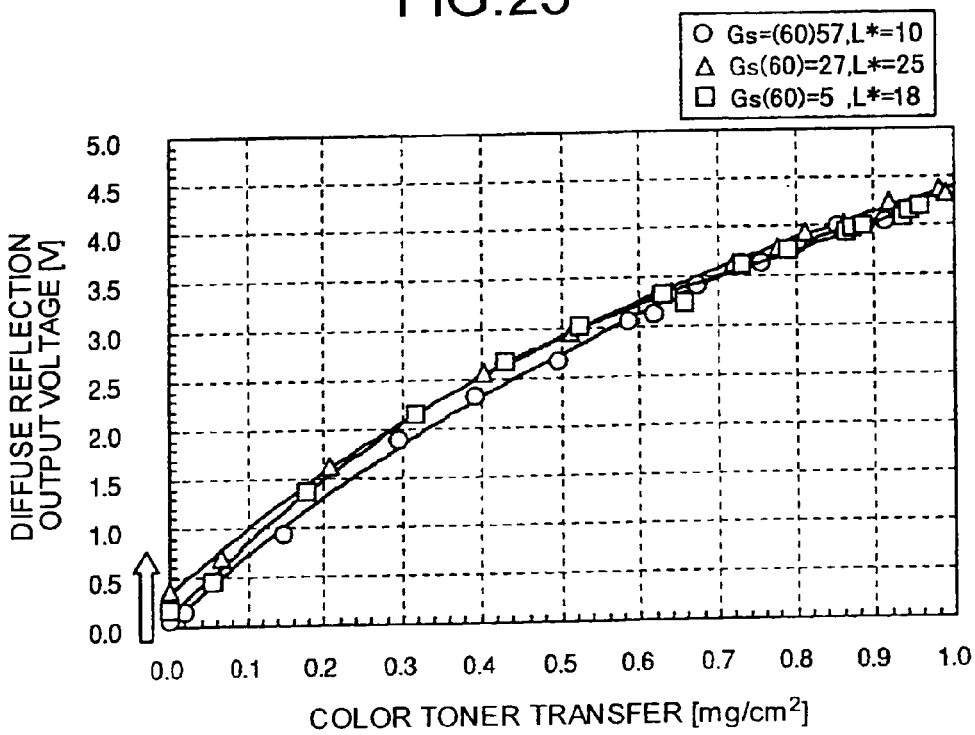
FIG. 25 is a graph illustrating diffuse reflection output characteristics with respect to the amount of color toner transfer.

The diffuse reflection output characteristics with respect to the black toner transfer (X axis) are illustrated in FIG. 24, and the diffuse reflection output characteristics with respect to the color toner transfer (X axis) are illustrated in FIG. 25.

In the high transfer area where there is no influence of the belt background, the diffuse reflection output of the three types of belts substantially agree with each other, but in the low transfer area where there is the influence of a change in lightness of the belt background, the diffuse reflection output of the three types of belts do not agree with each other due to a change in lightness.

In other words, it is seen that when the transfer belt whitens with the lapse of time, the diffuse reflection output in the transfer belt background increases.

From the facts obtained from the experiments, the major problem when the transfer detection is performed by using the sensor of type (2) having only the diffuse reflection output is that firstly, this type of sensor does not have a unit that corrects an age-based change in characteristics on the detection target surface, and secondly, when the detection target surface is black such that the lightness: L* is less than 20, calibration of the sensor sensitivity cannot be performed on the detection target surface.

The reason why sensitivity calibration cannot be performed at lightness: L*<20 is that the diffuse reflection output from the background becomes substantially zero.

For reference, the sensitivity calibration method of the sensor performed by the present applicant with respect to the conventional machine will be explained. That is, after fitting the sensor to the image forming apparatus in the factory, the LED current on the light emission side of the sensor has been heretofore adjusted so that the sensor output with respect to a certain white reference board becomes a certain value. With this method, however, though adjustment is possible initially, since the sensor does not have a unit that corrects a change in sensitivity due to deterioration in LED, a positive guarantee with respect to the age-based quality cannot be provided.

Figure 26:
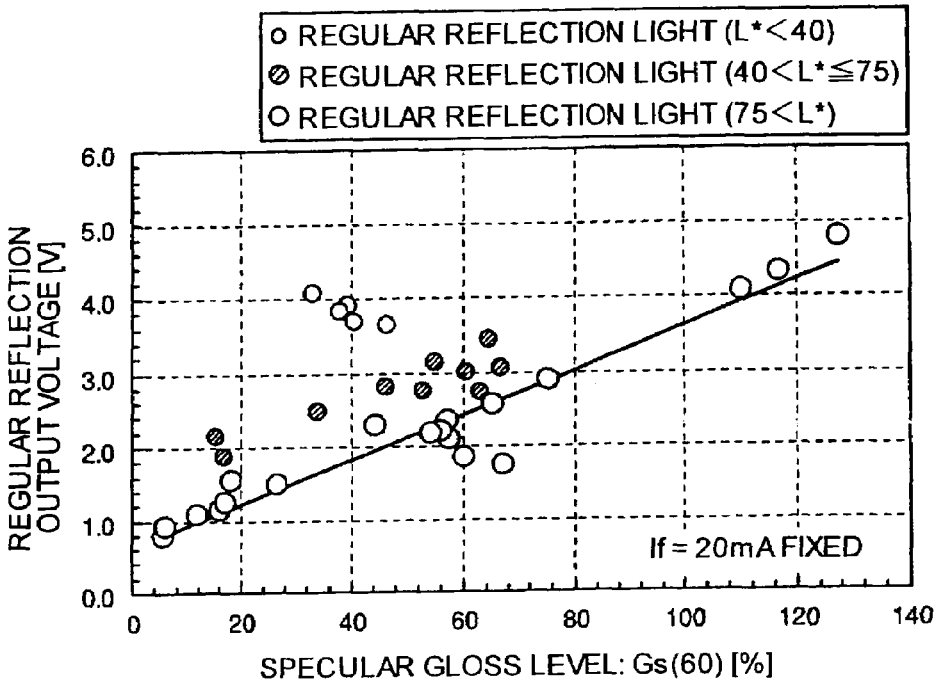
FIG. 26 is a graph illustrating regular reflection output characteristics with respect to the specular gloss level of the detection target surface.
Figure 27:
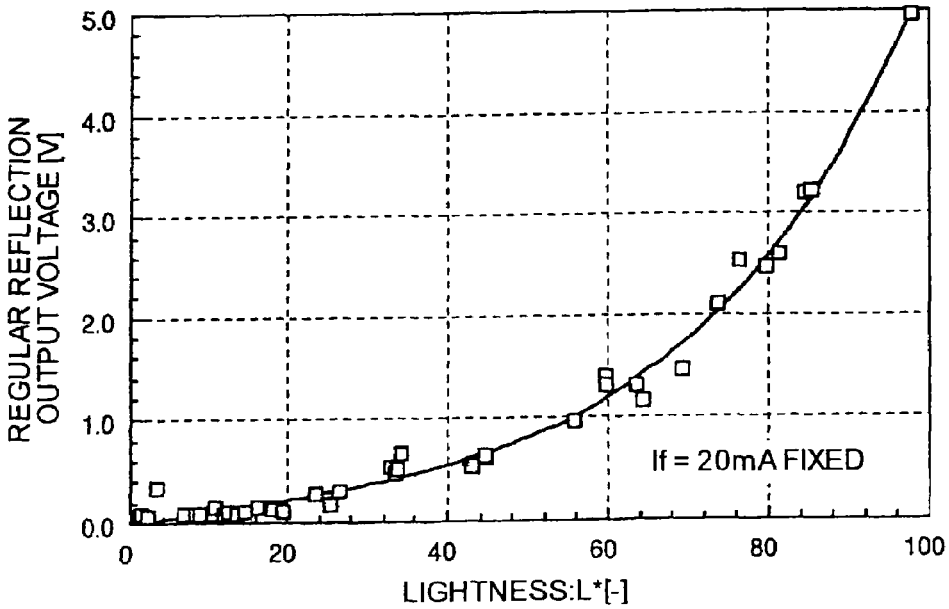
FIG. 27 is a graph illustrating the diffuse reflection output characteristics with respect to lightness of the detection target surface.

FIG. 26 indicates the results of study relating to the correlation between specular gloss level and the regular reflection output. FIG. 27 indicates the results of study relating to the correlation between the lightness and the diffuse reflection output.

In FIG. 26, the regular reflection outputs of 42 types of transfer belts having different "gloss level" and "lightness" are plotted with respect to the X axis: 60 degrees gloss level, at the time of the LED current being fixed to 20 milliamperes, by using a reflection type photo sensor illustrated in FIG. 16.

The measurements of gloss level on the X axis are values measured at a measurement angle of 60 degrees, by using the gloss meter PG-1 manufactured by Nippon Denshoku.

From FIG. 21, it is seen that since the regular reflection output contains diffuse reflection components, if the result is sorted for each range of lightness, such a relation can be obtained that the regular reflection output voltage is proportionate to the gloss level substantially linearly.

This is because the regular reflection light itself is measured with respect to the specular gloss level (see JISZ8741: Specular gloss level—measurement method).

FIG. 27 is a graph in which the diffuse reflection output measured, simultaneously with the regular reflection light, is plotted with respect to the lightness of the belt on the X axis. In FIG. 27, [-] indicates there is no unit.

The lightness on the X axis is measured by using a spectrophotometric calorimeter: X-Rite 938 manufactured by X-Rite and performing measurement at an angle of visibility of 2 degrees, using D50 as a light source.

Since there is a difference in the light source and the measurement angle, the relation between these is not a linear relationship, but is plotted on substantially the same curve, without being affected by the gloss level. Therefore, it is seen that the diffuse reflection output is independent of the regular reflection output.

When the surface of the transfer belt becomes rough with the lapse of time, and the regular reflection output in the belt background deteriorates, or the surface of the transfer belt whitens to increase the diffuse reflection output in the background, or these two symptoms progress at the same time, in either case, the relations between the "regular reflection output" and the "diffuse reflection output" collapse, and hence the output cannot be kept in the same state as the initial state only by simply calculating the difference or ratio between the two outputs.

Therefore, even if amount-of-transfer conversion is performed based on the calculation thereof, the same result as that of the initial state cannot be obtained. Further, if the amount-of-transfer conversion is not performed, and the result is directly fed back to the density control, a result deviated from that of the initial state can only be obtained.

Figure 28:
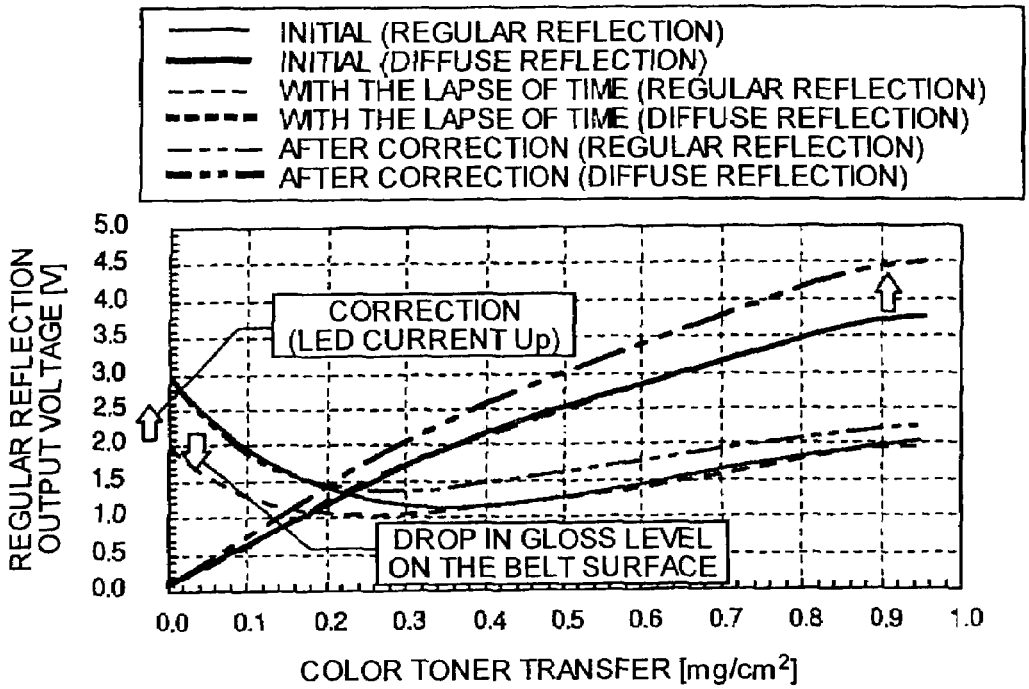
FIG. 28 is a graph illustrating relations between a decrease in the age-based gloss level of the detection target surface, and correction of the regular reflection output.

Therefore, when the regular reflection output decreases due to deterioration in the gloss level of the belt, correction by increasing the LED current can be considered. For example, if adjustment is performed so that the regular reflection output in the belt background becomes the initial value, at least in the belt background, the regular reflection output is the same as the initial value. However, as illustrated in FIG. 28, in the case of a color toner, the output increases over the whole transfer area.

Figure 29:
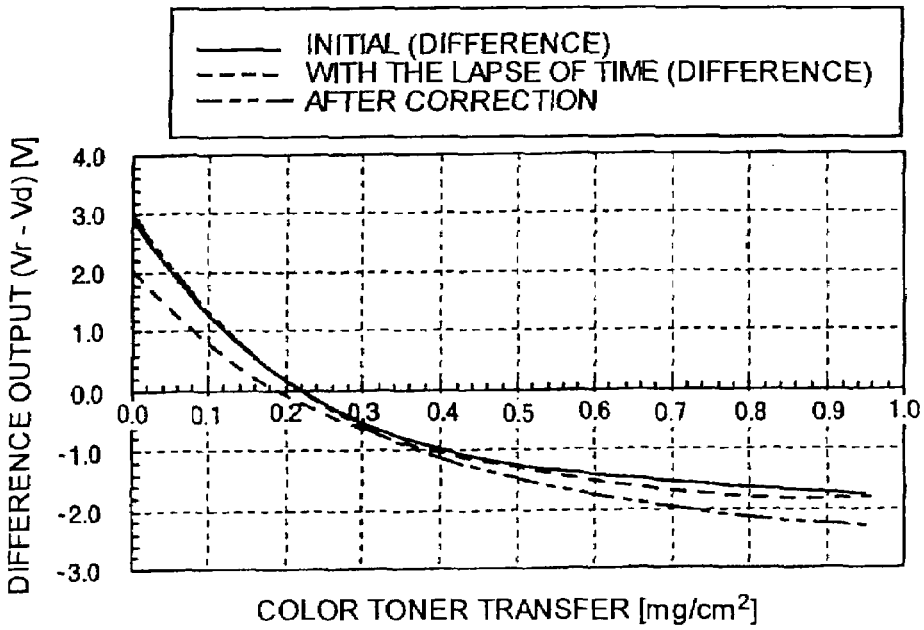
FIG. 29 is a graph illustrating a difference between the amount of color toner transfer and the regular reflection light in a decrease in the age-based gloss level of the detection target surface.

Not only this, but also the diffuse reflection output voltage increases with an increase in the light receiving quantity. The difference output obtained as a result of this is such that, as illustrated in FIG. 29, it can be matched with the initial value in the low transfer area, but since a deviation occurs in the high transfer area, the same result as that of the initial state cannot be obtained. This applies to a case of taking the ratio, instead of the difference output.

Even if there is no age-based change, when a change occurs in the output characteristics of the light emitting diode and the photodetector, being a semiconductor, due to an increase in the ambient temperature, the output result also becomes different from that of the initial state.

As explained above, with the methods in the conventional technique, proposed as a solution for the transfer detection in the high transfer area, particularly, the amount-of-toner-transfer detection up to the high transfer area on the black belt frequently used in the color image forming apparatus, (a) it seems that it is a major premise that the two outputs of the density detection sensor are strictly adjusted beforehand, that is, strict adjustment is required at the time of final inspection, in order to handle the gradation pattern detection technique. Further, if it is considered that (b) any measure is not taken against an age-based change and an environmental change in the density detection sensor, and (c) any measure is not taken against an age-based change in the detection target surface (transfer belt), technical problems are piled up in the detection of the gradation patterns.

In other words, there is a technical problem to be solved, that is, how to perform detection of the amount of toner transfer in the high transfer area stably at all times, regardless of (a) an output difference due to a lot difference of sensors, (b) an age-based change and an environmental change in the density detection sensor, and (c) an age-based change in the detection target surface (transfer belt).

The present invention has been achieved in order to solve the above problems in the conventional technique, and is for (1) making the strict adjustment of the relations between the "regular reflection output" and the "diffuse reflection output" unnecessary on the sensor side (hardware side), that is, contributing to a reduction of production cost by increasing flexibility at the shipping, and (2) making automatic correction possible by the features of the software side, regardless of the existence of the above three factors, to realize highly accurate detection of the gradation patterns.

The object of the present invention can be achieved by the amount-of-transfer conversion algorithm and an image forming apparatus using the same according to the present invention.

Specifically, the object of the present invention is achieved by an algorithm in which the gradation patterns are read by a reflection type optical sensor having two outputs of the "regular reflection output" and the "diffuse reflection output", which is the type of (3) and (4), the two outputs are converted to a value having a linear relation with respect to the transfer in a transfer area in which transfer detection by the regular reflection light is possible, and sensitivity correction of a converted value of the diffuse reflection output is performed based on the converted value of the regular reflection output, by which an unequivocal relation with respect to the transfer can be obtained, thereby converting the diffuse reflection output to a value unequivocally determined with respect to the transfer.

The color laser printer according to the second embodiment of the present invention will be explained based on the specific configuration.

Figure 13:
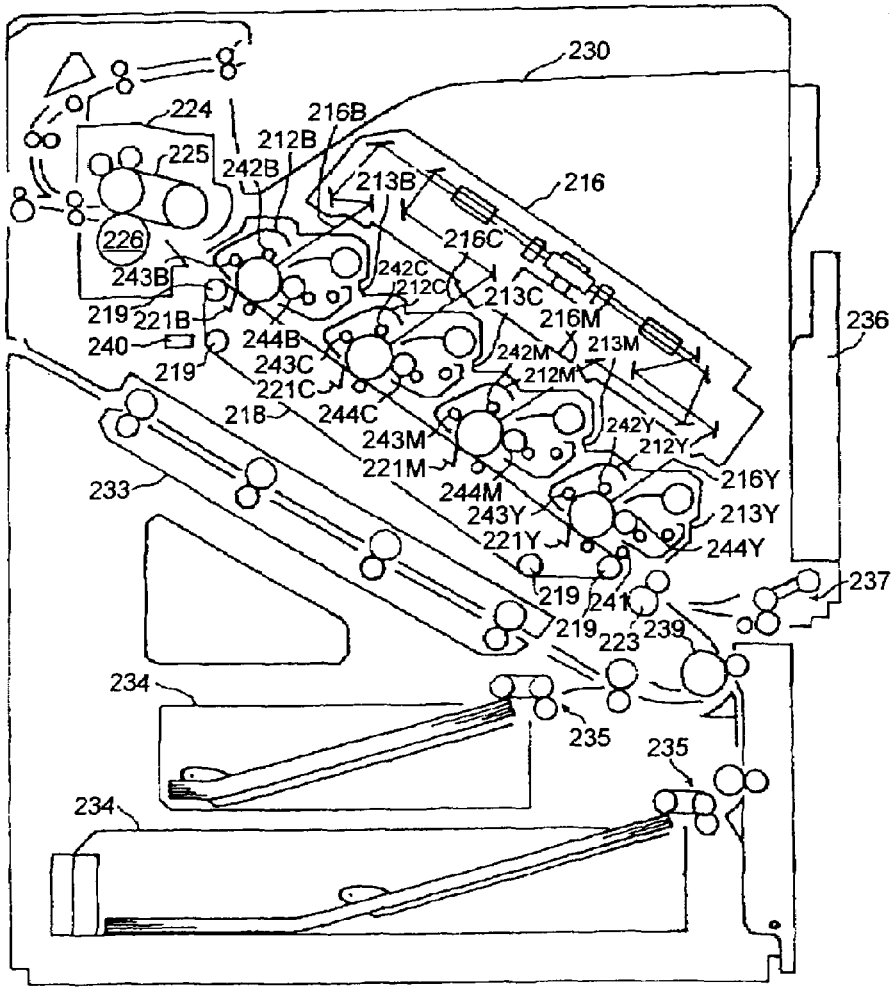
FIG. 13 is a schematic front elevation of the color laser printer as the image forming apparatus according to a first embodiment of the present invention.

As illustrated in FIG. 13, the schematic configuration of a color laser printer of the train-of-four tandem direct transfer type, as the image forming apparatus and a toner transfer detection apparatus in this embodiment, will be explained.

The color laser printer has three paper feed trays, that is, one manual feed tray 236 and two paper feed cassettes 234 (first and second paper feed trays), and transfer paper (not shown) as recording medium fed from the manual feed tray 236 is sequentially separated one by one from the uppermost sheet by a feed roller 237, and transported toward a resist roller pair 223. The transfer paper fed from the first paper feed tray 234 or the second paper feed tray 234 is sequentially separated one by one from the uppermost sheet by a feed roller 235, and carried toward the resist roller pair 223 via a carrier roller pair 239.

The fed transfer paper is temporarily stopped by the resist roller pair 223, and carried toward a transfer belt 218, with a skew thereof corrected, at a timing that the edge of an image formed on a photosensitive drum 214Y located on the uppermost stream side agrees with a predetermined position of the transfer paper in the transport direction, by the rotation of the resist roller pair 223 according to ON control of a resist clutch (not shown).

The transfer paper is electrostatically attracted to the transfer belt 218 due to a bias applied to a paper attraction roller 241, at the time of passing through a paper attraction nip, formed of the transfer belt 218 and the paper attraction roller 241 abutting against the transfer belt 218, and carried at a process linear velocity of 125 millimeters per second.

Since a transfer bias (positive) of a reverse polarity to the charging polarity (negative) of the toner is applied to transfer brushes 221B, 221C, 221M, and 221Y, arranged at positions facing the photosensitive drums 214B, 214C, 214M, and 214Y of the respective colors, putting the transfer belt 218 therebetween, the respective color toner images formed on the respective photosensitive drums 214B, 214C, 214M, and 214Y are transferred onto the transfer paper attracted on the transfer belt 218, in the order of yellow (Y), magenta (M), cyan (C), and black (Bk).

The transfer paper having passed through the transfer step for each color is curvature-separated from the transfer belt 218 at a drive roller 218 on the downstream side, and carried to a fixing apparatus 224. The transfer paper passes through a fixing nip formed of the fixing belt 225 and a pressure roller 226, and hence the toner images are fixed on the transfer paper by heat and pressure. The transfer paper after fixation is ejected onto a face down (hereinafter, "FD") tray 230 formed on the upper face of the apparatus, in the case of a one side printing mode.

When the dual side printing mode is selected beforehand, the transfer paper exiting from the fixing apparatus 224 is carried to a reversing unit (not shown), and carried to a dual side carrier unit 233 located below the transfer unit, with the both sides reversed by the reversing unit. The transfer paper is re-fed from the dual side carrier unit 233, and carried to the resist roller pair 223 via the carrier roller pair 239. Hereafter, the transfer paper goes through the same operation as that of the one side printing mode, and passes through the fixing apparatus 224, and ejected onto the FD tray 230.

The configuration and the imaging operation in the image forming section of the color laser printer will be explained in detail.

The image forming sections for respective colors have the same configuration and the same operation. Therefore, the configuration and operation for forming a yellow image will be explained as an example, and explanation of those for other colors is omitted, with signs corresponding to the respective colors added.

A charging roller 242Y, an imaging unit 212Y having a cleaning unit 243Y, a development unit 213Y, and an optical detecting unit 216 and the like are provided around the photosensitive drum 214Y located on the uppermost stream side in the transport direction of the transfer paper.

At the time of forming an image, the photosensitive drum 214Y is rotated in the clockwise direction by a main motor (not shown), discharged by the AC bias (containing zero DC components) applied to the charging roller 242Y, so that the surface potential thereof becomes a reference potential of about −50 volts.

The photosensitive drum 214Y is then uniformly charged to a potential substantially equal to the DC components by applying the DC bias in which AC bias is superposed thereon, so that the surface potential thereof is charged substantially to −500 to −700 volts (the target charging potential is determined by a process control section).

Digital image information sent from a controller (not shown) as a print image is converted to a binarized LD flash signal for each color, and exposed beams 216Y are irradiated onto the photosensitive drum 214Y by the optical detecting unit 216 having a cylinder lens, a polygon motor, an fθ lens, first to third mirrors, and a WTL lens.

The drum surface potential in the irradiated portion becomes substantially −50 volts, and an electrostatic latent image corresponding to the image information is formed thereon.

The electrostatic latent image corresponding to the yellow image information on the photosensitive drum 214Y is visualized by the development unit 213Y. DC (−300 to −500 volts) in which AC bias is superposed thereon is applied to a developing sleeve 244Y in the development unit 213Y, and hence the toner (Q/M: −20 to −30 μC/g) is developed only on the image portion where the potential decreases due to write, thereby forming a toner image.

The toner image formed on the photosensitive drums 214B, 214C, 214M, and 214Y for each color is transferred onto the transfer paper attracted on the transfer belt 218 by the transfer bias.

In the color laser printer in the embodiment, process control operation is executed in order to optimize the image density of the respective colors, at the time of toner on or after a predetermined number of sheets is fed, separately from the image forming mode.

In this process control operation, a plurality of density detection patches for each color (hereinafter, "P patterns") are formed on the transfer belt by sequentially changing over the charging bias and the development bias at an appropriate timing, and the output voltage of these P patterns is detected by a density detection sensor (hereinafter, P sensor) 240 arranged outside the transfer belt 218, close to the drive roller 219. The output voltage is subjected to the amount-of-transfer conversion according to the amount-of-transfer conversion algorithm (toner amount-of-transfer conversion method) of the present invention, to calculate (development γ, Vk) expressing the current developing ability. Based on this calculation value, control for changing the development bias and the toner density control target value is performed.

The configuration of the P sensor is as illustrated in FIG. 16, and the parameters are as described above.

Here, the phototransistor (PTr) is used for the photodetector, but other photodetectors such as a photodiode (PD) may be used.

The amount-of-transfer conversion algorithm in the present invention (in this embodiment) will be explained based on the experiment results illustrated in FIGS. 22 to 25. In this algorithm, the diffuse output is converted to a transfer value according to the following procedure:

(1) sampling the regular reflection output and the diffuse reflection output from the gradation patterns (see FIGS. 23 and 25);

(2) dividing the components in the regular reflection output into "regular reflection components" and "diffuse reflection components", to extract only the "regular reflection components";

(3) removing the "diffuse reflection components from the belt background" from the diffuse reflection output, to extract the "diffuse reflection components from the toner";

(4) using a primary linear relation between two output conversion values with respect to the transfer, independent (orthogonal) to each other obtained from (2) and (3), and sensitivity-correcting the diffuse reflection output conversion value, so that the diffuse reflection output conversion value with respect to a certain regular reflection output conversion value (or the transfer) becomes a certain value in a transfer range in which transfer detection by the regular reflection light is possible (in a low transfer area), to unequivocally determine the diffuse reflection output (correction value) with respect to the transfer; and (5) performing the amount-of-transfer conversion processing from the relation between the predetermined "transfer" and the "diffuse reflection output correction value".

Figure 30:
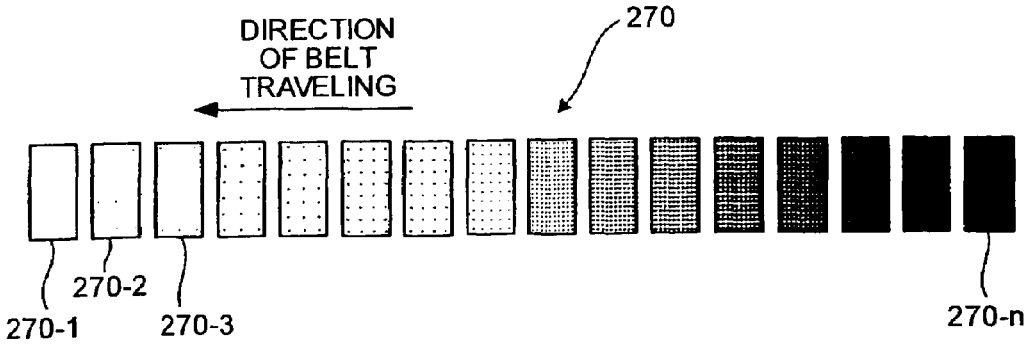
FIG. 30 is a plan view illustrating gradation patterns.

The "regular reflection output voltage" and the "diffuse reflection output voltage" obtained by detecting the P patterns 270 for density detection formed on the transfer belt 218 illustrated in FIG. 30 by the P sensor 240 illustrated in FIG. 16 are plotted with respect the amount color toner transfer [mg/cm$^2$] precisely measured by an electronic scale in FIGS. 23 and 25. In the gradation patterns 270, the amount of toner transfer increases toward the upstream side in the belt traveling direction.

For the transfer belt 218, three types having different specular gloss level and lightness are used.

Figure 31:
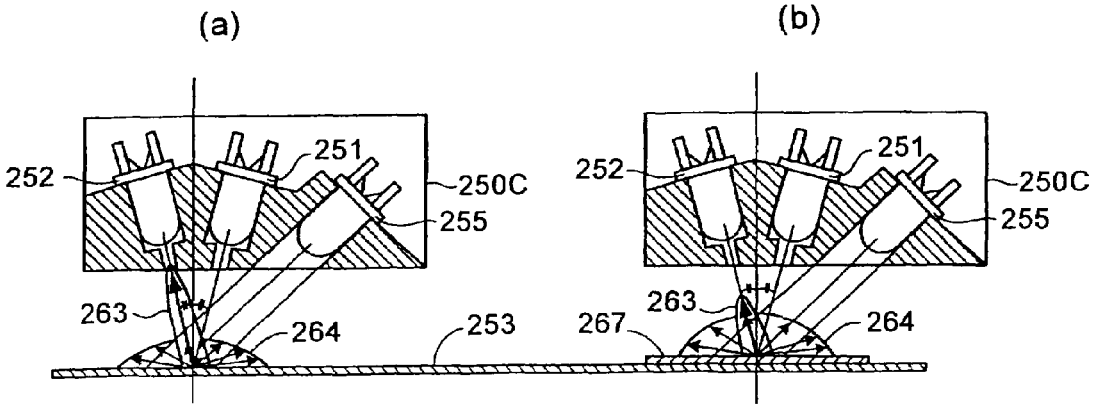
FIG. 31 illustrates that the light received by a regular reflection photodetector as the regular reflection light includes the pure regular reflection components as well as diffuse reflection components from the detection target surface and diffuse reflection components from the toner layer.
Figure 32:
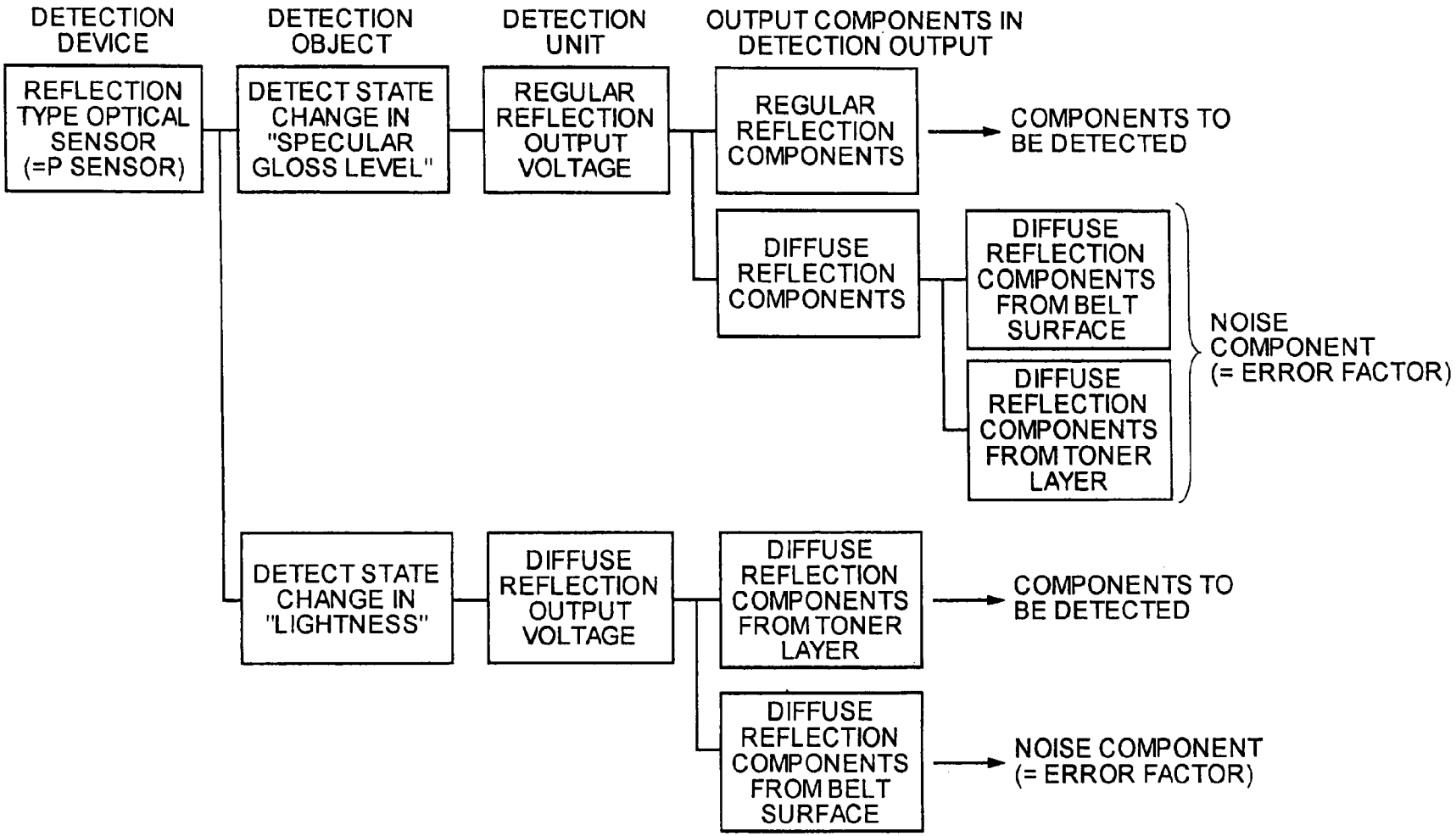
FIG. 32 is a block diagram illustrating relations between the reflected light components to be actually detected by the optical detecting unit and reflected light components to be removed.
Figure 33:
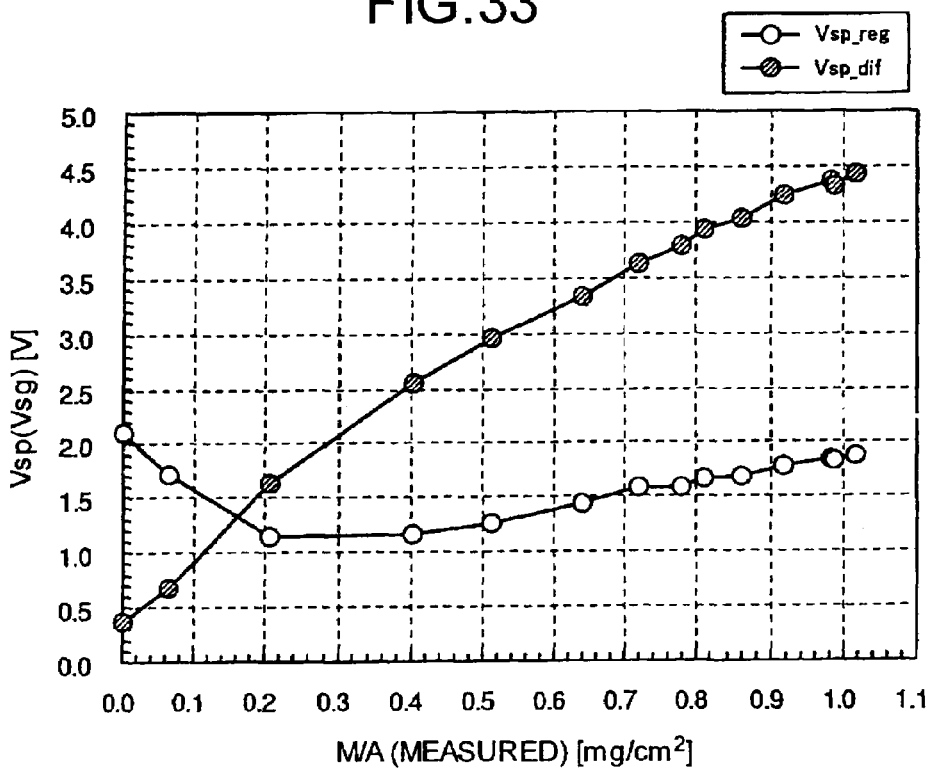
FIG. 33 is a graph illustrating relations between a transfer and a detection output at the time of data sampling.
Figure 34:
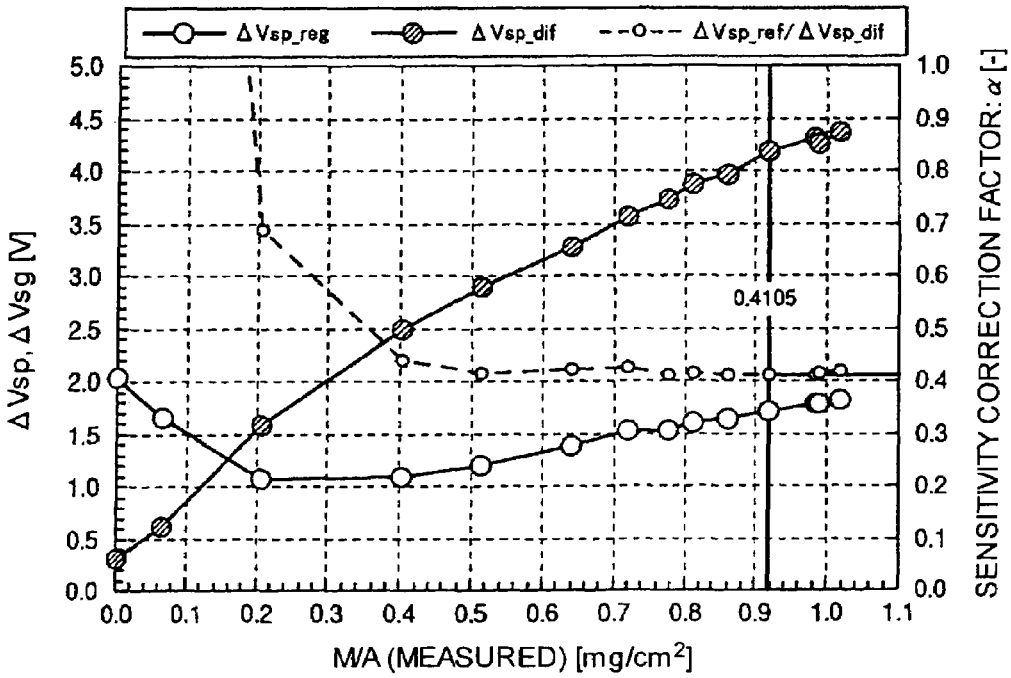
FIG. 34 is a graph illustrating relations between a sensitivity correction factor multiplied to the diffuse reflection output, the transfer, and the detection output.

When the regular reflection output characteristic with respect to the black toner transfer illustrated in FIG. 22 is compared with the regular reflection output characteristic with respect to the amount color toner transfer illustrated in FIG. 23, in FIG. 23, it is seen that the regular reflection output changes from a monotonous decrease to a monotonous increase at a certain transfer (in this case, 0.2 to 0.4 mg/cm$^2$). This is because, as illustrated in FIGS. 31 and 32, the light received by the regular reflection photodetector 252 as the regular reflection light includes [diffuse reflection components from the belt surface] and [diffuse reflection components from the toner layer], in addition to the pure [regular reflection components]. Reference sign 254 denotes a solid part of cyan.

Considering that the irradiation light from the LED 251 uniformly diffuses on the detection target surface, as illustrated in FIG. 31, n-times relation should be established between the diffuse reflection components received by the regular reflection photodetector 252 and the diffuse reflection light entering into the diffuse reflection photodetector 255.

The n-times value used herein is a value determined by the optical layout such as light receiving diameter and arrangement of the respective photodetectors 252 and 255.

The actual output is output as a voltage, after the reflected light entering into the respective photodetectors 252 and 255 is I-V converted by an OP amplifier in the circuit. Therefore, a difference in gain of the OP amplifier in each output is multiplied to the output relation between these, and hence β times relation should be established.

It is considered that if such a factor α can be obtained, the components of the regular reflection output can be divided into the "regular reflection components" and the "diffuse reflection components".

Considering how to obtain the factor α, with regard to the Bk toner, as the diffuse reflection components becomes close to zero, the factor α becomes smaller. Therefore, it can be considered that the regular reflection output characteristic of Bk illustrated in FIG. 22 is substantially equal to the regular reflection output characteristic of the color toner, from which the diffuse reflection components are removed.

As illustrated in FIG. 22, the regular reflection output characteristic of the Bk toner is such that the output value becomes substantially zero or a slightly positive value, with an increase in the transfer, and never takes a negative value. Therefore, by determining a minimum value of a ratio between the regular reflection output and the diffuse reflection output for each P pattern of the color toner, and subtracting a value obtained by multiplying the diffuse reflection output by the minimum value of the ratio from the regular reflection output, the intended output characteristic of only the regular reflection components should be able to be extracted.

The processing flow will be explained based on the output result of a brown belt (Gs=27, L*=25) illustrated in FIG. 23.

The meaning of signs (marks) in the following explanation is as follows.

Vsg Output voltage in the transfer belt background

Vsp Output voltage in each pattern

Voffset Offset voltage (output voltage at the time of the LED 251 being OFF)

_reg. Regular reflection output (abbreviation of Regular Reflection)

_dif. Diffuse reflection output (abbreviation of Diffuse Reflection, see terms relating to color, in JISZ8105)

[n] Number of elements: array variable of n (Step 1): Calculation of Data Sampling: ΔVsp, ΔVsg (See FIGS. 33 and 34)

A difference between the regular reflection output and the offset voltage (an output at the time of the LED, a light emitting diode, being OFF), and a difference between the diffuse reflection output and the offset voltage are calculated first for all points [n] according to the following processing expression 1. This is for finally expressing the "increment of the sensor output only by the increment due to the transfer change in the color toner".

Since the processing for the transfer belt background is similar to that for the respective pattern portions, except of being only one-point detection, only the processing expression for the pattern portions will be described until STEP 3.

Regular Reflection Output Increment:

$$\Delta V\text{sp_reg.}[n]=V\text{sp_reg.}[n]-V\text{offst_reg. Diffuse reflection output increment: }\Delta V\text{sp_ref.}[n]=V\text{sp_dif.}[n]-V\text{offst_dif.} \quad (1)$$

However, when an OP amplifier in which the respective offset output value at the time of the LED 251 being OFF becomes sufficiently small so that it can be ignored (in the embodiment, Vsp_reg_offset: 0.0621 volt, and Vsp_dif_offset: 0.0635 volt), such difference processing is not necessary, and the regular reflection output or diffuse reflection output may be directly used.

(STEP 2): Calculation of Sensitivity Correction Factor: α (FIG. 9)

When ΔVsp_reg.[n]/ΔVsp_dif.[n] is calculated for each point by the ΔVsp_reg.[n] and ΔVsp_dif.[n] obtained at STEP 1, to divide the components of the regular reflection output at STEP 3, calculation of the factor α to be multiplied to the diffuse reflection output (ΔVsp_dif.[n]) is performed according to the following expression $$\alpha = \min\left(\frac{\Delta\text{Vsp_reg.}[n]}{\Delta\text{Vsp_dif.}[n]}\right) \quad (2)$$

Here, the reason why a is obtained from the minimum value of the ratio is that it is known that the minimum value of the regular reflection output components in the regular reflection output is substantially zero The gradation pattern here includes at least one, desirably, at least three transfer patterns, close to the transfer, at which the minimum value of the ratio between the regular reflection output and the diffuse reflection output can be obtained. Near the transfer, at which the minimum value of the ratio between the regular reflection output increment and the diffuse reflection output increment obtained from a difference between the respective output values at the time of light emitting diode being OFF can be obtained, at least one, desirably, at least three transfer patterns may be included. Alternatively, at least three transfer patterns may be included within a transfer range where the regular reflection output conversion value is in a primary linear relation with respect to the transfer.

Figure 35:
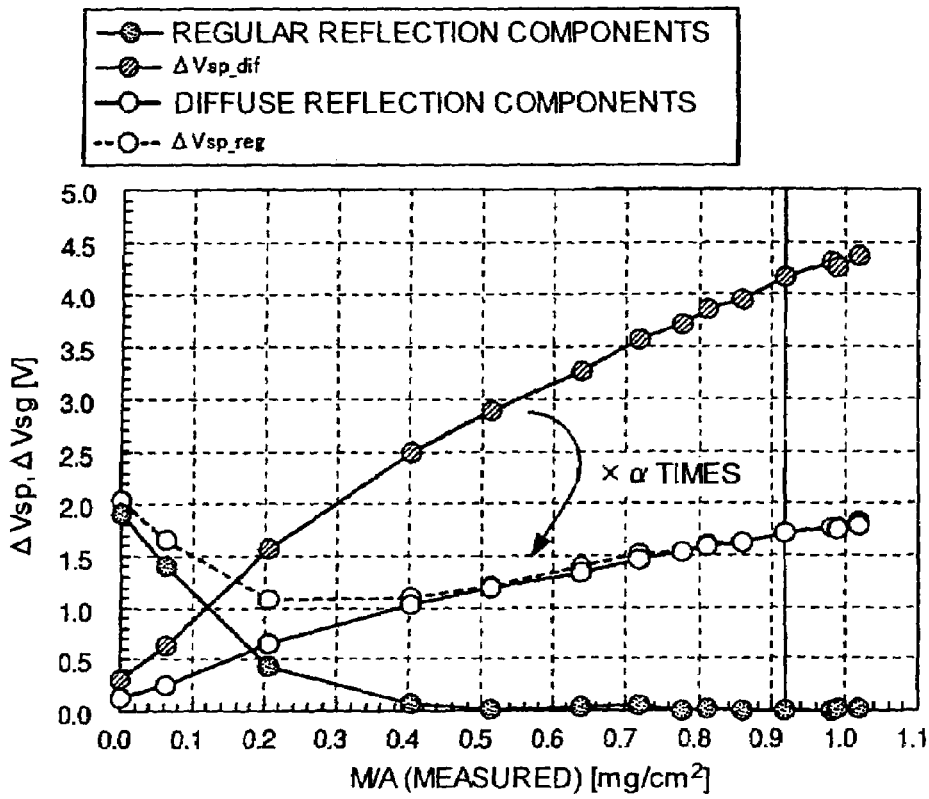
FIG. 35 is a graph illustrating separation of components in the regular reflection light.

(STEP 3): Separation of Components of Regular Reflection Light (FIG. 35)

Separation of components in the regular reflection output is performed according to the following expression.

Diffuse reflection components in regular reflection output:

$$\Delta V\text{sp_reg._dif.}[n]=V\text{sp_dif.}[n]\times\alpha$$

Regular reflection components in regular reflection output:

$$\Delta V\text{sp_reg._reg.}[n]=V\text{sp_reg.}[n]-\Delta V\text{sp_reg._dif.}[n] \quad (3)$$

When the components are separated in this manner, the regular reflection output components in the regular reflection output become zero in the pattern portion where the sensitivity correction factor α is obtained.

By this processing, as illustrated in FIG. 35, the components in the regular reflection output are divided into the [regular reflection components] and the [diffuse reflection components].

(STEP 4): Normalization of Regular Reflection Output-_Diffuse Reflection Output (see FIG. 36)

In order to correct the difference between the regular reflection outputs from the background of the three types of belts, a ratio of the output from each pattern portion to the output from the belt background is calculated, and converted to a normalized value of from 0 to 1.

$$\text{Normalized value: }\beta[n]=\Delta V\text{sp_reg._reg.}[n]/\Delta V\text{sg_reg._reg.}[n]\text{(=Exposure rate of transfer belt background)} \quad (4)$$

Figure 36:
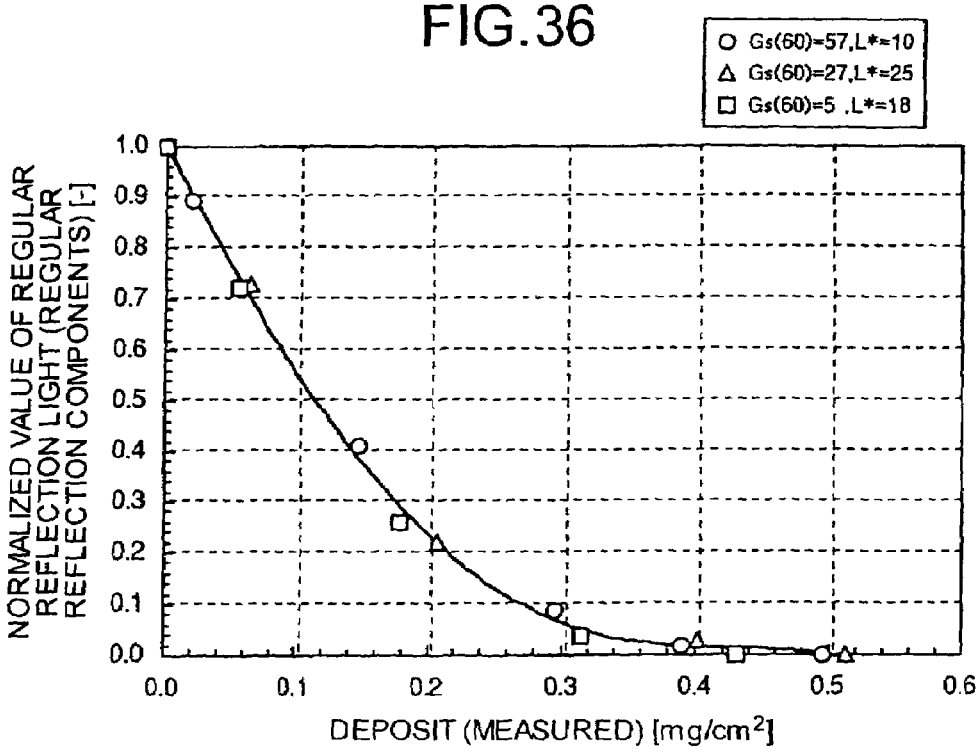
FIG. 36 is a graph illustrating normalization of the regular reflection components in the regular reflection output.

FIG. 36 illustrates the conversion results to the normalized values obtained by performing the similar processing for all three types of belts illustrated in FIG. 23.

Thus, by dividing the components in the regular reflection light, to extract only the regular reflection components, and converting the components to a normalized value, the relation between the regular reflection components and the transfer can be determined unequivocally. This value expresses an exposure rate of the belt background, and in a transfer range of from transfer zero to one layer formation, this normalized value (=exposure rate of the belt background) is in a primary linear relation with respect to the transfer.

When it is desired to determine the amount of toner transfer in a low transfer area of M/A=0 to 0.4 mg/cm$^2$, the amount-of-transfer conversion can be performed by experimentally obtaining the relations between the transfer and the normalized value as illustrated in FIG. 35 as a numerical expression or table data beforehand, and inverting this or referring to the table.

Comparison with the conventional technique is made. Claim 4 in Japanese Patent Application Laid-Open No. 2001-215850 describes an expression of "regular reflection light+(irregular reflection light−irregular reflection output min)×a predetermined coefficient", and in an embodiment part in the specification, there is a description that the predetermined coefficient is set to [−6], so that the output after correction is in a primary correlation. However, multiplication of the predetermined coefficient in this form does not have a practical meaning, because, as described above, a characteristic difference of the optical detecting unit is not taken into consideration.

On the other hand, in the embodiment of the present invention, since a coefficient calculated based on the sensor outputs of the regular reflection light and diffuse reflection light is multiplied as the predetermined coefficient, highly accurate detection can be performed, taking into consideration a characteristic difference of the optical detecting unit.

The processing for removing the [diffuse reflection output components from the belt background] from the [diffuse reflection output voltage] will be explained below.

In this embodiment, what is desired to obtain finally according to the amount-of-transfer conversion algorithm is unequivocal relations between the diffuse reflection output and the amount of toner transfer.

As illustrated in FIG. 32, however, since the light entering into the diffuse reflection photodetector 55 includes the diffuse reflection light from the belt background (noise component) in addition to the diffuse reflection light from the toner layer, it is necessary to remove this component from the original output.

The ratio between the [background output] and [pattern portion output] in the regular reflection components is unequivocally determined with respect to the transfer (transfer detectable range: 0 to 0.4 mg/cm$^2$).

In the diffuse reflection components from the toner layer, if the irradiation light onto the detection target surface is constant, the relation with respect to the transfer is unequivocally determined (transfer detectable range: 0 to 1.0 mg/cm$^2$).

As a follow-up of STEP 4, the processing flow will be explained based on the output result of a brown belt (Gs=27, L*=25) illustrated in FIG. 25.

As shown in the results in FIG. 25, the diffuse reflection output from the belt background becomes the largest in the belt background where the toner does not adhere, and the components gradually decrease as the toner adheres.

The relation of the diffuse reflection output voltage increment due to the light entering into the diffuse reflection photodetector 55 directly from the belt background to the transfer is in proportion to the exposure rate of the transfer belt 18, that is, the normalized value of the regular reflection components in the regular reflection output obtained previously (see FIG. 36). Therefore, the processing for removing the [diffuse reflection output components from the belt background] from the [diffuse reflection output voltage] is as described below.

(STEP 5): Correction of Changes in the Background in the Diffuse Reflection Output (see FIG. 37)

Diffuse reflection output after correction: $\Delta V$sp_dif.'= [diffuse reflection output voltage]−[belt background output]×[normalized value of regular reflection components]=$\Delta V$sp_dif($n$)−$\Delta V$sg_dif×$\beta(n)$ (5)

Figure 38:
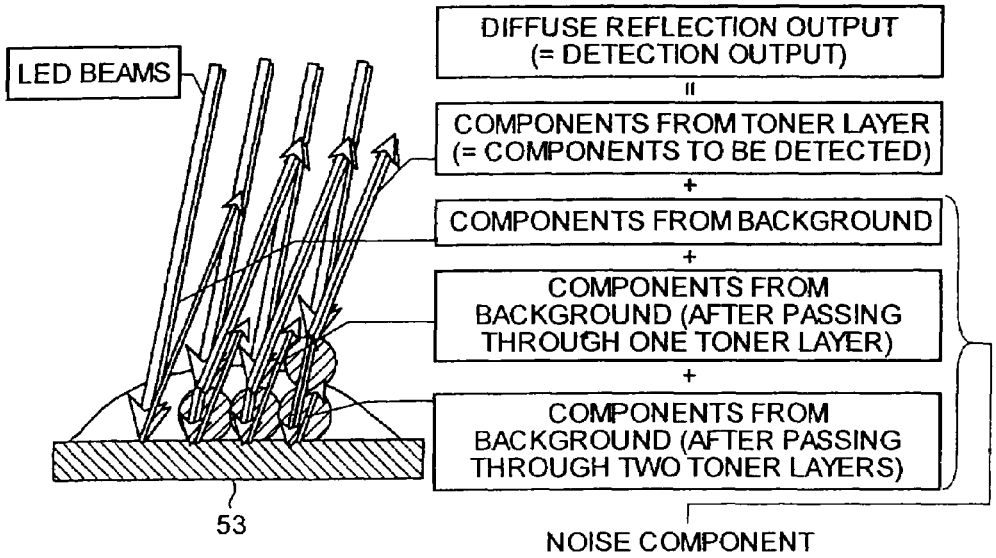
FIG. 38 illustrates that a plurality of components exists in the components reflected from a belt background.

The results are illustrated in FIG. 38. By performing such correction processing, the influence of the background of the transfer belt 218 can be eliminated. Therefore, the [diffuse reflection components directly reflected from the belt background] can be removed from the [diffuse reflection output] in the low transfer area in which the regular reflection output has a sensitivity.

By performing such a processing, the diffuse reflection output after correction in the transfer range of from transfer zero to one layer formation is converted to a certain value having a primary linear relation passing through the origin with respect to the transfer.

The diffuse reflection light will be further explained. The regular reflection light is light reflected on the detection target surface, and hence as illustrated in FIG. 36, when the detection target surface is covered with the toner by 100%, the output does not change substantially in the further transfer area, and the normalized conversion value becomes substantially zero.

On the other hand, the diffuse reflection light is such that the light irradiated from the LED 251 and having entered into the toner layer is multi-reflected. Therefore, as illustrated in FIG. 25, even in the high transfer area covered with the toner layer by 100%, the sensor output has a characteristic of a monotonous increase.

Therefore, the light reflected from the belt background includes, as illustrated in FIG. 38, primary components directly reflected by the belt background, and secondary and tertiary components reflected after having transmitted through the toner layer.

In this embodiment, correction only for the primary components is performed at STEP 5, but only with this correction, the influence of the belt background can be removed substantially accurately, at least in the low transfer area where the sensitivity correction is performed. Since the secondary and tertiary components are sufficiently small as compared with the primary components, practically sufficient accuracy can be obtained with the correction of only the primary components.

By the above processing, in the low transfer area where the regular reflection output has a sensitivity, only the [regular reflection components] that can unequivocally express the relation with the amount of toner transfer are extracted from the regular reflection light in (2), and the [diffuse reflection components directly reflected from the belt background] can be removed from the diffuse reflection light in (3). Hence, based on these, the sensitivity correction is performed for the diffuse reflection output.

The reason why the sensitivity correction is performed here is to perform correction as described below:

(1) correction of light emitting diode output and photodetector output with respect to a lot difference; and (2) correction of light emitting diode output and photodetector output with respect to temperature characteristics and deterioration.

The most important point in this processing is that the sensitivity correction for the diffuse reflection output is performed by using the fact that two outputs after correction for the regular reflection light and the diffuse reflection light are in a primary relation with respect to the amount of toner transfer, such that in the low transfer area where the toner layer is formed only in one layer, 1. The normalized value of the regular reflection output (regular reflection components), that is, the exposure rate of the transfer belt background is in a primary linear relation with respect to the amount of toner transfer; and 2. The [diffuse reflection components from the toner layer] are in a primary linear relation passing through the origin with respect to the amount of toner transfer.

Various methods can be considered as the method for correcting the sensitivity. Here, two methods will be explained as an example.

(STEP 6): Sensitivity Correction for Diffuse Reflection Output (See FIG. 37)

Figure 39:
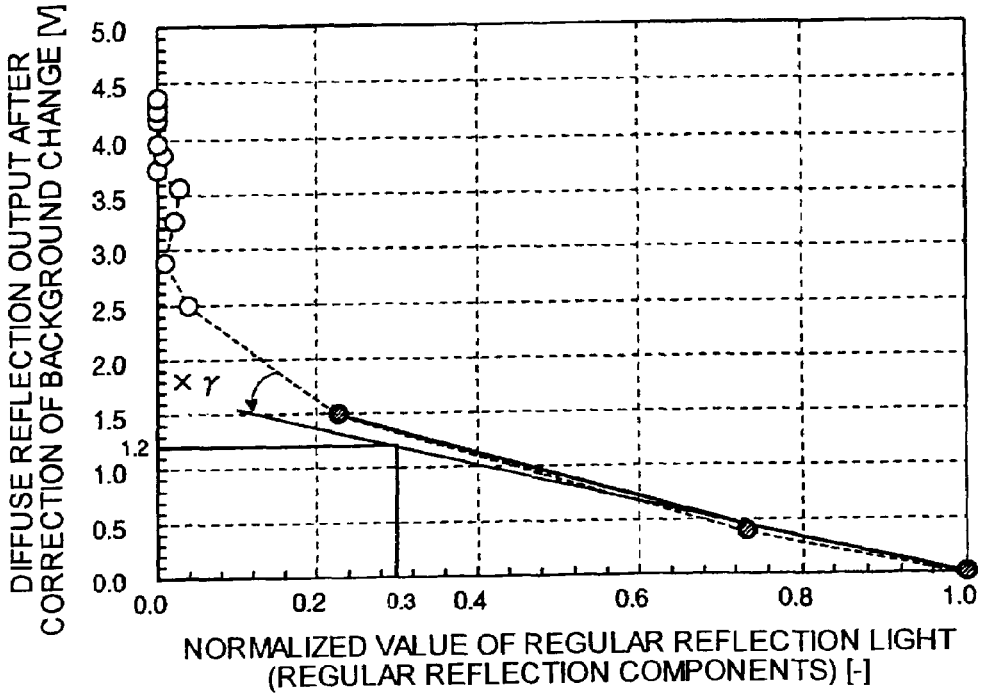
FIG. 39 is a graph illustrating relations between the normalized value of the regular reflection components and the diffuse reflection output after correction of a background change.
Figure 40:
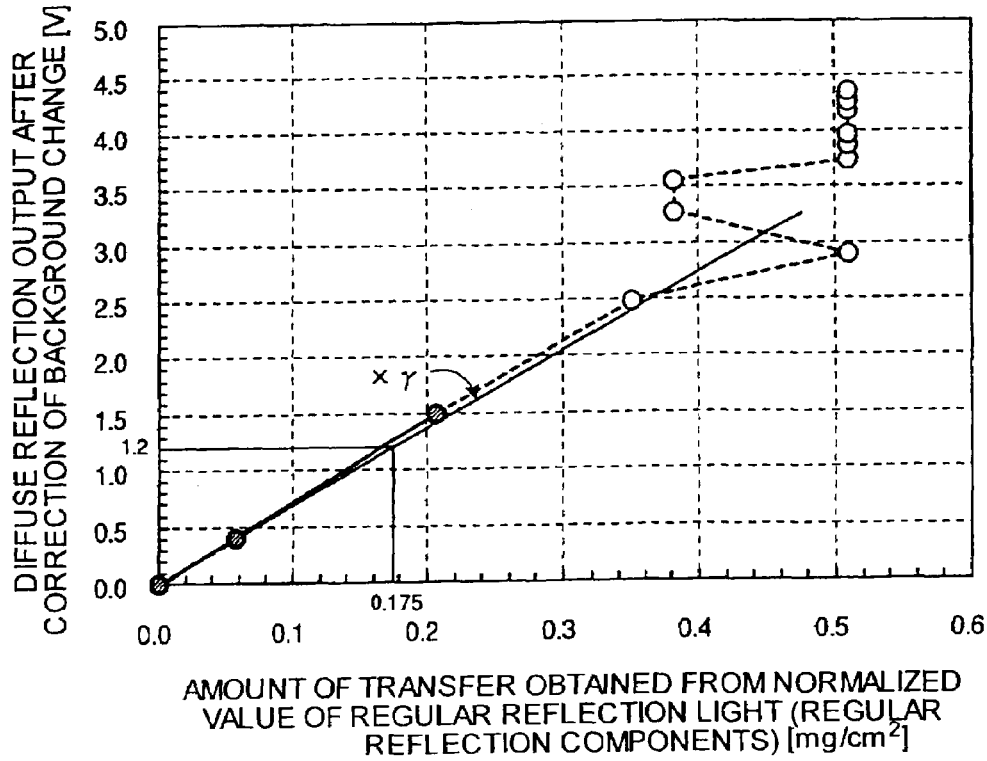
FIG. 40 is a graph illustrating sensitivity of the diffuse reflection output.

As illustrated in FIG. 39, the diffuse reflection output after correcting a background change is plotted with respect to the [normalized value of the regular reflection light (regular reflection components)], and the sensitivity of the diffuse reflection output is determined from the linear relation in the low transfer area, to perform correction so that the sensitivity becomes the predetermined sensitivity.

The sensitivity of the diffuse reflection output here stands for the inclination of the line illustrated in FIG. 39, and a correction factor to be multiplied to the current inclination is calculated so that the diffuse reflection output after correcting a background change with respect to a certain normalized value becomes a certain value (here, 1.2 when the normalized value is 0.3), to perform correction.

(1) The Inclination of the Line is Determined by the Least-Squares Method.

$$\text{Inclination of line} = \frac{\Sigma(x[i]-\overline{X})(y[i]-\overline{Y})}{\Sigma(x[i]-\overline{X})^2} \tag{6}$$

y intercept=Y-inclination of line×X x[i]: normalized value of regular reflection_regular reflection components X: Mean value of normalized value of regular reflection-_regular reflection components y[i]: Diffuse reflection output after correction of background change Y: Mean value of diffuse reflection output after correction of background change However, the x range to be used in calculation is $0.06 \leqq x \leqq 1$.

In this embodiment, the lower limit of the x range used for the calculation is set to 0.06, but this lower limit is a value optionally determined in a range where x and y are in a linear relation. The upper limit is set to 1, since the normalized value is from 0 to 1.

(2) A sensitivity correction factor γ is determined so that a certain normalized value "a" calculated from the thus obtained sensitivity becomes a certain value "b".

$$\text{Sensitivity correction factor } \gamma = \frac{b}{\text{Inclination of line} \times a + y \text{ intercepts}} \tag{7}$$

(3) This sensitivity correction factor γ is multiplied to the diffuse reflection output after correcting the background change, obtained at STEP 5, to perform correction. A reference point at the time of performing sensitivity correction (a certain regular reflection output conversion value at the time of multiplying a correction factor so that the diffuse reflection output conversion value with respect to a certain regular reflection output conversion value becomes a certain value) is in an area where transfer detection by the regular reflection light is possible.

Diffuse reflection output after sensitivity correction: $\Delta V$sp_dif."=[Diffuse reflection output after correction of background change]×[Sensitivity correction factor: γ]=$\Delta V$sp_dif.$(n)'$×γ (8)

The [normalized value of the regular reflection light (regular reflection components)] is converted to a transfer (converted value), by an inversion expression obtained from the relation between the transfer (measurement) obtained from FIG. 36, and the normalized value of the regular reflection light (regular reflection components), or referring to a conversion table, the diffuse reflection output after correcting the background change is plotted with respect to this transfer (converted value), the sensitivity of the diffuse reflection output is determined from the linear relation in the low transfer area, and correction is performed so that this sensitivity becomes the predetermined sensitivity.

A different point from the first method is that the X axis is changed from the [normalized value of the regular reflection light (regular reflection components)] to the [transfer (converted value)]. The sensitivity of the diffuse reflection output here stands for the inclination of the line illustrated in FIG. 40, and a correction factor to be multiplied to the current inclination is calculated so that the diffuse reflection output after correcting a background change with respect to a certain transfer (converted value) becomes a certain value (here, 1.2 when the transfer is 0.175), to perform correction.

(1) The inclination of the line is determined by the least-squares method.

$$\text{Inclination of line} = \frac{\Sigma(x[i]-\overline{X})(y[i]-\overline{Y})}{\Sigma(x[i]-\overline{X})^2} \tag{9}$$

y intercept=Y-inclination of line×X x[i]: Deposit (converted value)

X: Mean value of transfers (converted values)

y[i]: Diffuse reflection output after correction of background change

Y: Mean value of diffuse reflection outputs after correction of background change However, the x range to be used in calculation is $0 \leqq x \leqq 0.3$.

In this embodiment, the upper limit of the x range used for the calculation is set to 0.3, but this upper limit is a value optionally determined in a range where x and y are in a linear relation. The lower limit is set to 0, since the lower limit of the transfer is 0.

(2) A sensitivity correction factor γ is determined so that a certain normalized value a calculated from the thus obtained sensitivity becomes a certain value b.

$$\text{Sensitivity correction factor } \gamma = \frac{b}{\text{Inclination of line} \times a + y \text{ intercepts}} \tag{10}$$

(3) This sensitivity correction factor γ is multiplied to the diffuse reflection output after correcting the background change, obtained at STEP 5, to perform correction.

Diffuse reflection output after sensitivity correction: $\Delta V$sp_dif."=[Diffuse reflection output after correction of background change]×[Sensitivity correction factor: γ]=$\Delta V$sp_dif.$(n)'$×γ (11)

Figure 41:
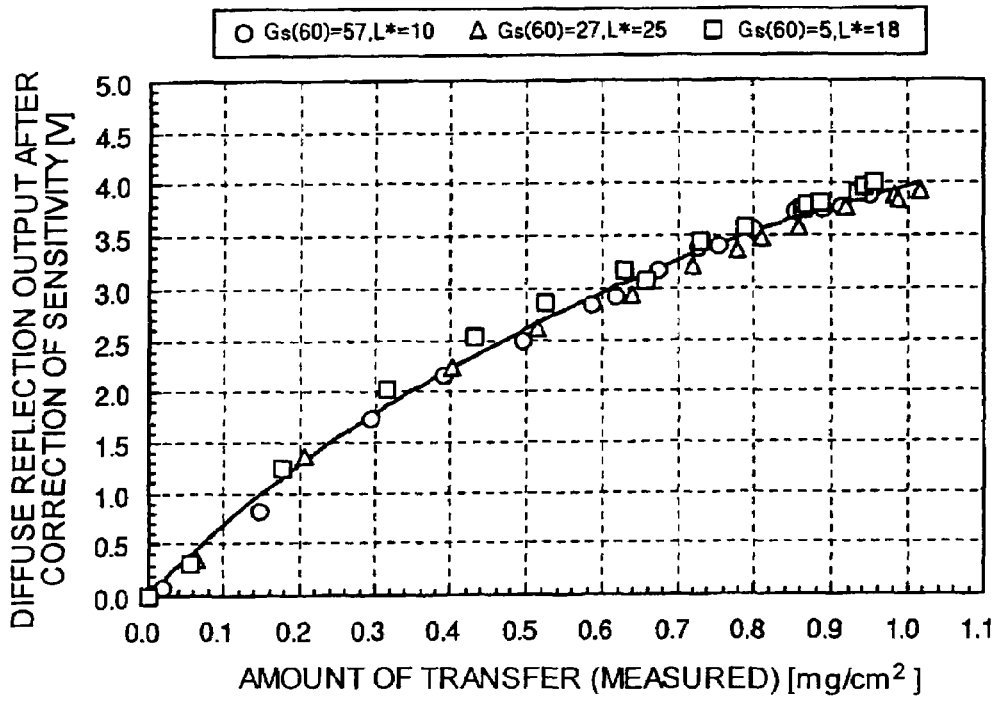
FIG. 41 is a graph illustrating conversion results to the normalized value.

FIG. 41 illustrates the conversion results to the normalized value, obtained by performing the same processing with respect to all three types of the belts.

Here, since the diffuse reflection output voltage before the correction is as illustrated in FIG. 25, it can be confirmed that (1) correction of light emitting diode output and photodetector output with respect to a lot difference; and (2) correction of light emitting diode output and photodetector output with respect to temperature characteristics and deterioration, which is the object of the present invention, can be sufficiently executed by the above processing.

By such processing, since the diffuse reflection output after correction of the sensitivity with respect to the amount of toner transfer can be expressed unequivocally, if this is determined experimentally beforehand as a numerical expression or table data, accurate amount-of-transfer conversion becomes possible up to the high transfer area, by performing inverse conversion or referring to the conversion table.

Figure 42:
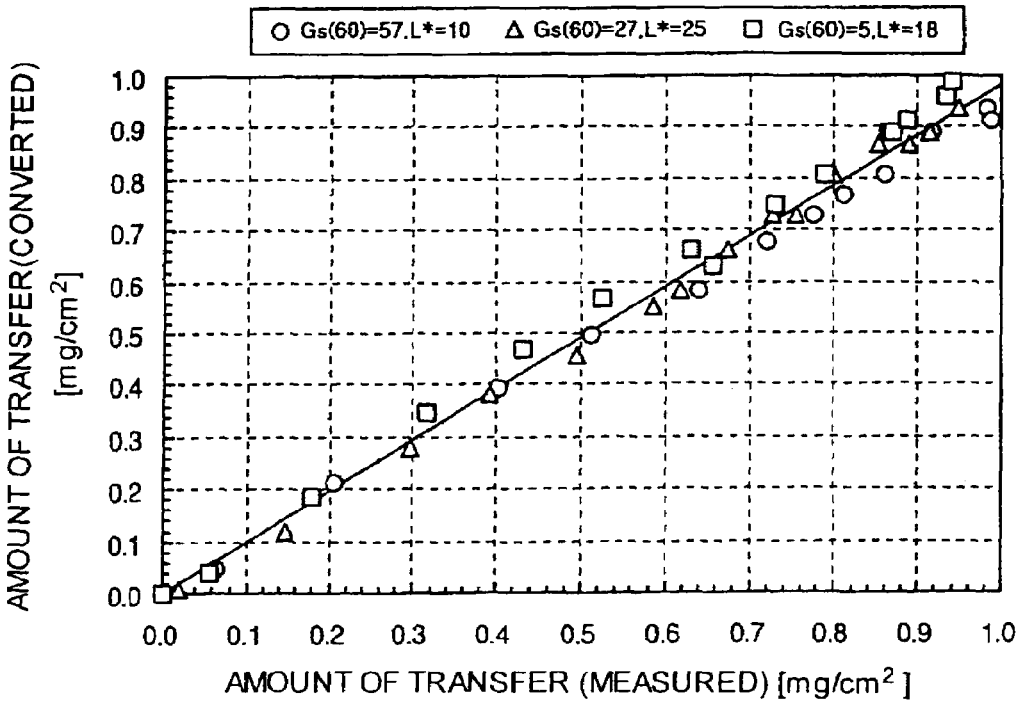
FIG. 42 is a graph illustrating results of plotting the transfer obtained by inverting the normalized value with respect to the transfer measurements by an electronic scale.

The results of plotting the transfer (converted value) actually obtained by inverting the normalized value with respect to a transfer measurement obtained by the electronic scale are illustrated in FIG. 42.

As illustrated in FIG. 42, it can be confirmed that the amount-of-transfer conversion can be performed considerably accurately up to the high transfer area. Since accurate transfer detection becomes possible up to the high transfer area, the maximum target transfer in the image density control can be accurately controlled. As a result, stable image quality can be obtained at all times, regardless of age-based difference, environmental difference, and a lot difference of sensors.

Figure 43:
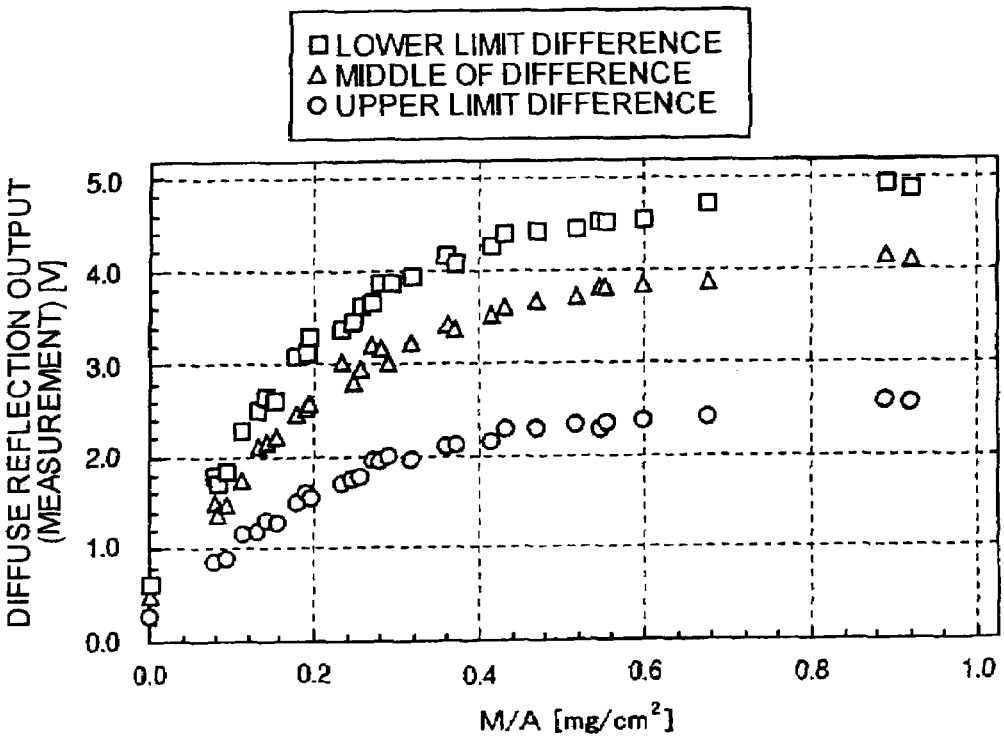
FIG. 43 is a graph illustrating relations between a lot difference of the optical detecting unit extracted from many prototypes, and the diffuse reflection output in detection of gradation patterns.
Figure 44:
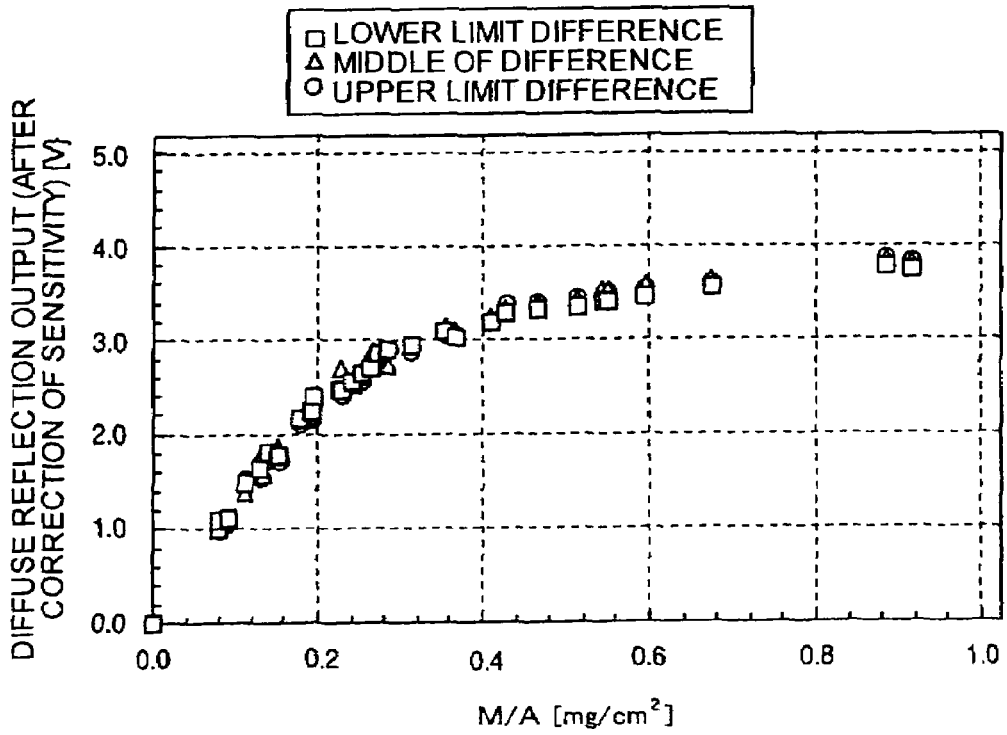
FIG. 44 is a graph illustrating relations between a lot difference of the optical detecting unit extracted from many prototypes, and the diffuse reflection output after correction of sensitivity in detection of gradation patterns.

FIG. 43 illustrates a diffuse reflection output voltage, obtained by detecting 30 P patterns (gradation patterns), 10 for each color toner, formed on the transfer belt 218 in the laser color printer A illustrated in FIG. 13, by three sensors extracted as the upper limit product, the lower limit product, and the intermediate product, of 200 prototypes of the density detection sensor. FIG. 43 illustrates a diffuse reflection conversion value according to the conversion algorithm at STEP 1 to STEP 6. The LED current at this time has a value adjusted so that the regular reflection output voltage in the background of the transfer belt 218 becomes 4.0 volts.

From this result, an output difference of the photodetector due to various factors in the optical detecting unit can be automatically and highly accurately corrected on the algorithm side, that is, on the software side, by using the algorithm according to this embodiment (the present invention), without requiring strict adjustment on the hardware side.

In the second embodiment, for the optical detecting unit, one having the light emitting diode, the regular reflection photodetector, and the diffuse reflection photodetector illustrated in FIG. 16 is used. However, the similar detection function can be realized by using an optical detecting unit having the beam splitter illustrated in FIG. 17

Application Example 1 of the Second Embodiment

In the second embodiment, the detection target surface is the transfer belt 218 as a transfer body, but the respective photosensitive drums may be used as the detection target surface (Application Example 2 of the second embodiment). In this case, the P sensor 40 is provided so as to face the respective photosensitive drums.

Figure 45:
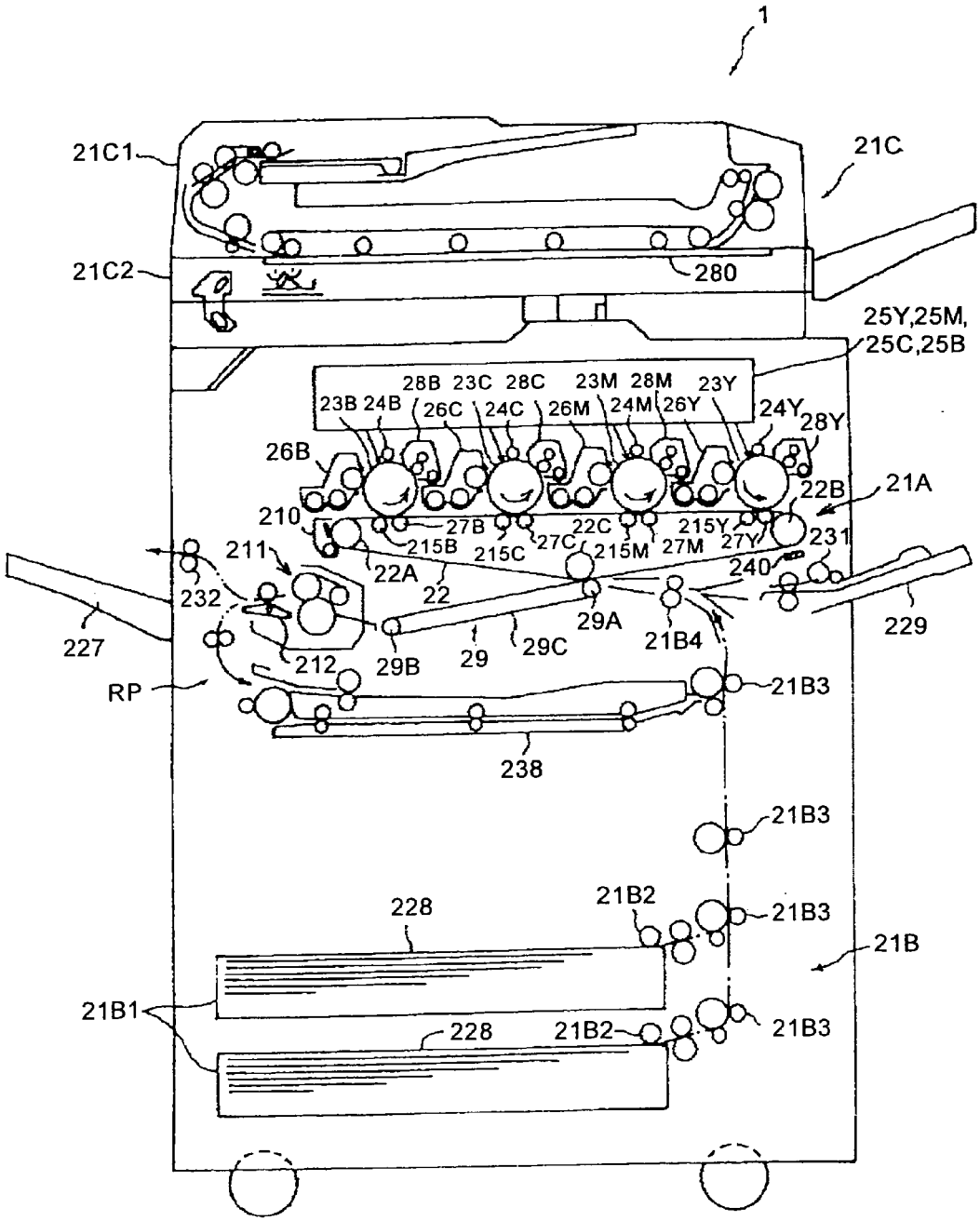
FIG. 45 is a schematic front elevation of a color image forming apparatus of a train-of-four tandem type in which toner images are transferred and superposed onto an intermediate transfer body and then collectively transferred onto transfer paper.

In the second embodiment, an example of the color image forming apparatus of the train-of-four tandem direct transfer type is described. However, as illustrated in FIG. 45, the present invention is also applicable to a color image forming apparatus of the train-of-four tandem type, in which the toner images are transferred and superposed on an intermediate transfer body, and then collectively transferred onto the transfer paper (Application Example 3 of the second embodiment).

In Application Example 3, the P patterns for density detection illustrated in FIG. 30 are formed on the intermediate transfer belt 22 as the intermediate transfer body, which are detected by the P sensor 240 arranged close to a support roller 22B. In other words, the intermediate transfer belt 22 is the detection target surface. The detection method and the operation (handling of the detection data and the like) are the same as in the second embodiment.

The configuration and the outline of operation of the tandem type color copying machine as the image forming apparatus in Application Example 3 will be explained. The color copying machine 1 has an image forming section 21A located at the center of the apparatus, a paper feeder 21B located below the image forming section 21A, and an image reader 21C located above the image forming section 21A.

An intermediate transfer belt 22 as the transfer body having a transfer plane extending in the horizontal direction is arranged in the image forming section 21A, and a configuration for forming an image of a color having a complementary relation with a color-separated color is provided on the upper surface of the intermediate transfer belt 22. In other words, photosensitive drums 23Y, 23M, 23C, and 23B as image carriers capable of supporting images of color toners having a complementary relation (yellow, magenta, cyan, and black) are juxtaposed along the transfer plane of the intermediate transfer belt 22.

The respective photosensitive drums 23Y, 23M, 23C, and 23B are respectively formed of a drum rotatable in the same counterclockwise direction, and a charging apparatus 24 as a charging unit that executes image forming processing in the rotation process, an optical write unit 25 as an exposure unit that forms an electrostatic latent image of a potential VL on the respective photosensitive drums 23Y, 23M, 23C, and 23B based on the image information, a development unit 26 as a development unit that develops the electrostatic latent image on the respective photosensitive drums 23 with a toner having the same polarity as that of the electrostatic latent image, a transfer bias roller 27 as a primary transfer unit, a voltage application member 215, and a cleaning unit 28 are respectively arranged around the respective photosensitive drums. The alphabet added to the respective reference number corresponds to the toner color, as with the photosensitive drums 23. The respective color toner is stored in the respective development unit 26.

The intermediate transfer belt 22 is spanned over a plurality of rollers 22A to 22C, and can move in the same direction with the photosensitive drums 23Y, 23M, 23C, and 23B at the confronting position therewith. The roller 22C separate from the rollers 22A and 22B for supporting the transfer plane faces a secondary transfer apparatus 29, putting the intermediate transfer belt 22 therebetween. In FIG. 45, a sign 210 denotes a cleaning unit for the intermediate transfer belt 22.

The surface of the photosensitive drum 23Y is uniformly charged by the charging apparatus 24Y, and an electrostatic latent image is formed on the photosensitive drum 23Y based on the image information from the image reader 21C. The electrostatic latent image is visualized as a toner image by a two-component (carrier and toner) development unit 26Y that stores a yellow toner, and the toner image is attracted and transferred onto the intermediate transfer belt 22 by an electric field due to the voltage applied to the transfer bias roller 27Y, as a first transfer step.

The voltage application member 2151 is provided on the upstream side of the transfer bias roller 27Y in the rotation direction of the photosensitive drum 23Y. The voltage application member 2151 applies a voltage having the same polarity as the charging polarity of the photosensitive drum 23Y and having an absolute value larger than that of VL in the solid state to the intermediate transfer belt 22, so that it is prevented that the toner is transferred to the intermediate transfer belt 22 from the photosensitive drum 23Y before the toner image enters into the transfer area, to prevent turbulence due to dust at the time of transferring the toner from the photosensitive drum 23Y to the intermediate transfer belt 22.

In other photosensitive drums 23M, 23C, and 23B, the similar image forming is performed, with only the toner color being different, and the respective color toner images are transferred and superposed on the intermediate transfer belt 22 sequentially.

After transfer, the toner remaining on the photosensitive drum 23 is removed by the cleaning unit 28, and the potential of the photosensitive drum 23 is initialized by a discharging lamp (not shown), for preparation for the next imaging step.

The secondary transfer apparatus 29 has a transfer belt 29C spanned over a charging drive roller 29A and a driven roller 29B, and moving in the same direction as the intermediate transfer belt 22. Since the transfer belt 29C is charged by the charging drive roller 29A, a multi-color image superposed on the intermediate transfer belt 22 or a single color image carried thereon can be transferred to the paper 228 as the recording medium.

The paper 228 is fed from a paper feeder 21B to a secondary transfer position. The paper feeder 21B is provided with a plurality of paper feed cassettes 21B1 in which the paper 228 is loaded and stored, a feed roller 21B2 that separates the paper 228 stored in the paper feed cassette 21B1 one by one sequentially from the top to feed the paper, carrier roller pairs 21B3, and a resist roller pair 21B4 located on the upstream of the secondary transfer position.

The paper 228 fed from the paper feed cassette 21B1 is temporarily stopped by the resist roller pair 21B4, and carried toward the secondary transfer position, with a skew thereof corrected, at a timing that the edge of a toner image formed on the intermediate transfer belt 22 agrees with a predetermined position of the point of the transfer paper in the transport direction. A manual feed tray 229 is provided foldably on the right side of the apparatus, and the paper 228 stored in the manual feed tray 229 is carried toward the resist roller pair 21B4, through a carrier path joining to a paper carrier path from the paper feed cassette 21B1 fed by the feed roller 231.

In the optical write unit 25, writing beams are controlled by the image information from the image reader 21C or the image information output from a computer (not shown), to emit the writing beams corresponding to the image information with respect to the photosensitive drums 23Y, 23M, 23C, and 23B, thereby forming an electrostatic latent image.

The image reader 21C has an automatic document feeder 21C1, a scanner 21C2 having a contact glass 280 as an original table, and the like. The automatic document feeder 21C1 has a configuration capable of reversing the document sent out onto the contact glass 280, so that scanning for the both sides of the document is possible.

The electrostatic latent image on the photosensitive drum 23 formed by the optical write unit 25 is visualized by the development unit 26, and primary-transferred onto the intermediate transfer belt 22. After the toner images for the respective colors are transferred and superposed on the intermediate transfer belt 22, the toner images are secondary-transferred onto the paper 228 collectively by the secondary transfer apparatus 29. The secondary-transferred paper 228 is sent to the fixing apparatus 211, where the unfixed image is fixed by heat and pressure. The residual toner on the intermediate transfer belt 22 after the secondary transfer is removed by the cleaning unit 210.

The paper 228 having passed through the fixing apparatus 211 is selectively guided to either the carrier path toward the output tray 227 or the reversing path RP, by a carrier path switching hook 212 provided on the downstream side of the fixing apparatus 211. When carried toward the output tray 227, the paper 228 is ejected onto the output tray 227 by an ejection roller pair 232, and stacked. When guided to the reversing path RP, the paper 228 is reversed by a reversing unit 238, and fed toward the resist roller pair 21B4 again.

By such a configuration, in the color copying machine 1, an electrostatic latent image is formed on the uniformly charged photosensitive drums 23 by exposing and scanning the document placed on the contact glass 280, or according to the image information from the computer, and after the electrostatic latent image is visualized by the development unit 26, the toner image is primary-transferred onto the intermediate transfer belt 22.

The toner image transferred onto the intermediate transfer belt 22 is then transferred onto the paper 228 fed from the paper feeder 21B, in the case of a single-color image. In the case of a multi-color image, each color image is superposed on each other by repeating the primary transfer, and then the images are secondary-transferred onto the paper 228 collectively.

The paper 228 after the secondary transfer is ejected onto the output tray 227, with the unfixed image fixed by the fixing apparatus 211, or reversed and sent to the resist roller pair 21B4 again for dual side printing.

In Application Example 3, the detection target surface is the intermediate transfer belt 22 as the transfer body, but the respective photosensitive drums may be used as the detection target surface (Application Example 4 of the second embodiment). In this case, the P sensor 40 is provided so as to face the respective photosensitive drums.

Figure 46:
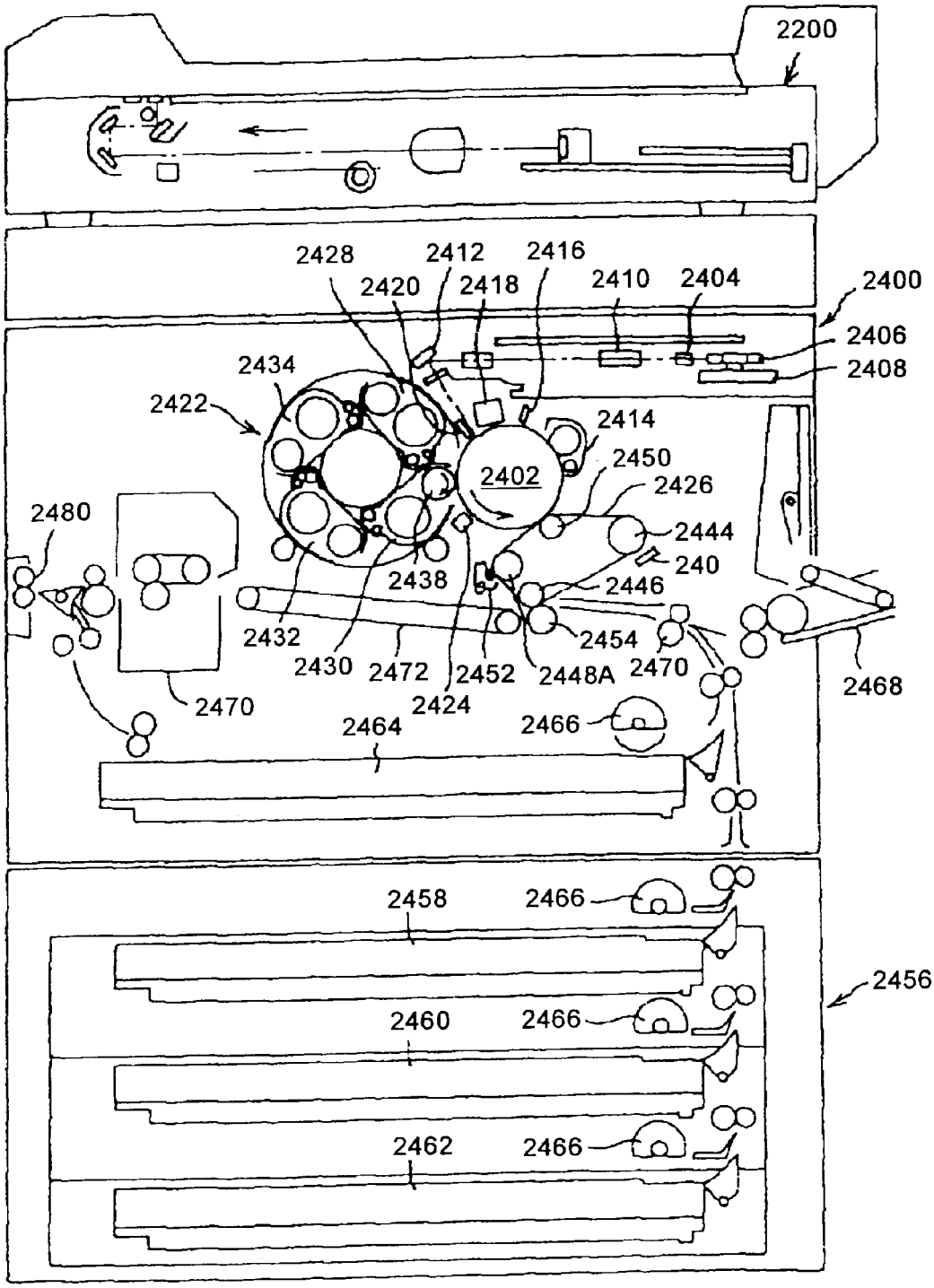
FIG. 46 is a schematic front elevation of a color image forming apparatus of a type in which respective toner images are transferred and superposed onto an intermediate transfer body by one photosensitive drum and then collectively transferred onto transfer paper.

Further, in a color image forming apparatus of a type in which the respective color toner images are formed by using one photosensitive drum and a revolver type development unit, and the respective toner images are transferred and superposed on the intermediate transfer body, and then transferred onto the transfer paper as the recording medium collectively (Application Example 5 of the second embodiment). One example thereof is illustrated in FIG. 46.

In Application Example 5, the P patterns for density detection as illustrated in FIG. 30 are formed on the intermediate transfer belt 2426 as the intermediate transfer body, and these patterns are detected by the P sensor 240 arranged near the drive roller 2444. That is, the intermediate transfer belt 2426 is the detection target surface. The detection method and the operation (handling of the detection data and the like) are the same as in the second embodiment.

The outline of the configuration of the color copying machine as the image forming apparatus in Application Example 5 will be explained below.

In the color copying machine, a write optical unit 2400 as the exposure unit converts the color image data from a color scanner 2200 to an optical signal, and perform optical write corresponding to the original image, to form an electrostatic latent image on a photosensitive drum 2402, being an image carrier.

The write optical unit 2400 includes a laser diode 2404, a polygon mirror 2406 and a motor 2408 for rotation thereof, an fθ lens 2410, and a reflection mirror 2412.

The photosensitive drum 2402 is rotated in a counterclockwise direction as indicated by the arrow, and a photosensitive material cleaning unit 2414, a discharging lamp 2416, a potential sensor 2420, a development unit selected from a rotary development unit 2422, a development density pattern detector 2424, and an intermediate transfer belt 2426 as the intermediate transfer body are arranged around the photosensitive drum 2402.

The rotary development unit 2422 has a black development unit 2428, a cyan development unit 2430, a magenta development unit 2432, a yellow development unit 2434, and a rotary actuator (not shown) that rotates the respective development units. The respective development units are a so-called two-component developing type development unit having a carrier and toner mixed developer, and have the same configuration as that of the development unit 24. The condition and the specification of the magnetic carrier are the same.

In the standby state, the rotary development unit 2422 are set to a position of black development, and when the copying operation is started, readout of the black image data is started at a predetermined timing by the color scanner 2200, and based on this image data, optical write by the laser beams and formation of an electrostatic latent image (black electrostatic latent image) are started.

In order to develop from the point of the black latent image, rotation of the developing sleeve is started to develop the black electrostatic latent image with the black toner, before the point of the latent image reaches the developing position of the black development unit 2428. A toner image of a negative polarity is formed on the photosensitive drum 2402.

Thereafter, the development operation for the black latent image area is continued. At a point in time when the rear end of the latent image passes the black developing position, the rotary development unit 2422 rotates promptly from the black developing position to the next color developing position. This operation is to be completed at least until the point of the latent image by the next image data reaches the developing position.

When the image forming cycle is started, at first, the photosensitive drum 2402 is rotated in the counterclockwise direction as indicated by the arrow, and the intermediate transfer belt 2426 is rotated in the clockwise direction, by a drive motor (not shown). With a rotation of the intermediate transfer belt 2426, formation of the black toner image forming of the cyan toner image forming of the magenta toner image, and formation of the yellow toner image are performed, and finally superposed on the intermediate transfer belt 2426 (primary transfer) in the order of black (Bk), cyan (C), magenta (M), and yellow (Y), thereby forming toner images.

The intermediate transfer belt 2426 is laid across the respective support members, such as a primary transfer electrode roller 2450 facing the photosensitive drum 2402, a drive roller 2444, a roller 2446 facing a secondary transfer roller 2454, and a roller 2448A facing a cleaning unit 2452 that cleans the surface of the intermediate transfer belt 2426, in a tensioned state, and drive-controlled by a drive motor (not shown).

The respective toner images of black, cyan, magenta, and yellow sequentially formed on the photosensitive drum 2402 are sequentially registered on the intermediate transfer belt 2426, thereby four-color superposed belt transfer images are formed. These belt transfer images are collectively transferred onto the paper by the roller 2446.

Paper of various sizes different from the size of the paper stored in a cassette 2464 in the apparatus is stored in the respective recording medium cassettes 2458, 2460, and 2464 in a feed bank 2456. From a storage cassette for paper of a specified size of these cassettes, the specified paper is fed and transported in the direction toward a resist roller pair 2470 by a feed roller 2466. In FIG. 46, a sign 2468 denotes a manual feed tray for overhead projector (OHP) transparencies or thick papers.

When the image forming is started, the paper is fed from a feeding port of any cassette, and stands by at a nip portion of the resist roller pair 2470. The resist roller pair 2470 is driven so that when the point of the toner image on the intermediate transfer belt 2426 approaches the secondary transfer facing roller 2446, the point of paper agrees with the point of the image, thereby performing resist adjustment between the paper and the image.

Thus, the paper is superposed on the intermediate transfer belt 2426, and passes under the secondary transfer facing roller 2446, to which the voltage of the polarity the same as that of the toner is applied. At this time, the toner image is transferred onto the paper. Subsequently, the paper is discharged, separated from the intermediate transfer belt 2426, and shifted onto a carrier belt 2472.

The paper on which the four-color superposed images are collectively transferred from the intermediate transfer belt 2426 is carried to a fixing apparatus 2470 of a belt fixing type by the carrier belt 2472, where the toner image is fixed by heat and pressure. The paper after fixation is ejected outside of the apparatus by an ejection roller pair 2480, and stacked in a tray (not shown). As a result, a full color copy can be obtained.

In Application Example 5, the detection target surface is the intermediate transfer belt 2426 as the transfer body, but the photosensitive drum 2402 may be used as the detection target surface (Application Example 6 of the second embodiment). In this case, the P sensor 40 is provided so as to face the photosensitive drum 2402.

In the second embodiment and the application examples thereof, processing is performed based on the minimum value of a ratio between the regular reflection output and the diffuse reflection output, but the similar detection function can be realized by a method in which processing is performed based on the minimum value of a ratio between the regular reflection output increment and the diffuse reflection output increment which are obtained from a difference between respective output values at the time of the light emitting unit being OFF.

In the respective embodiments, the image forming apparatus is exemplified as a toner transfer detection apparatus, but also in a transfer detection field in which toner other than the toner is handled, the similar detection function can be realized by the similar processing method.

The effects obtained in the second embodiment and the application examples thereof will be explained below.

In the conventional technique, since the color transfer detectable range becomes gradually narrow, due to a decrease in the age-based gloss level on the detection target surface, deterioration of the detection target surface due to wear becomes a rate-limiting factor of the life. However, by performing the conversion processing, the transfer detectable range expands as compared with that of the conventional detection of regular reflection light, and hence accurate transfer detection can be performed, without depending on the gloss level.

Further, in this embodiment, since transfer detection does not depend on the deterioration of the detection target surface due to wear, the service life of the detection target surface can be extended.

By applying the regular reflection output conversion algorithm to the transfer detection in which the image carrier or the transfer body in the color image forming apparatus is designated as the detection target surface, transfer can be converted without any problem even on a detection target surface such as a belt having a low gloss level, in which it is considered to be difficult to detect the density in the conventional technique, and density control can be performed based on the amount-of-transfer conversion value.

Further, by performing the conversion processing, in the low transfer range of from transfer zero to one toner layer formation, the diffuse reflection output can be converted to a value, by which a linear relation with respect to the transfer can be obtained.

By performing the conversion processing (the automatic correction function of the diffuse reflection output sensitivity), a difference in the diffuse reflection output (the hardware side) resulting from an output difference of the light emitting diode and the photodetector in the density detection sensor can be corrected on the amount-of-transfer conversion algorithm side (the software side). As a result, the adjustment operation on the sensor side (the hardware side) at the time of the final inspection of the sensor, which has been heretofore performed, becomes unnecessary, or the span of adjustable range can be greatly expanded.

With the diffuse reflection type sensor mounted on the conventional apparatus by the present applicant, about two minutes are required for the output adjusting time for each sensor, but as a result of enlarging the tolerance range, adjustment can be performed only for less than ten seconds.

As a result, the productivity in manufacturing the sensors can be considerably improved, thereby realizing cost reduction of the sensor, and cost reduction of the image forming apparatus.

Further, stable amount-of-transfer conversion at all times can be performed by the automatic correction function for the diffuse reflection output sensitivity, with respect to a drop in the quantity of light of the LED with the lapse of time in the density detection sensor, and an output change of the light emitting diode and the photodetector due to the temperature characteristics.

Even when the detection target surface is black, in which in the conventional technique, sensitivity calibration has been difficult with the sensor using only the diffuse reflection output (type (2)), accurate sensitivity calibration and transfer detection can be performed.

Further, in the sensor using both the regular reflection output and the diffuse reflection output (types (3) and (4)), the accuracy in transfer detection has been conventionally dropped with the lapse of time, resulting from a characteristic change due to deterioration of the detection target surface. However, since the age-based characteristic change of the detection target surface can be detected on the algorithm side (the software side), by the automatic correction function for the diffuse reflection output sensitivity, the diffuse reflection output can be converted to a transfer accurately, regardless of the gloss level even when the gloss level on the detection target surface is very low, or in the case of black. As a result, long life of the detection target surface and a reduction of the running cost can be realized.

By applying the diffuse reflection output conversion algorithm to transfer detection in which the image carrier or the transfer body in the color image forming apparatus is designated as the detection target surface, transfer detection can be performed without any problem, even on a belt having a low gloss level, in which it is considered to be difficult to detect the density in the conventional technique, or even when the detection target surface is a black belt. As a result, the solid transfer, being the maximum transfer target value, can be detected, and hence stable image density control can be performed at all times, regardless of an age-based change or environmental change.

Further, the service life of the photosensitive material, being the detection target surface, or the image carrier such as a transfer belt can be extended. The detection target surface of the transfer belt and the like is generally formed in a unit integrally with the development unit or the like, and collective replacing method is adopted. However, since early collective replacement due to a decrease in the detection accuracy resulting from deterioration only of the detection target surface is not required, the running cost can be considerably reduced, in view of the relation with other unit parts still having the service life.

More accurate amount-of-transfer conversion becomes possible, by having at least one, and desirably, at least three transfer patterns (number of transfer patches) near a transfer where a minimum value of a ratio between the regular reflection output and the diffuse reflection output can be obtained.

Further, more accurate amount-of-transfer conversion becomes possible, by having at least one, and desirably, at least three transfer patterns near a transfer where a minimum value of a ratio between the regular reflection output increment and the diffuse reflection output increment, obtained from a difference between the respective output values can be obtained.

Further, more accurate amount-of-transfer conversion becomes possible, by having at least one, and desirably, at least three transfer patterns in a certain transfer range where the regular reflection output conversion value has a primary linear relation with the transfer.

According to the second embodiment, stable transfer detection at all times can be performed highly accurately, regardless of factors, such as a lot difference in the light emitting diode output and the photodetector output, a change due to temperature characteristics, deterioration, and deterioration of the detection target surface.

A third embodiment of the present invention is for a color laser printer in which the amount of toner transfer is detected through the similar processing to that of the second embodiment, to control the toner density, and since the configuration of the apparatus and the processing according to the amount-of-transfer conversion algorithm for the diffuse reflection output are the same as those of the second embodiment, the explanation thereof is omitted.

Figure 47:
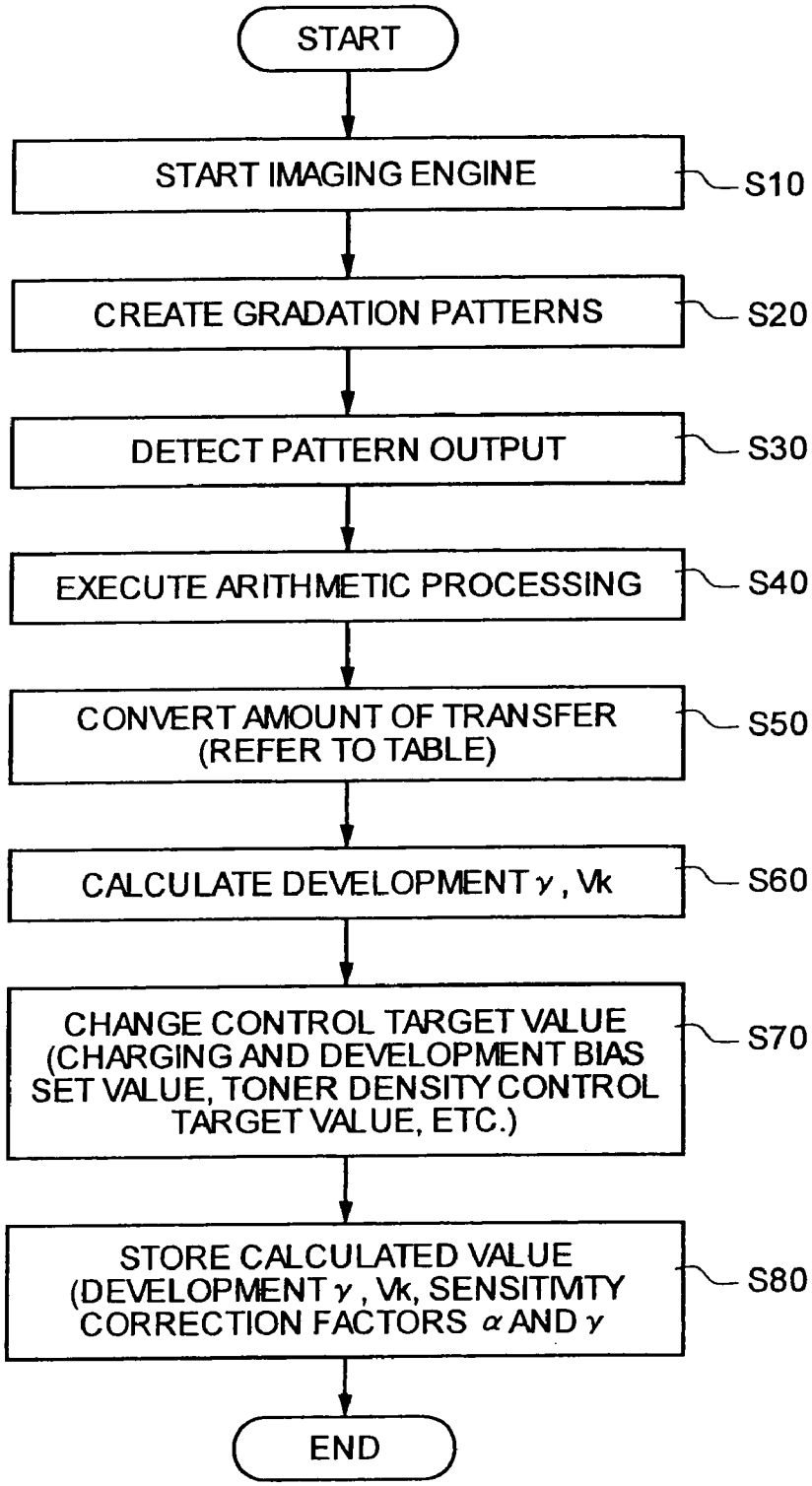
FIG. 47 is a flowchart of process control operation for optimizing the image density.

In the color laser printer in the third embodiment, the process control operation is executed, separately from the image forming mode, in order to optimize the image density of the respective colors, at the time of toner on, or after a predetermined number of sheets has been fed. The flow of the process control operation is as illustrated in FIG. 47.

The predetermined gradation patterns 270 (=density detection pattern, hereinafter, as P patterns) illustrated in FIG. 30 are formed on the transfer belt 218 by sequentially changing over the charging bias and the development bias at an appropriate timing for each color (STEP 20), the output voltage of these P patterns is detected by the density detection sensor (hereinafter, as P sensor) arranged outside of the transfer belt 218 close to the drive roller 219 (STEP 30), and the output voltage is converted to a transfer by the amount-of-transfer conversion algorithm (the toner amount-of-transfer conversion method) of the present invention (STEPS 40 to 50), to perform calculation of (development y and development starting voltage Vk) expressing the current development ability (STEP 60). Based on the calculated values, the development bias and the toner density control target value are changed (STEP 70), and the calculated values (development $\gamma$, development starting voltage Vk, and sensitivity correction factors $\alpha$ and $\gamma$) are stored in a memory of a control unit (not shown) (a main controller of the color laser printer can perform this function)(STEP 80).

The predetermined gradation pattern here stands for a normal density detection pattern having a predetermined number of patches, as in the second embodiment.

Hereinafter, it may be also simply referred to as gradation patterns.

Since the arithmetic processing (amount-of-transfer conversion algorithm processing for the diffuse reflection output) at STEP 40 in the third embodiment is the same processing at STEPS 1 to 6 explained in the second embodiment, detailed explanation thereof is omitted.

At the next STEP 50 in FIG. 47, the diffuse reflection output after the sensitivity correction unequivocally expressed with respect to the amount of toner transfer obtained at STEP 40 is converted to a transfer according to an amount-of-transfer conversion look-up table (LUT) or the inversion expression.

Figure 48:
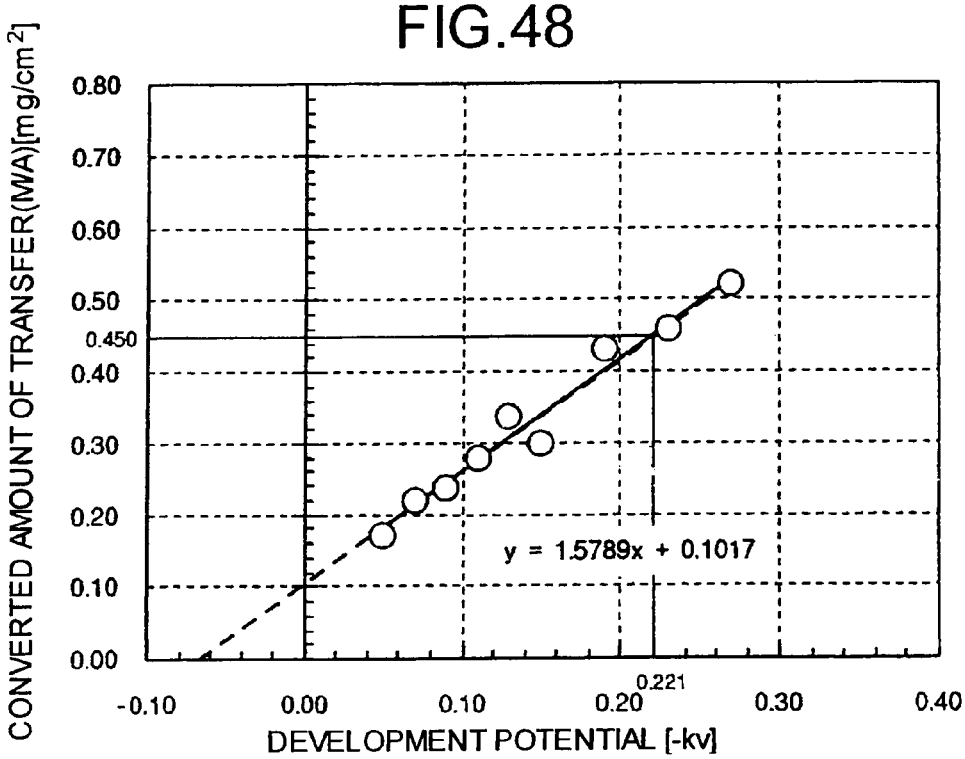
FIG. 48 is a graph illustrating a straight line obtained by plotting amount-of-transfer conversion values with respect to the development potential at the time of imaging the respective gradation patterns.

At STEP 60, from a line obtained by plotting the amount-of-transfer conversion values obtained at STEP 50 with respect the development potential (=potential of the development roller section−potential of the exposure section) at the time of forming images of the respective gradation patterns, as illustrated in FIG. 48, the development γ (inclination of the line) and development starting voltage (X intercept) are calculated, to calculate the development bias so that the maximum controlled transfer target value in the solid part (in this embodiment, M/A=0.4 mg/cm$^2$) becomes the intended value.

(development bias=development potential−potential in exposure section=−0.221−0.05=−0.271 kilovolts)

Figure 51:
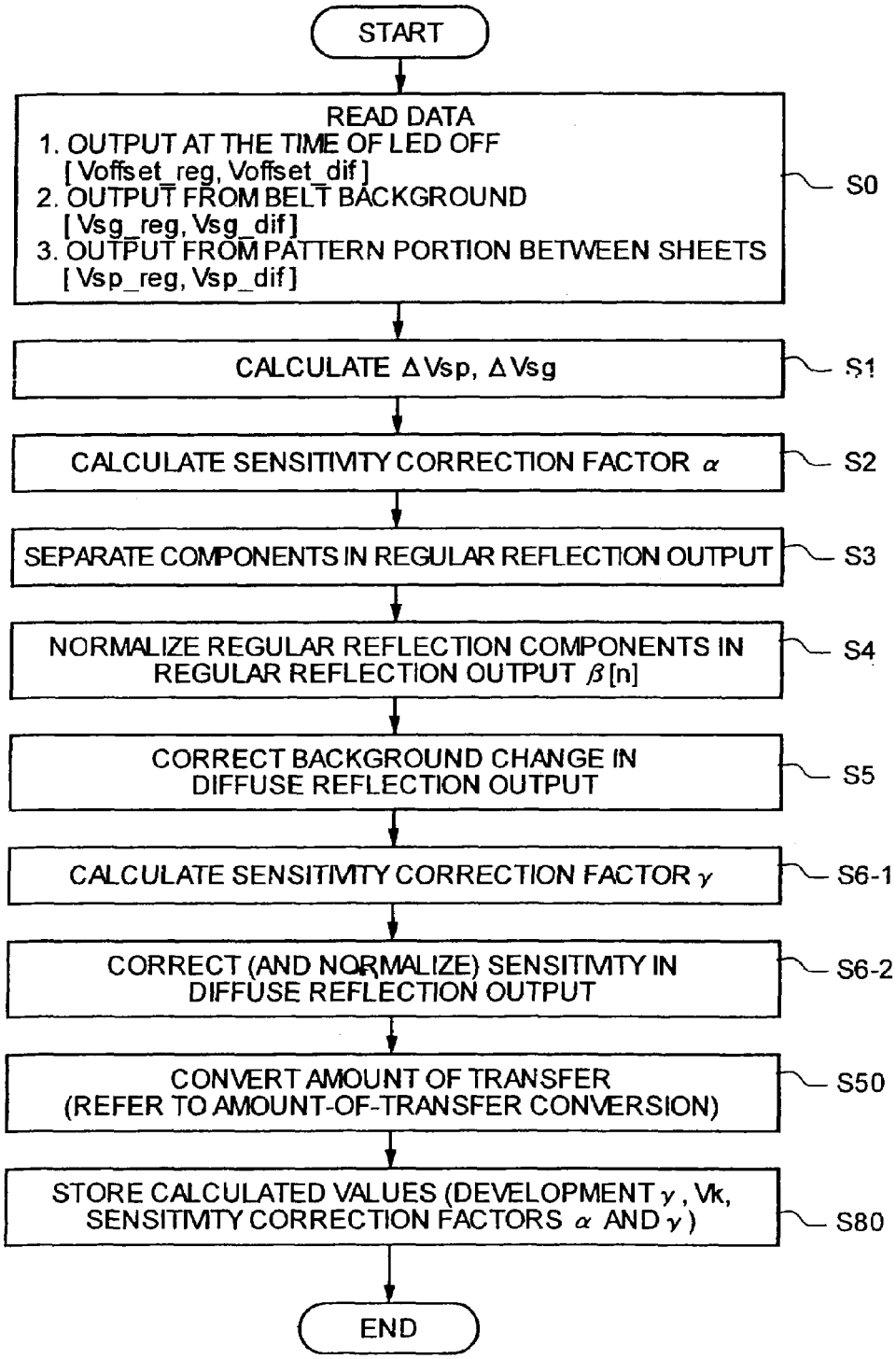
FIG. 51 is a flowchart of amount-of-transfer conversion algorithm processing operation in an independent execution mode.

Lastly, from the above calculation, the sensitivity correction factor α obtained at STEP 2 in FIG. 51, the sensitivity correction factor γ obtained at STEP 6, development y calculated at STEP 60 in FIG. 47, and the development starting voltage Vk are stored in an NV-RAM as a memory, to finish the processing operation.

The processing flow described above becomes the process control operation flow to be executed at the time of toner on, or after a predetermined number of sheets has been fed, separately from the image forming mode.

By using such an amount-of-transfer conversion algorithm, automatically correctable amount-of-transfer conversion becomes possible, (1) without requiring strict adjustment in the output relation between the "regular reflection output" and the "diffuse reflection output" on the sensor side (hardware side), (2) even on the black transfer belt, and (3) even if there is an age-based change or an environmental change in the transfer belt and the density detection sensor.

However, when the algorithm is to be executed, the sensitivity correction factors α and γ used for amount-of-transfer conversion cannot be obtained, unless the gradation patterns are formed. In other words, in order to obtain sensitivity correction factors that make automatic correction possible with respect to age-based changes and environmental changes of the transfer belt and the density detection sensor, it is essential to prepare the gradation patterns, and in the process control operation between sheets in which the transfer patterns should be decreased, highly accurate amount-of-transfer conversion calculation is not possible.

In other words, when image output is continuously performed in large quantities, downtime occurs due to the creation of the gradation patterns (repeatability decreases at the time of image output), and hence the density control characteristics according to the algorithm cannot be used effectively.

It is considered here on what are the sensitivity correction factors α and γ obtained from the calculation. The sensitivity correction factor α is a ratio between the diffuse reflection components in the regular reflection output entering into the regular reflection photodetector and the diffuse reflection components entering into the diffuse reflection photodetector, and this value is determined by the optical layout such as the light-receiving diameter and arrangement of the respective photodetectors, and a difference in the OP amplifier gains of the respective outputs in the circuit.

The sensitivity correction factor γ is the output sensitivity itself of the diffuse reflection output, and this value is determined mainly by an output difference of the diffuse reflection photodetectors and the quantity of emitted light on the light emitting diode side.

Figure 49:
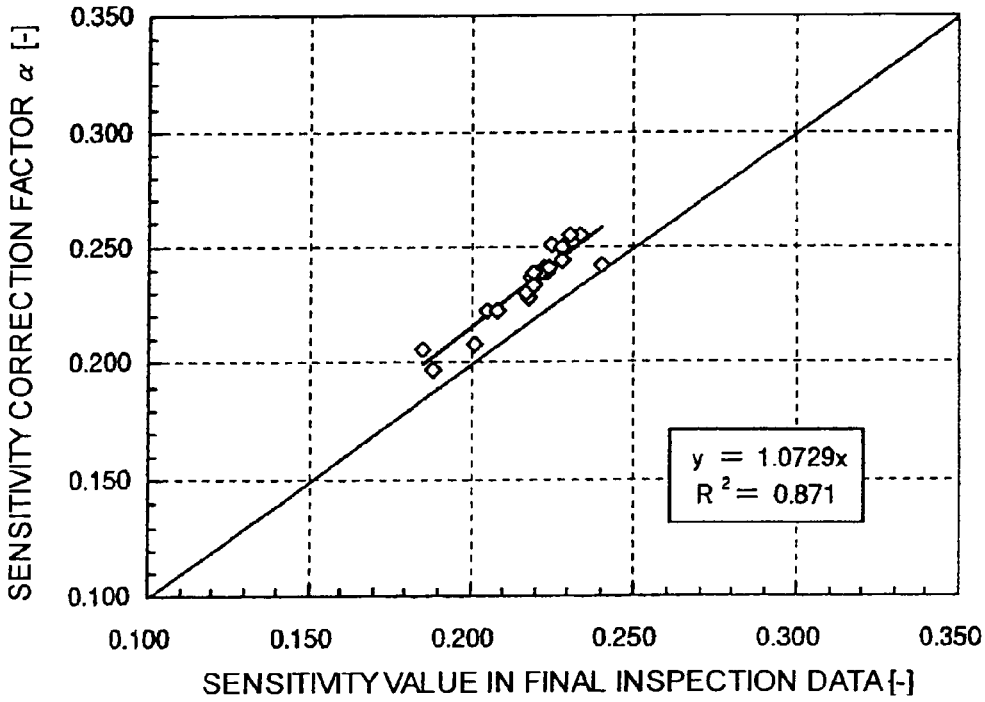
FIG. 49 is a graph illustrating relations between the sensitivity in final inspection data and a sensitivity correction factor $\alpha$.
Figure 50:
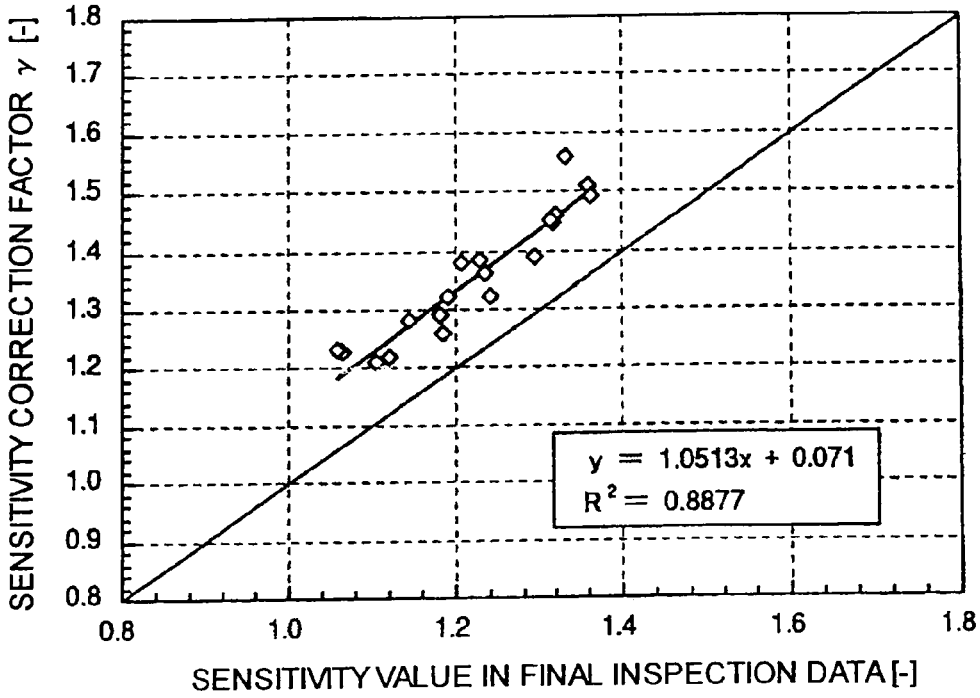
FIG. 50 is a graph illustrating relations between the sensitivity in the final inspection data and a sensitivity correction factor $\gamma$.

In order to actually confirm this for reference, 20 pieces in total of upper limit products, lower limit products, and intermediate products, determined from the final inspection data, are picked up from 130 sensors manufactured at a certain period, and these sensors are sequentially mounted in the color laser printer illustrated in FIG. 13, to check the correlation between the sensitivity correction factors α and γ obtained at the time of executing the process control operation and the sensor sensitivity in the final inspection data. The results are illustrated in FIG. 49 (correlation between the sensitivity in the final inspection data and the sensitivity correction factor α) and FIG. 50 (correlation between the sensitivity in the final inspection data and the sensitivity correction factor γ). These are values when the LED adjustment is performed so that Vsg_reg. Becomes 4.0 volts both in the final inspection and in the actual sensor.

From the correlation between these in the two graphs, it is seen that the sensitivity correction factors obtained by the amount-of-transfer conversion algorithm is the sensitivity of the sensor itself.

Therefore, the sensitivity correction factors may change due to deterioration of the photodetector in the sensor over a long period, and hence it can be said that the value may change due to the temperature characteristics of the element with respect to the environmental change.

Figure 53:
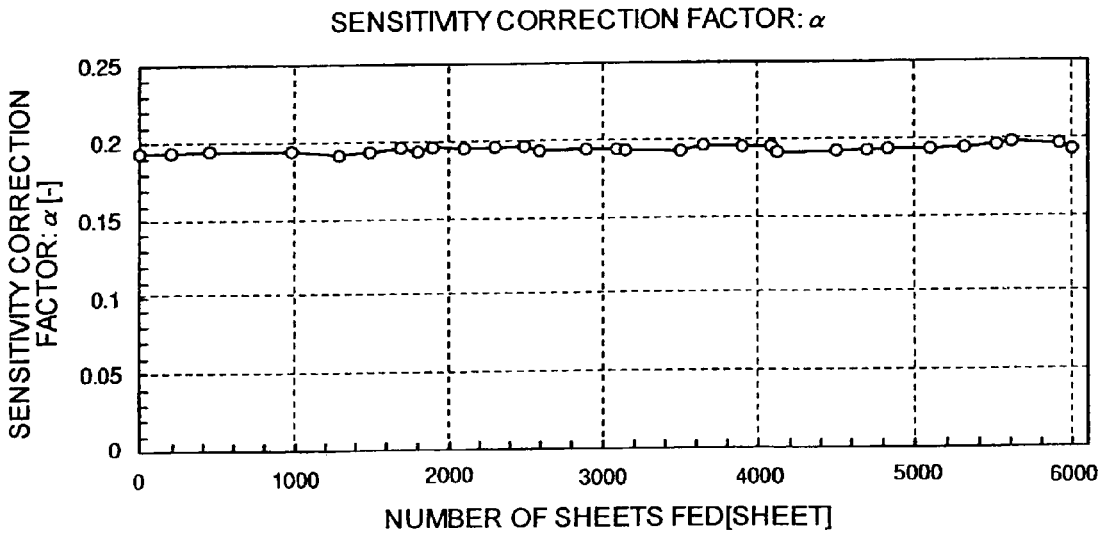
FIG. 53 is a graph illustrating variation experimental data of the sensitivity correction factor $\alpha$ in the number of fed paper.
Figure 54:
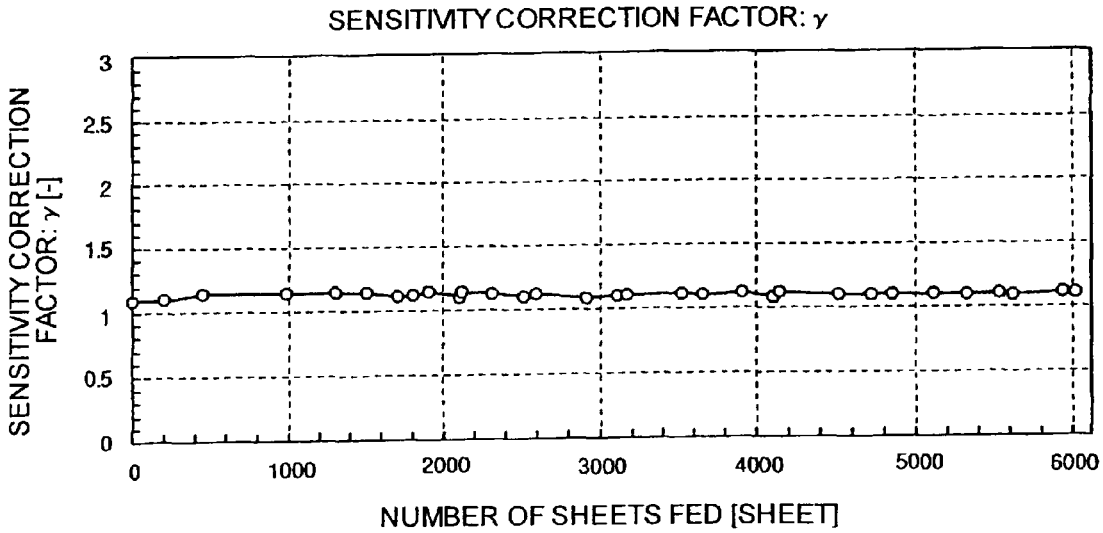
FIG. 54 is a graph illustrating variation experimental data of the sensitivity correction factor $\gamma$ in the number of fed paper.

Actually, however, any change can be hardly seen in the level of 6,000 sheets, as is obvious from FIG. 53 (variable experimental value of the sensitivity correction factor α in the number of fed sheets) and FIG. 54 (variable experimental value of the sensitivity correction factor γ in the number of fed sheets).

When attention is given to this point, as in between sheets during continuous feeding, even if only one pattern can be formed when an area where the P pattern can be formed is narrow (outside the image forming area), if the sensitivity correction factors α and γ obtained by the execution with the previous gradation patterns are stored in the NVRAM area, by using these, transfer detection can be performed with a small number of patterns, without actually forming the gradation patterns.

Figure 52:
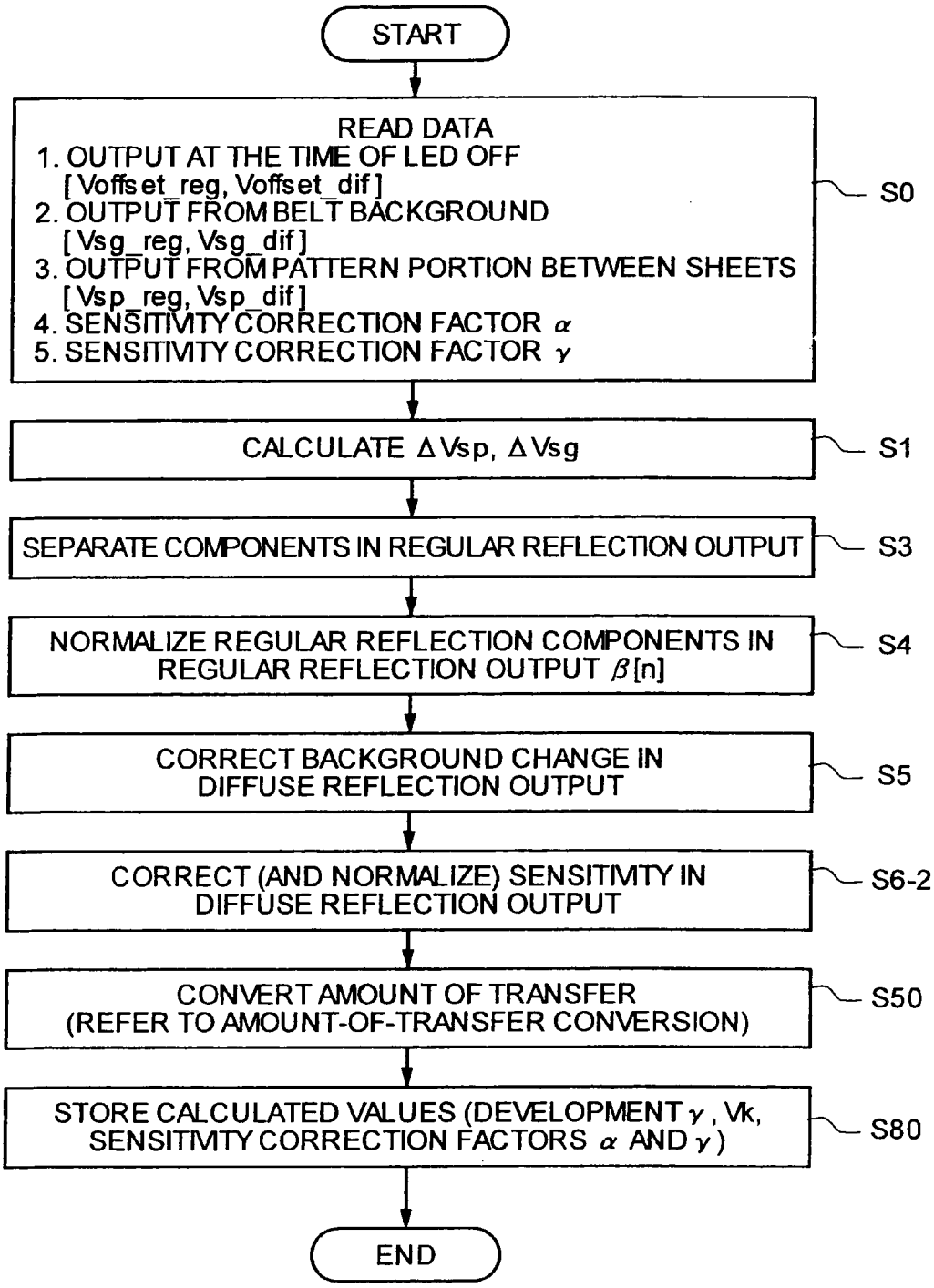
FIG. 52 is a flowchart of processing operation in a between-sheets process control mode.

FIG. 51 illustrates the process control operation flow to be executed at the time of toner on, or after a predetermined number of sheets are fed, separately from the image forming mode, and FIG. 52 illustrates the amount-of-transfer conversion processing flow at the time of process control between sheets.

As illustrated in FIG. 52, if the calculated sensitivity correction factors α and γ (required for transfer calculation) obtained by executing the previous process control are read out from the memory and used for the calculation at the time of process control between sheets, even if the number of patches is only one, amount-of-transfer conversion can be performed accurately as in the case of forming the gradation patterns, and contribution to a reduction in the CPU load is possible when there is a lot of processing on the engine control side, as in between sheets at the time of feeding sheets, and much CPU load cannot be applied.

Figure 37:
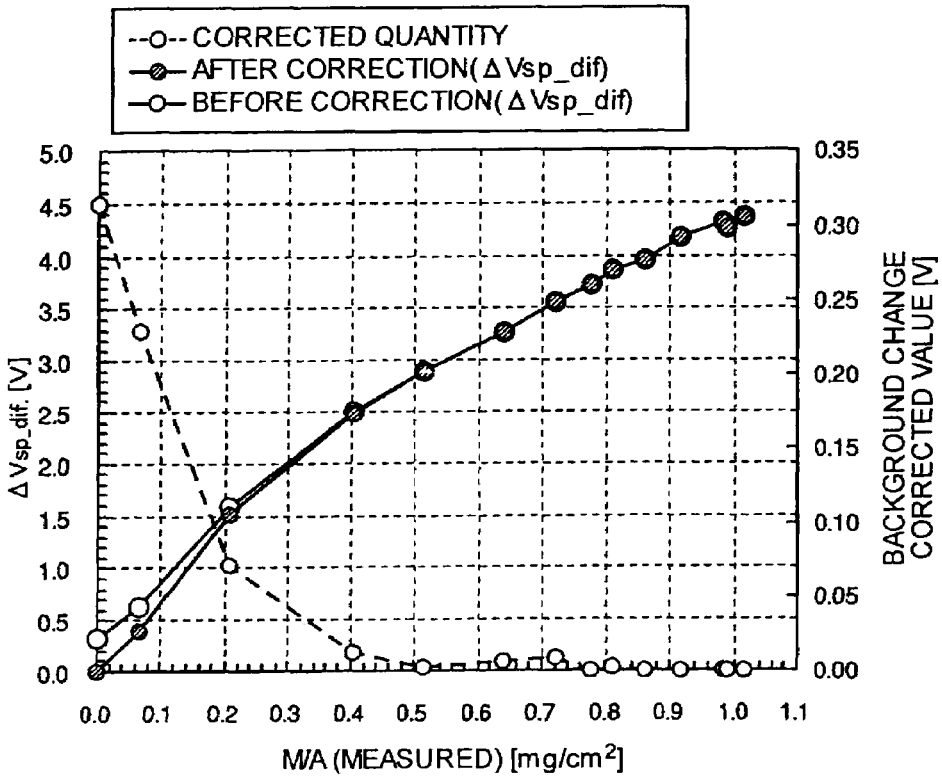
FIG. 37 is a graph illustrating relations between a background change correction amount of the diffuse reflection output, the transfer, and the detection output.

As illustrated in FIGS. 53 and 37, even when the number of fed sheets is 6,000, the sensitivity correction factors α and γ hardly change, but these are values that may change due to deterioration of the photodetector and the light emitting diode in the sensor over a long period, and may change due to the temperature characteristics of the elements with respect to the environmental change.

Therefore, a paper feed level, at which a change occurs such that the sensitivity correction factors α and γ cannot be used for the process control calculation between sheets, is determined by experiments (including computer simulation), and the number of fed transfer paper (number of fed sheets) is counted, and when the total number reaches a predetermined value, new detection operation with the predetermined gradation patterns illustrated in FIG. 51 (an individual execution mode, which does not accompany the image forming operation) is performed, and the obtained sensitivity correction factors α and γ are overwritten on the data stored in the memory and updated Thus, an age-based decrease in the accuracy of density control according to the algorithm can be prevented for a long period.

In the respective embodiments, the density control method using the toner as the toner is exemplified, but the similar detection function can be obtained by the similar processing method, also in the density control method handling toner other than the toner.

According to the third embodiment, when the toner patterns (gradation patterns) cannot be formed continuously, for example between sheets, the sensitivity correction factors calculated in the amount-of-transfer conversion processing at the time of image density control operation individually executed at the time other than the image forming are stored in the memory, and by reading out these values at the time of process control between sheets and using for the calculation, the density control accuracy of the same level as that in the image density control using the algorithm individually executed at the time other than the image forming can be obtained. At the time of image density control operation in which the number of patterns is only one, reliable amount-of-transfer conversion can be performed.

Further, by applying such an image density control method to the image forming apparatus, an image forming apparatus having excellent stability can be provided with less age-based change, environmental change and repeat change.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus, comprising:

a forming unit configured to form a color image by sequentially superposing toner images formed on a plurality of image carriers onto an intermediate transfer body, and collectively transfer the color image onto a recording medium, wherein controlling an image density is executed by using the intermediate transfer body as a detection target the forming unit is further configured to form a plurality of predetermined gradation patterns of powder having different amounts of powder transferred continuously on a surface of the detection target;

a detection unit configured to optically detect the predetermined gradation patterns;

an acquiring unit configured to acquire data of the detected predetermined gradation patterns and data arithmetically processed based on the data of the detected predetermined gradation patterns;

an extraction unit configured to extract a regular reflection light component by separating a regular reflection output from the detected predetermined gradation patterns into the regular reflection light component and a diffuse reflection light component;

a conversion unit configured to convert the regular reflection light component into a normalized value;

a determining unit configured to determine a first-order linear relation between the normalized value and an amount of toner transferred within a range in which detection of an amount of toner transferred by the regular reflection of light is possible;

a storage unit configured to store data patterns obtained by detecting the predetermined gradation patterns, and necessary for maintaining accuracy in density control with fewer patterns than the predetermined gradation patterns to a level equal to an accuracy in density control with the predetermined gradation patterns; and a control unit configured to control the image density of the color image with fewer patterns by using the stored data.

2. An image forming apparatus, comprising:

a forming unit configured to form a color image by sequentially superposing toner images formed on a plurality of image carriers onto an intermediate transfer body, and collectively transfer the color image onto a recording medium, wherein controlling an image density is executed by using the image carriers as a detection target the forming unit is further configured to form a plurality of predetermined gradation patterns of powder having different amounts of powder transferred continuously on a surface of the detection target;

a detection unit configured to optically detect the predetermined gradation patterns;

an acquiring unit configured to acquire data of the detected predetermined gradation patterns and data arithmetically processed based on the data of the detected pretermined gradation patterns;

an extraction unit configured to extract a regular reflection light component by separating a regular reflection output from the detected predetermined gradation patterns into the regular reflection light component and a diffuse reflection light component;

a conversion unit configured to convert the regular reflection light component into a normalized value;

a determining unit configured to determine a first-order linear relation between the normalized value and an amount of toner transferred within a range in which detection of an amount of toner transferred by the regular reflection of light is possible;

a storage unit configured to store data patterns obtained by detecting the predetermined gradation patterns, and necessary for maintaining accuracy in density control with fewer patterns than the predetermined gradation patterns to a level equal to an accuracy in density control with the predetermined gradation patterns; and a control unit configured to control the image density of the color image with fewer patterns by using the stored data.

3. An image forming apparatus, comprising:

a forming unit configured to form a color image by sequentially superposing toner images formed on an image carrier onto an intermediate transfer body, and collectively transfer the color image onto a recording medium, wherein controlling an image density is executed by using the intermediate transfer body as a detection target the forming unit configured to form a plurality of predetermined gradation patterns of powder having different amounts of powder transferred continuously on a surface of the detection target;

a detection unit configured to optically detect the predetermined gradation patterns;

an acquiring unit configured to acquire data of the detected predetermined gradation patterns and data arithmetically processed based on the data of the detected predetermined gradation patterns;

an extraction unit configured to extract a regular reflection light component by separating a regular reflection output from the detected predetermined gradation patterns into the regular reflection light component and a diffuse reflection light component;

a conversion unit configured to convert the regular reflection light component into a normalized value;

a determining unit configured to determine a first-order linear relation between the normalized value and an amount of toner transferred within a range in which detection of an amount of toner transferred by the regular reflection of light is possible;

a storage unit configured to store data patterns obtained by detecting the predetermined gradation patterns, and necessary for maintaining accuracy in density control with fewer patterns than the predetermined gradation patterns to a level equal to an accuracy in density control with the predetermined gradation patterns; and a control unit configured to control the image density of the color image with fewer patterns by using the stored data.

4. An image forming apparatus, comprising:

a forming unit configured to form a color image by sequentially superposing toner images formed on an image carrier onto an intermediate transfer body, and collectively transfer the color image onto a recording medium, wherein controlling an image density is executed by using the image carriers as a detection target, the forming unit configured to form a plurality of predetermined gradation patterns of powder having different amounts of powder transferred continuously on a surface of the detection target;

a detection unit configured to optically detect the predetermined gradation patterns;

an acquiring unit configured to acquire data of the detected predetermined gradation patterns and data arithmetically processed based on the data of the detected predetermind gradation patterns;

an extraction unit configured to extract a regular reflection light component by separating a regular reflection output from the detected predetermined gradation patterns into the regular reflection light component and a diffuse reflection light component;

a conversion unit configured to convert the regular reflection light component into a normalized value;

a determining unit configured to determine a first-order linear relation between the normalized value and an amount of toner transferred within a range in which detection of an amount of toner transferred by the regular reflection of light is possible;

a storage unit configured to store data patterns obtained by detecting the predetermined gradation patterns, and necessary for maintaining accuracy in density control with fewer patterns than the predetermined gradation patterns to a level equal to an accuracy in density control with the predetermined gradation patterns; and a control unit configured to control the image density of the color image with fewer patterns by using the stored data.

* * * * *